US005857294A

United States Patent [19]

Castro

[11] Patent Number: 5,857,294

[45] Date of Patent: Jan. 12, 1999

[54] DOME ROOF STRUCTURE AND METHOD OF DESIGNING AND CONSTRUCTING SAME

[76] Inventor: Gerardo Castro, Calle 114 No. 42-26, Bogota, Colombia

[21] Appl. No.: 286,471

[22] Filed: Aug. 5, 1994

[51] Int. Cl.[6] ..... E04B 7/10

[52] U.S. Cl. ..... 52/81.2; 52/6; 52/80.1

[58] Field of Search ..... 52/6, 80.1, 81.2

[56] References Cited

U.S. PATENT DOCUMENTS

| | | | |
|---|---|---|---|
| 2,908,236 | 10/1959 | Kiewitt | 52/81.2 |
| 3,137,097 | 6/1964 | Zeinetz | 52/81.2 |
| 3,139,957 | 7/1964 | Fuller | 52/81.2 X |
| 3,772,836 | 11/1973 | Geiger . | |
| 3,835,599 | 9/1974 | Geiger . | |
| 3,841,038 | 10/1974 | Geiger . | |

(List continued on next page.)

FOREIGN PATENT DOCUMENTS

| | | | |
|---|---|---|---|
| 403137332 | 6/1991 | Japan | 52/81.2 |
| 405148901 | 6/1993 | Japan | 52/80.1 |
| 406101274 | 4/1994 | Japan | 52/80.1 |

OTHER PUBLICATIONS

Seminar Paper "Hypar–Tensegrity Roofs—A Celebration in Fabric and Cables" by Matthys Levy, of Weidlinger Associates, Inc., New York, New York, published in *Olympic and Sporting Structures* by The Structural Branch of the NSW Chapter of the Association of Consulting Engineers (pp. 93–110); Sep. 2, 1992.

"Analysis of The Georgia Dome Cable Roof" by Gerardo Castro and Matthys P. Levy, in Computing in Civil Engineering and Geographic Information Systems Symposium, edited by Barry J. Goodno and Jeff R. Wright, published by ASCE; Jun. 1992.

"Floating Fabric Over Georgia Dome" by Matthys Levy, published in Civil Engineering, Nov. 1991 (pp. 34–37).

"Tensile Membrane Structures" by J. Schlaich, R. Bergermann and W. Sobek, in Bulletin Of The International Association For Shell And Spatial Structures (IASS) vol. 31, No. 1–2 (pp. 19–32); 1990.

Chapter 17 Aspension (Geodesic Structures) (1964) of Inventions: The Patented Works of R. Buckminster Fuller, pp. 201–213, published by St. Martin's Press, New York; Circa 1989.

"Retractable Roof Olympic Stadium Montreal" by Luc Lainey, Normand Morin, Jorg Schlaich and Rudolf Bergermann (6 pages); Circa 1988.

*Primary Examiner*—Carl D. Friedman
*Assistant Examiner*—Yvonne Horton-Richardson
*Attorney, Agent, or Firm*—Hopgood, Calimafde Kalil & Judlowe

[57] ABSTRACT

A structural system that can be used to cover an underlying area exactly or approximately defined by a circle, an ellipse, a superellipse, a triangle, a rectangle, a regular polygon, an irregular polygon, or any closed boundary line. When viewed in plan, the roof structure substantially matches the boundary of the underlying area. The roof structure is made of sets of evenly or unevenly spaced arched parallel trusses which, at their lower ends, are supported by a compression ring that substantially matches the perimeters of the underlying area, and at their high end intersect one of a set of arched collector trusses. When viewed in plan, each parallel truss is parallel to one of a set of generator lines, defined as those lines running from a central point in the projected area of the roof structure to the vertices of a regular or irregular circumscribing polygon that approximates the projected roof area. The collector trusses are located in plan, on the lines that bisect the angles formed by adjacent generator lines. A series of hoop-like tension members which are similar to the geometry of the compression ring, are located at different heights. Substantially vertical compression members are located in plan at the intersection points of the centerlines of the set of hoop-like tension members. The roof structure can be provided with retractable membrane panels, to expose the underlying area to light and air, as desired.

16 Claims, 79 Drawing Sheets

U.S. PATENT DOCUMENTS

| | | | |
|---|---|---|---|
| 4,068,422 | 1/1978 | Sumner | 52/81.2 |
| 4,276,733 | 7/1981 | Casper | 52/71 X |
| 4,676,033 | 6/1987 | Allen et al. . | |
| 4,716,691 | 1/1988 | Allen et al. . | |
| 4,736,553 | 4/1988 | Geiger . | |
| 4,757,650 | 7/1988 | Berger . | |
| 5,067,288 | 11/1991 | Kazushige | 52/81.2 |
| 5,146,719 | 9/1992 | Saito . | |
| 5,259,158 | 11/1993 | Levy . | |
| 5,355,641 | 10/1994 | Levy . | |

Method of Designing the Dome of the Present Invention
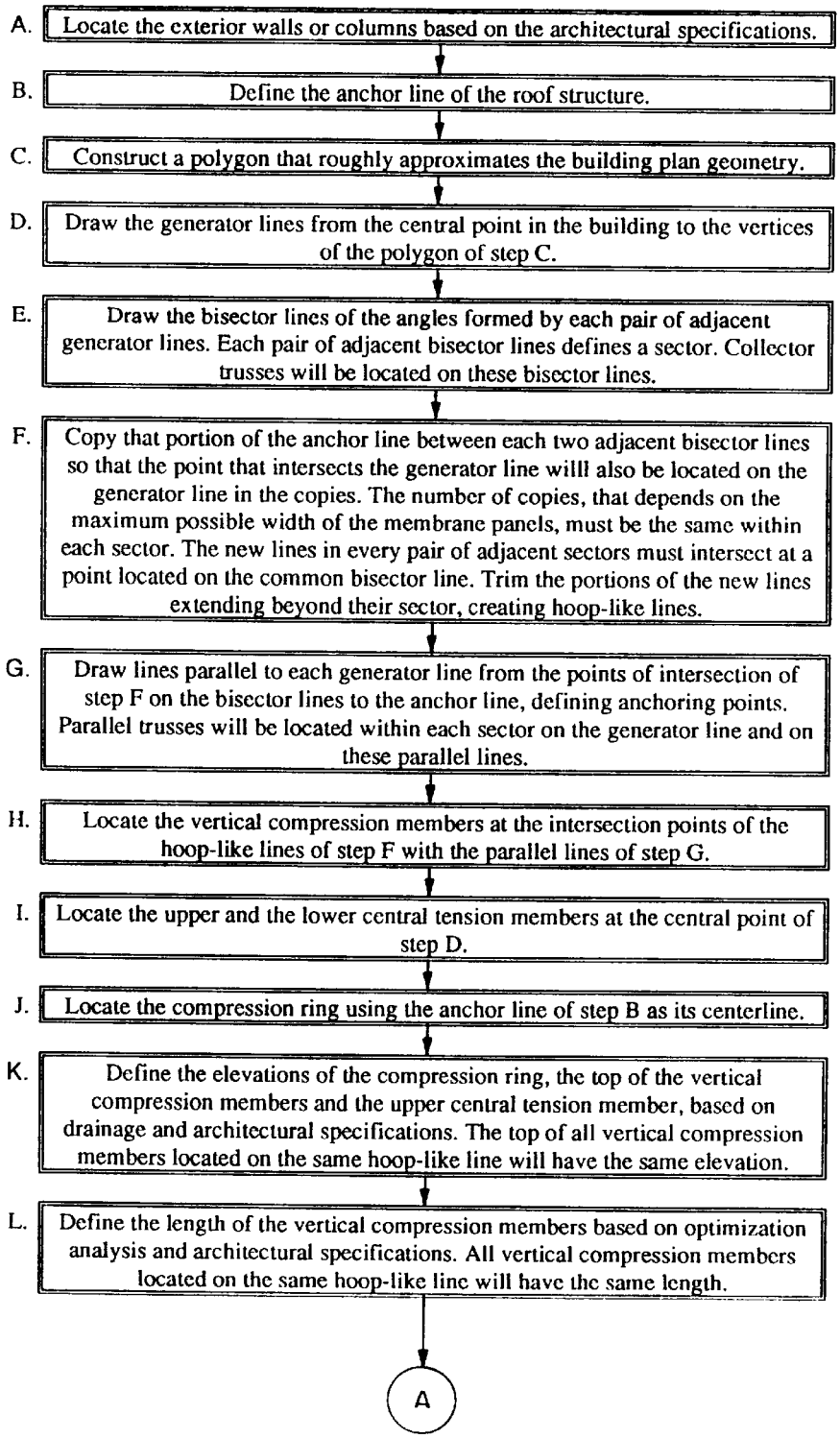
FIG. 6A1

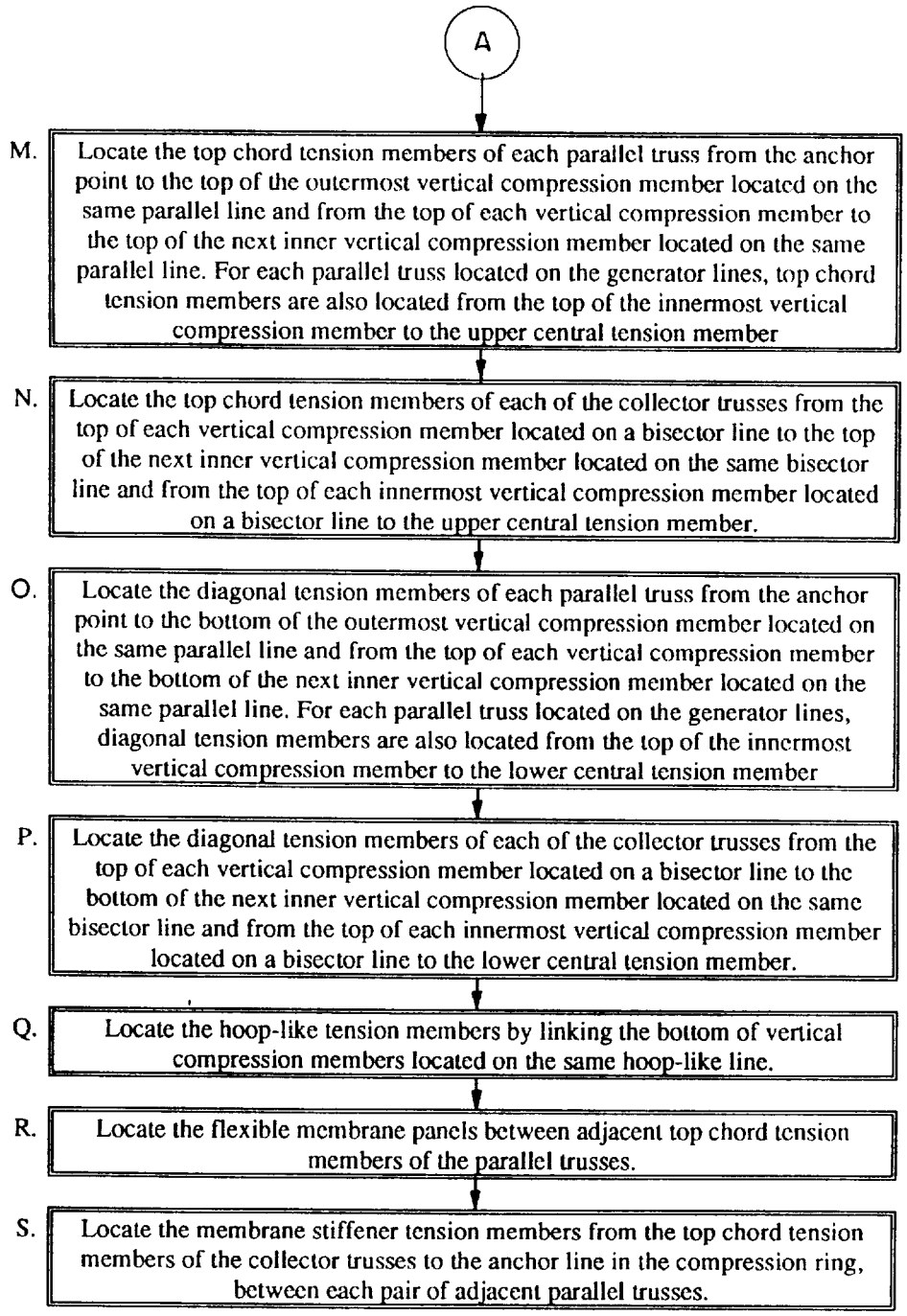
FIG. 6A2

Method of Construction of the Dome of the Present Invention

STAGE 2

STAGE 3

STAGE 4

STAGE 5

STAGE 6

DOME ROOF STRUCTURE AND METHOD OF DESIGNING AND CONSTRUCTING SAME

BACKGROUND OF INVENTION

Field of Invention

The present invention relates to dome roof structures and more particularly, a dome roof structure which can be easily constructed using cables.

BRIEF DESCRIPTION OF THE PRIOR ART

Domes have been used for a long time to cover areas where an unobstructed space, free of columns, or any other type of intermediate support, is needed. At the same time, domes provide the solution to spaces where a larger clear height is required at the center than at the perimeter zones of the covered area. Until very recently, domes were rigid structures made of concrete or steel. But this trend was changed by the development of new materials that could be used as very light membranes to cover a given area. These materials, which have desirable qualities like translucency and thermal insulation, allow for covered spaces with an airy and outdoor feeling that provide a pleasant environment to the occupants. This has motivated the birth of new structural systems that are lightweight, flexible, and that utilize more efficiently the tensile capacity of the materials.

One of these dome-like structures is described in U.S. Pat. Nos. 3,772,836 and 3,841,038 to David H. Geiger, where the structure has a peripheral support ring that conforms in plan substantially to a close curve having major and minor axes of symmetry. A plurality of sets of arches are connected to the ring to form the roof, with the arches of at least two sets respectively extending substantially parallel to a separate one of the skewed axes of symmetry of the closed curve and the arches of another set extending in plan substantially parallel to major and/or the minor axes of the closed curve. The arches impose a funicular load on the ring and support a roof deck structure to form a dome structure. A similar concept has also been described in U.S. Pat. No. 3,807,421 to Horst L. Berger. While the arch-supported membrane is in tension, the arches work in compression and stability becomes a concern, especially for very long spans. Also, the resulting structures have a very high aspect ratio, i.e., a large height to span ration, which results in high costs due to the large quantity of membrane that is required.

Another type of dome that uses efficiently the tensile capacity of the materials is the air-supported dome, as presented for example in U.S. Pat. No. 3,835,599 to David H. Geiger. The structure comprises a ring conforming in plan to a closed curve, a plurality of sets of cables with the cables of each set extending in plan parallel to an axis of skewed symmetry of the closed curve, and a membrane attached to the cable which by means of inflation lifts the cables so as to pretension the roof and form a domed surface. This dome, with its ability to cover economically large spans without any form of obstruction below the membrane, while at the same time possessing a natural beauty, captured the attention of many and was the preferred system for some time. Even though it has a low profile, which utilizes efficiently the membrane, it has proved to have its own problems. The need for a mechanical blower, an air-tight building, a snow melting system, and an emergency generator, together with the deflations that roofs using this system have experienced in the past, have made people skeptical about using it in new projects.

In the past few years, the system of choice has become the so-called Cable Dome. The origin of this type of structures can be traced back to U.S. Pat. No. 3,139,957 to Richard Buckminster Fuller, where he defined an aspension, or ascending suspension structure. His structure consists of a series of box frames of polygonal, cylindrical or other form, these frames being of progressively varying sizes arranged in a concentric array of sequentially different heights have a common place of reference and in vertically overlapping spaced relationship to one another. Tension elements such as flexible cables extend between and are attached to adjacent pairs of the box frames in the series. These tension elements serve the functions of suspension, anchoring, buttressing, and resistance to torquing and counter-torquing of the frames. One set of these tension elements extends downwardly from their points of attachment to the upper chord of the lower frame of a pair to their respective points of attachment to the lower chord of the upper frame of the pair whereby successive frames in the series are suspended from one another. Another set of tension elements extends downwardly from their points of attachment to the upper chord of the frame of a pair to their respective points of attachment to the lower chord of the lower frame of the pair whereby successive frames in the series are anchored down one to another. The fact that both sets of cables are criss-crossed when viewed in plan or elevation produces a triangulated geometry that resists the torquing and countertorquing of the frames.

Fuller's roof structure has a number of problems. In particular, due to the triangularization of the geometry, a large number of elements joining in at a single point of attachment, would have implied difficult connection details. This would be specifically true for noncircular configurations, where a different connection geometry would be required at every attachment point. Also, the set of frames constituted a rigid element that could have become excessively heavy. This dome was never built.

The first practical application of the Cable Dome was for the 1988 Olympic Games in Korea, where two arenas were covered using a system disclosed in U.S. Pat. No. 4,736,553 to David H. Geiger. The system consists of a non-triangulated cable dome with a generally horizontal outer compression ring, a generally horizontal inner tension ring, and a plurality of radially oriented support members attached to the outer compression ring that extend radically inwardly and are attached to the inner tension ring. Each of these support members lies in a generally vertical plane, and has at least one upper arched tensioned member, at least one diagonal tensioned member extending inwardly, downwardly and diagonally from the upper tensioned member, and at least one substantially vertical rigid strut in compression attached at its upper end to the upper tensioned member and attached to its lower end to the diagonal tensioned member. Each set comprising an upper member, a diagonal member, and strut form a triangle in a vertical plane. These triangles form groups of triangular supports located at common radial positions between the outer compression ring and the inner tension ring. Also, each triangle in each radially oriented support does not have common sides with any other triangle in that support member. At least one tensioned hoop concentric with the outer compression ring and the inner tension ring is attached to the lower ends of each strut in each group of triangular supports. The membrane that overlies the structure is tensioned by means of tensioned members that extend radially from the outer compression ring to the inner tension ring and between adjacent radially oriented support members.

Geiger's system, being non-triangulated, allows for the use of large membrane panels which are substantially triangular when viewed in plan. In this way, it is possible to cover a large area with a relatively small amount of panels. In some respects, this design is advantageous since the smaller the number of panels that have to be patterned, the lower the engineering cost will be. Also, the construction time will be reduced if a smaller number of panels has to be installed. Another advantage that results from the absence of triangularization is that the connection details, especially those at the top of the struts, can be simplified, since there are cables coming into the joint from only two directions.

But there are also problems with the Geiger system. The radial layout of the supporting members, combined with the fact that at every hoop location the same number of struts is used, results in the struts being located closer and closer to each other as the hoops get closer to the center of the structure. On the other hand, every membrane panel has to span longer and longer distances as it gets closer to the outer compression ring, so that in order to limit the span, a large number of radially oriented supports are necessary. This combination can result in overcrowding of posts at the innermost hoop or at the tension ring. Also, since every membrane panel extends between the outer compression ring and the inner tension ring, the installation of the panels can only start after the supporting structure is completely erected, resulting in additional construction time. Another problem arises when trying to provide a roof structure over oval-shaped areas. While the Geiger system works well for circular areas producing mainly axial forces in the compression ring, for non-circular underlying areas the radially oriented support members impose loads on the compression ring that produce large bending moments in addition to the axial forces, requiring a larger and more expensive compression ring. Typically, this is a major concern since the cost of the compression ring represents a high percentage of the total cost of the cable dome system. One requirement of this cable dome, when completely unobstructed space is required below the lowest point of the structural system, is additional building height to compensate for the depth below the outer compression ring that the outermost diagonal must travel to connect to the outermost post and outermost hoop. This could be seen as a problem in cases where there are building height limitations due to local building laws. The additional volume that must be enclosed imposes also higher demands on mechanical systems such as air conditioning and heating systems. Finally, this dome is a permanently closed system which impedes the opportunity to enjoy the pleasant open air feeling during good weather. A consequence of this closed system is that natural gases cannot grow in a building covered in this type of structure so that sports that require natural gases, like soccer, cannot be practiced in a stadium with this kind of roof.

Another version of the cable dome system is disclosed in U.S. Pat. No. 4,757,650 to Horst L. Berger. The system consists primarily of intersecting cables, each of which supports two struts and each strut rests on two intersecting cables. The cable dome has lower and upper outer cables each connecting nodes of an edge ring which are spaced by two other nodes. The lower and upper cables connecting the same nodes are spaced from each other in elevation by a pair of outer struts each having an upper and a lower node. Each upper node in turn supports lower and upper inner cables, serving a function similar to that of a corresponding edge ring node. As a result, the struts in plan view are located on radial lines, forming concentric rings. The result is very similar to Geiger's dome, except that both the upper cables and the diagonal cables appear in a criss-crossed configuration, creating a triangulated system. The tensioning of the fabric is achieved by poles in the middle of the panels and additional cables running from the top of the struts to the bottom of the poles.

Berger's system, having also a radial layout of the struts, has the same advantages and disadvantages as Geiger's dome, with the exception that the triangularization adds a degree of lateral stability to the roof. However, the same triangularization makes the connection details more complicated.

The most recent cable dome innovation is the system designed by Weidlinger Associates for the roof of the Georgia Dome in Atlanta. Applicant is one of the original developers of this so-called Hypar-Tensegrity Dome. This structure has been described in several technical papers such as "Floating Fabric Over Georgia Dome," by Matthys Levy in the November 1991 issue of ASCE's Civil Engineering, and "Analysis of the Georgia Dome Cable Roof," by Gerardo Castro and Matthys Levy in the proceedings of the Eighth ASCE Conference on Computing in Civil Engineering, Dallas, Tex., 1992. The system uses Fuller's triangular concept to cover an underlying oval area. The oval area perimeter is approximated by a series of circular arcs in order to favor repetition of the geometry and minimize the number of different connections. When viewed in plan, the structure appears as two circular halves separated in the center by a center truss located on the long axis of the oval. A series of concentric tension hoops steps inward and upward towards the crown of the roof. The posts are located on radial lines belonging to the series of circles, their bottom end being attached to the concentric tension hoops. Posts on every other hoop are located on the same radial lines, but posts on each pair of adjacent hoops do not lie on the same radial lines. For an intermediate post, upper cables extend from the top of the post to the top of the two nearest posts in the adjacent inner hoop and to the top of the two nearest posts in the adjacent outer hoop. Also, diagonal cables extend from the top of the post to the bottom of the two nearest posts in the adjacent inner hoop. When viewed in plan, this triangularization creates diamond shaped membrane panes. No additional cables are used to tension the membrane. In order to introduce enough curvature into the panels, the typical dome profile has been modified by rising and lowering the top of certain posts, creating panels in the shape of hyperbolic paraboloids, and creating an overall tent-like appearance.

The Hypar-Tensegrity dome represents the first major application of cable domes to oval areas. In addition to the added lateral stability in its final configuration, the triangularization employed in constructing the Hypar-Tensegrity dome also speeds up the erection sequence since temporary cables are not necessary to stabilize the posts at intermediate stages. Another advantage of the triangulated system is that installation of the membrane panels located next to the compression ring can start as soon as the posts supporting these panels are in place, not having a wait for the entire supporting structure to be erected.

However, despite its benefits, the Hypar-Tensegrity dome system suffers from a number of shortcomings and drawbacks. In particular, the perimeter of the building using this dome system must closely match a curve made of a series of circular arcs. If this condition is not satisfied, then either a separate set of columns to support the roof must be built or the compression ring will have to be supported eccentrically, resulting in torsional moments that must be resisted by the compression ring. Furthermore, the very large number of hyperbolic paraboloid panels required by the triangulated geometry demands more patterning during the engineering of this dome system. More installation time is required with this type of dome system, not only because of the large number of panels, but also because the panels, not having a cable to introduce the tension, must be pulled into their attachment position. Another problem with this structure is the creation of very flat areas when rising and lowering of the posts in order to introduce enough curvature into the panels. These very flat areas can cause ponding or snow accumulation. Appearance can also become a serious concern with the Hypar-Tensegrity dome system. While the interior is a beautiful dome-like structure, the rising and lowering of the posts makes the outside look more like a tent, something that the architect or the owner might not want. The Hypar-Tensegrity dome system also suffers from many of some of the problems previously described in connection with other cable domes. In particular, the radial layout of the posts within each of the circular arcs used to approximate the perimeter of the building, combined with the fact that at every hoop location the same number of posts is used, results in overcrowding of posts at the innermost hoop and in congested connections at the center truss. The radially oriented resultants of the cable forces impose loads on the compression ring that produce large bending moments in addition to the axial forces, requiring a large and expensive compression ring. Additional building height is required to compensate for the depth below the outer compression ring that the outermost diagonal must travel to connect to the outermost post and the outermost hoop. Finally, this dome is also a permanently closed system.

The latest trend in roof design is to provide the option to open a portion of the structure. In this manner, a retractable roof allows people to enjoy good weather in its open window, while protecting from inclement weather in its closed position.

A modification to the Hypar-Tensegrity dome has been partially disclosed in the 1992 paper "Hypar-Tensegrity Roofs, A Celebration in Fabric and Cables," by Matthys Levy. In this modified dome system, a retractable roof section is provided to the oval-shaped dome structure. The two end portions are identical to the Hypar-Tensegrity dome, but the central portion, extending the full length of the center truss and bounded by the compression ring has been modified. In this central portion, the posts are located at the intersection points of a series of parallel lines and the concentric hoops of the Hypar-Tensegrity dome. The series of parallel lines are perpendicular to the center truss. At this central portion, there appears to be no triangulation in the upper cables, but apparently the diagonal cables are arranged in a criss-crossing fashion. The central portion is shown to be retractable but no further details are given as to how this is accomplished. Even though this system could work for oval areas, it is not applicable to circular areas since they do not have the center truss section.

Other retractable roofs have been proposed. One of them is disclosed in U.S. Pat. Nos. 4,676,033 and 4,716,691 to Christopher M. Allen and Roderick G. Robbie. This is the system used to cover the Skydome in Toronto. This structure comprises a central arch separating a pair of end segments, where one end segment is movable into nesting relationship with the other end segment while the central arch is movable to rest above the nesting end segments. The nesting end segments and the above resting central arch are movable laterally so that the interior of the stadium is more fully exposed.

This system has the advantage of exposing a large area beneath the dome structure when it is retracted. However, the system is described exclusively for circular configurations. Also, the central arch and the end the end segments are made of rigid trusses that are heavy and require complicated mechanical systems to accomplish the required rotations and translations, making it a very expensive system to implement in practice.

A paper entitled "Retractable Roof Olympic Stadium Montreal," by Luc Lainey, Normand Morin, Jorg Schlaich, and Rudolf Bergerman, in the proceedings of the IVBH Symposium, Helsinki, 1988, describes a roof with a retractable membrane used in the Montreal Olympic Stadium. In this concept, a one piece membrane in the center of the roof is suspended by cables at intermediate points from a very high inclined tower. In order to open the roof, the prestress in the membrane is released by releasing the suspension cables and lowering the suspension points, the connections at the boundary are removed, and the roof is lifted by winding independent hoisting cables. Part of the membrane is stored inside the tower.

This is without a doubt a beautiful structure from the architectural point of view, but the system has shown problems. First of all, the membrane can only be lifted in very low winds since its prestress has been released. Secondly, several tears have appeared around the suspension points near the tower. Finally, it requires a very high tower which is expensive to build.

Two other retractable membrane systems have been described in paper "Tensile Membrane Structures," by J. Schlaich, R. Bergermann, and W. Sobek, in the 1990 Vol. 31 of the bulletin of the IASS. The first one is for the Arena of Zaragoza, Spain. It consists of a permanent ring-shaped outside and a retractable central part. The permanent part of the roof is a lightweight "Rim, Spokes and Hub"-type primary structure. The rim is a polygonal steel ring, the spokes are radial prestressed cables, and the hub consists of an upper and a lower ring cable connected by posts. The permanent membrane is placed between the lower set of the spoke cables. The retractable part is attached to the lower end of the posts and a central point is suspended from a spoke-type cable system. The prestressing of the convertible part is done with a hydraulic jack which is part of the central point. Opening and closing of the roof is done in the unstressed position, central jack released, by electric engines that ride over the spoke cables collecting the fabric towards the central point. This roof is not really a dome, but it illustrates a way to provide a retractable roof. Again, the membrane is retracted in its unstressed condition, which could result in tears under high winds.

Finally, the roof system for the Roman arena in Nimes, France, comprises an inflated cushion made of a lightweight membrane that is attached to a compression ring that rests on columns. The system is installed during the winter and it is completely disassembled for the summer. Thus, it is not really a retractable system in the strict sense of the word, making its practical applications limited.

Thus, there is a great need in the art for a dome system and a method of designing and instructing the same while avoiding the shortcomings and drawbacks of the prior art.

OBJECTS AND SUMMARY OF THE PRESENT INVENTION

Accordingly, it is an object of the present invention to provide a structural system that can be used to roof an area defined by a closed boundary line, while retaining the advantages of the above-mentioned prior art and avoiding the shortcomings and drawbacks of the same.

The roof structure of the present invention can be used to cover an underlying area exactly or approximately defined by a circle, an ellipse, a superellipse, a triangle, a rectangle, a regular polygon, an irregular polygon, or any closed boundary line. When viewed in plan, the roof structure substantially matches the boundary of the underlying area. The roof structure is made of sets of evenly or unevenly spaced arched parallel trusses which, at their lower ends, are supported by a compression ring that substantially matches the perimeters of the underlying area, and at their high end intersect one of a set of arched collector trusses. When viewed in plan, each parallel truss is parallel to one of a set of generator lines. The generator lines are defined as those lines running from a central point in the projected area of the roof structure to the vertices of a regular or irregular circumscribing polygon that approximates the projected roof area. The collector trusses are located in plan, on the lines that bisect the angles formed by adjacent generator lines. A series of hoop-like tension members which substantially match, i.e., are "similar to" the geometry of the compression ring, are located at different heights. Substantially vertical compression members are located in plan at the intersection points of the centerlines of the set of hoop-like tension members with the centerlines of the parallel trusses. The lower ends of compression members are attached to the hoop-like tension members. Each of the parallel trusses is contained in a vertical plane and consists of top chord tension members, diagonal tension members, and substantially vertical compression members, forming triangles in which two sides are tension members and one side is a compression member. Each of the collector trusses is contained in a vertical plane and consists of top chord tension members, diagonal tension members, and substantially vertical compression members, forming triangles in which two sides are tension members and one side is a compression member. Vertical compression members that are shared by a collector truss and two parallel trusses are the common side of the three triangles creating in this way a partial triangulation in plan. Compression members that are not shared by parallel trusses and a collector truss are part of only one triangle. The innermost top chord tension members and the innermost diagonal tension members of the collector trusses and of the parallel trusses that do not intersect a collector truss are attached to upper and lower central tension members. Panels made of a light membrane are placed between top chord tension members of the parallel trusses, from the top chord tension members of the collector trusses to the compression ring. A membrane stiffener tension member is placed over each membrane panel, from the top chord tension member of the collector truss to the compression ring, between the two top chord tension members of the parallel trusses that bound the panel. The outermost top chord tension members and the outermost diagonal tension members of the parallel trusses are supported by the compression ring.

Advantages of the roof structure of the present invention are that it does not create overcrowding of posts at the center of the roof, minimizes the bending moments in the compression ring, substantially matches the perimeter of any building, creates as much uniformity in the connection details as possible, minimizes the number of membrane panels by using large panels, provides means to easily install and introduce tension in the membrane, keeps constant membrane panel width from the center of the roof to the compression ring, avoids flat membrane areas that could cause ponding, provides partial triangulation, allows membrane installation to start before the cable and post assembly is fully erected, has a dome-like appearance from both inside and outside, can accommodate a central opening that transforms it into a long span canopy and allows for a light membrane retractable central portion that opens and closes while keeping the tension in the membrane.

In accordance with another aspect of this invention, a roof structure with a set of retractable membrane sections is disclosed to cover an underlying area defined by a circle, an ellipse, a superellipse, a triangle, a rectangle, a regular polygon, an irregular polygon, or any closed boundary line. The roof structure when projected in plan, substantially matches the boundary of the underlying area. The roof structure is made of sets of evenly or unevenly spaced arches parallel trusses that are their lower end are supported by a compression ring that substantially matches the perimeter of the underlying area, and at their high end intersect one of a set of arched collector trusses. Each parallel truss, when viewed in plan, is parallel to one of a set of generator lines. The generator lines are defined as those lines running from a central point in the projected area of the roof structure to the vertices of a regular or irregular circumscribing polygon that roughly approximates the projected roof area. The collector trusses are located, in plan, on the lines that bisect the angles formed by adjacent generator lines. A series of hoop-like tension members which substantially match the geometry of the compression ring, are located at different heights.

A series of hoop-like tension members which substantially match the geometry of the compression ring, are located at different heights. Substantially vertical compression members are located in plan at the intersection points of the centerlines of the set of parallel hoop-like tension members with the centerlines of the parallel trusses. The lower ends of compression members are attached to the hoop-like tension members. Each of the parallel trusses is contained in a vertical plane and consists of top chord tension members, diagonal tension members, and substantially vertical compression members, forming triangles in which two sides are tension members and one side is a compression member. Each of the collector trusses is contained in a vertical plane and consists of top chord tension members, diagonal tension members, and substantially vertical compression members, forming triangles in which two sides are tension members and one side is a compression member. Compression members that are shared by a collector truss and two parallel trusses are the common side of three triangles, creating in this way a partial triangulation in plan. Compression members that are not shared by parallel trusses and a collector truss are part of only one triangle. The innermost top chord tension members and the innermost diagonal tension members of the collector trusses and of the parallel trusses that do not intersect a collector truss are attached to upper and lower central tension members.

Fixed panels made of a lightweight membrane are placed between top chord tension members of the parallel trusses, beyond the retractable sections, from an edge cable to the compression ring. A membrane stiffener tension member is placed over each panel from the top chord tension member of the collector trusses to the compression ring, between the two top chord tension members of the parallel trusses that bound the panel. A set of membrane sections that ride on the top chord tension members of the parallel trusses can be retracted in order to open the central area of the roof, leaving the parallel trusses and the collector trusses exposed without any membrane cover. Each retractable membrane section rides on a different set of parallel trusses. In each retractable membrane section, the membrane is attached to a set of light weight support space frames, each being rigid along its horizontal Extent to withstand forces imposed by the membrane, yet flexible along its vertical Extent in order to accommodate the deformations of the top chord tension members of the parallel trusses that support them. The lightweight support space frames are provided with wheels that travel along a vertically flexible track that is attached to the top chord tension members of the parallel trusses. Additional edge space frames are provided around the perimeter of each retractable section. The outermost top chord tension members and the outermost diagonal tension members of the parallel trusses are supported by the compression ring.

In accordance with yet another aspect of this invention, a roof structure with a retractable inflated membrane section is provided for covering an underlying area defined by a circle, an ellipse, a superellipse, a triangle, a rectangle, a regular polygon, an irregular polygon, or any closed boundary line of arbitrary geometry. The roof structure when projected in plan, substantially matches the boundary of the underlying area. The roof structure is made of sets of evenly or unevenly spaced arched parallel trusses that at their lower end are supported by a compression ring that substantially matches the perimeter of the underlying area, and at their high end intersect either one of a set of arched collector trusses or the upper and lower hoop-like tension members that bound the retractable section. Each parallel truss, when viewed in plan, is parallel to one of a set of generator lines. The generator lines are defined as those lines running from a central point in the projected area of the roof structure to the vertices of a regular or irregular circumscribing polygon that roughly approximates the projected roof area. The collector trusses are located, in plan, on the lines that bisect the angles formed by adjacent generator lines. A series of hoop-like tension members which substantially match the geometry of the compression ring, are located at different heights.

Substantially vertical compression members are located in plan at the intersection points in the centerlines of the set of hoop-like tension members with the centerlines of the parallel trusses. The lower ends of compression members are attached to the hoop-like tension members. Each of the parallel trusses is contained in a vertical plane and consists of top chord tension members, diagonal tension members, and substantially vertical compression members, forming triangles in which two sides are tension members and one side is a compression member. Each of the collector trusses is contained in a vertical plane and consists of top chord tension members, diagonal tension members, and substantially vertical compression members, forming triangles in which two sides are tension members and one side is a compression member. Compression members that are shared by a collector truss and two parallel trusses are the common side of three triangles, creating in this way a partial triangulation in plan. Compression members that are not shared by parallel trusses and a collector truss are part of only one triangle. The innermost top chord tension members and the innermost diagonal tension members of the collector trusses and of the parallel trusses that do not intersect a collector truss are attached to an upper and a lower hoop-like tension members. The upper hoop-like tension member is attached to the top of a set of compression members at the boundary of the retractable section. This upper hoop-like tension member is parallel in evaluation to the hoop-like tension member that is attached to the lower end of the same set of compression members.

Fixed panels made of a lightweight membrane are placed between the top chord tension members of the parallel trusses, from the upper hoop-like tension member and the top chord tension members of the collector trusses to the compression ring. Membrane stiffener tension members are placed over the panels, from the upper hoop-like tension member and from the top chord tension members of the collector trusses to the compression ring, between the two top chord tension members of the parallel trusses that bound the panel. A retractable membrane section is placed inside the upper hoop-like tension member. The retractable section consists of an upper lightweight membrane and a lower lightweight membrane that may or may not be reinforced with cable nets. The upper and lower membranes are joined together and made air-tight to form a cushion that can be inflated. The assembly, when inflated, is self-equilibrating, introducing tension in the upper and lower membranes, and only has to be hanged from the top of the compression members connected by the upper hoop-like tension member in order to close the roof. To open the roof, the cushion is deflated, and the assembly is lowered by means of hoisting cables so that it can be folded and stored. When the retractable section is not in place, the roof becomes a long span canopy. The outermost top chord tension members and the outermost diagonal tension members of the parallel trusses are supported by the compression ring.

Other objects of the present invention include novel methods of designing and constructing the roof structures of the present invention.

In summary, the present invention provides a structural system that can be used to provide a roof over an underlying area defined by a general closed boundary line of arbitrary geometrical character. This unique system overcomes the problems while providing numerous advantages over the prior art, namely: the system of the present invention provides a dome roof structure for covering an underlying area, using a parallel layout, rather than a radial layout of the supporting members; it does not create overcrowding of posts at the center of the roof; it minimizes the bending moments in the compression ring, substantially matches the perimeter of any building; it creates as much uniformity in the connection details as possible; it minimizes the number of membrane panels by using large panels; it provides means to easily install and introduce tension in the membrane, keeps constant membrane panel width from the center of the roof to the compression ring; it avoids flat membrane areas that could cause ponding; it provides partial triangulation; it allows membrane installation to start before the cable and post assembly is fully erected; it has a dome-like appearance from both inside and outside; it can accommodate a central opening that transforms it into a long span canopy; and it allows for a lightweight membrane retractable central portion that opens and closes while keeping the tension in the membrane.

Other advantages of the present invention will become apparent hereinafter.

BRIEF DESCRIPTION OF THE DRAWINGS

For a more complete understanding of the present invention, the following Detailed Description of the Preferred Embodiments should be read in conjunction with the following drawings, in which:

FIGS. 6A1 and 6A2, taken together, provide a flow chart illustrating the steps involved in the method of designing the roof structure of the present invention;

DETAILED DESCRIPTION OF THE ILLUSTRATIVE EMBODIMENTS OF THE PRESENT INVENTION

Figure 1A:
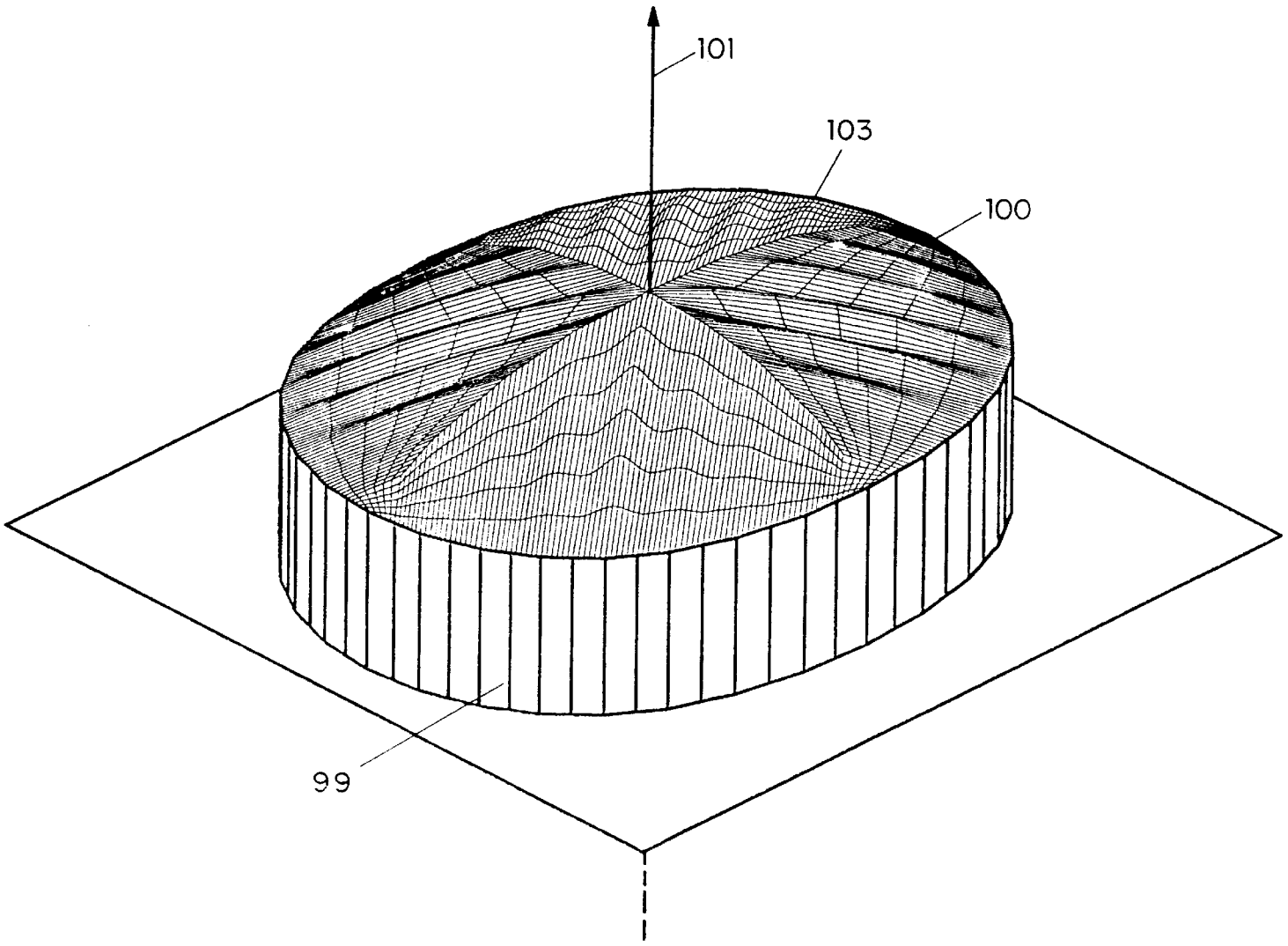
FIG. 1A is an isometric view showing a roof structure constructed in accordance with a first illustrative embodiment of the present invention.

When referring to the drawings of the illustrative embodiment, like reference numbers shall be used to designate similar parts through the various views thereof. In connection therewith, attention is first directed to FIGS. 1A to 2D in which the first illustrative embodiment of the dome roof structure of the present invention is illustrated.

As shown in the various view of FIGS. 1A, 1B, 1C and 1D, the first illustrative embodiment of the dome roof structure hereof 100 provides a roof-type structure over an underlying area which typically will be surrounded by side wall or station structures 99 of a stadium or building, as shown in FIGS. 1A to 2D. When designing the roof structure of the present invention, it is helpful to define a central axis 101 about which the underlying area can be related. Advantageously, the geometry of the underlying area beneath the roof structure may be arbitrary, providing great versatility in applying the present invention. In fact, the roof structure of the present invention can be implemented upon any support platform providing a support surface whose perimetrical extent can be made to circumscribe the perimetrical extent of the underlying area of arbitrary geometry.

Figure 1B:
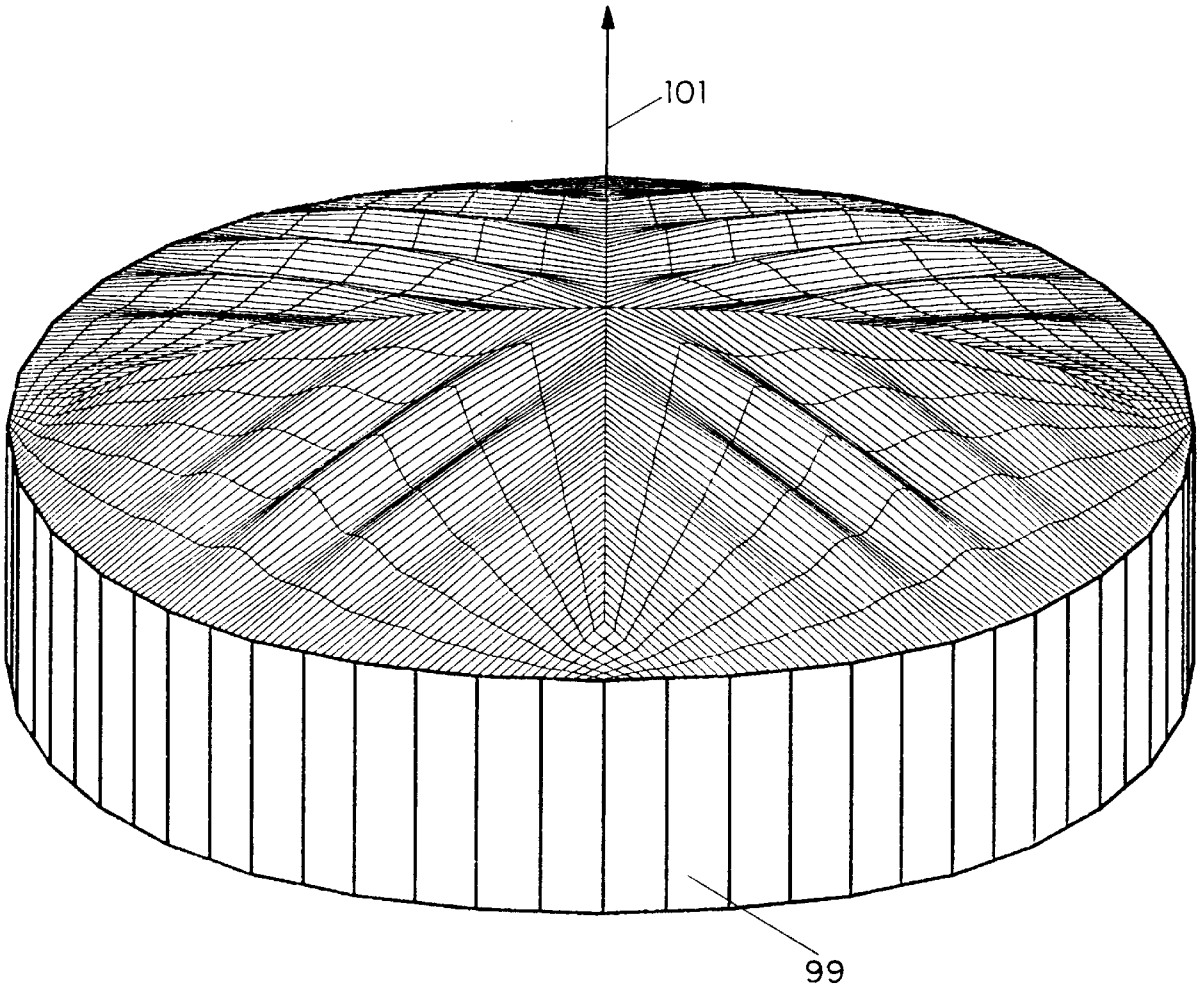
FIG. 1B is a perspective view of the roof structure constructed in accordance with the first illustrative embodiment of the present invention.
Figure 1C:
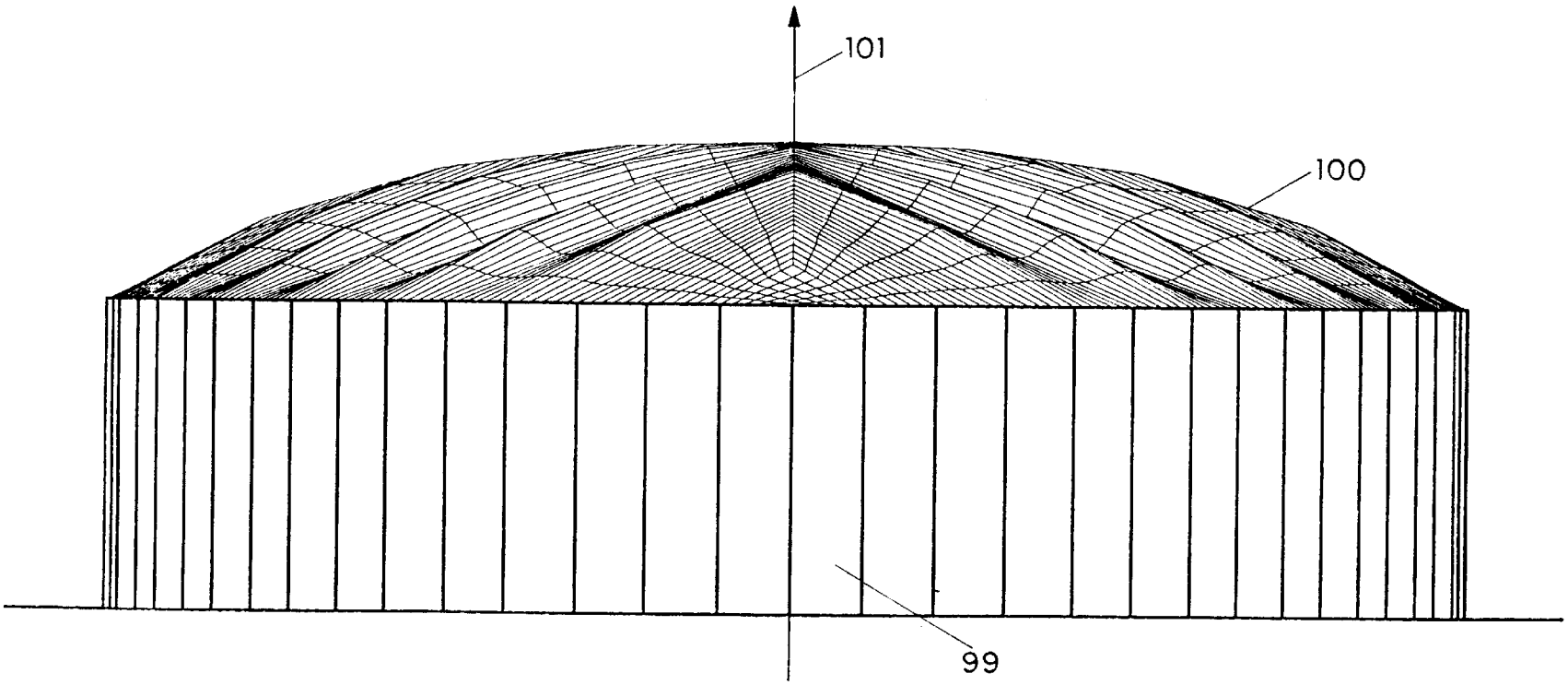
FIG. 1C is an elevated side view of the roof structure constructed in accordance with the first illustrative embodiment of the present invention.
Figure 1D:
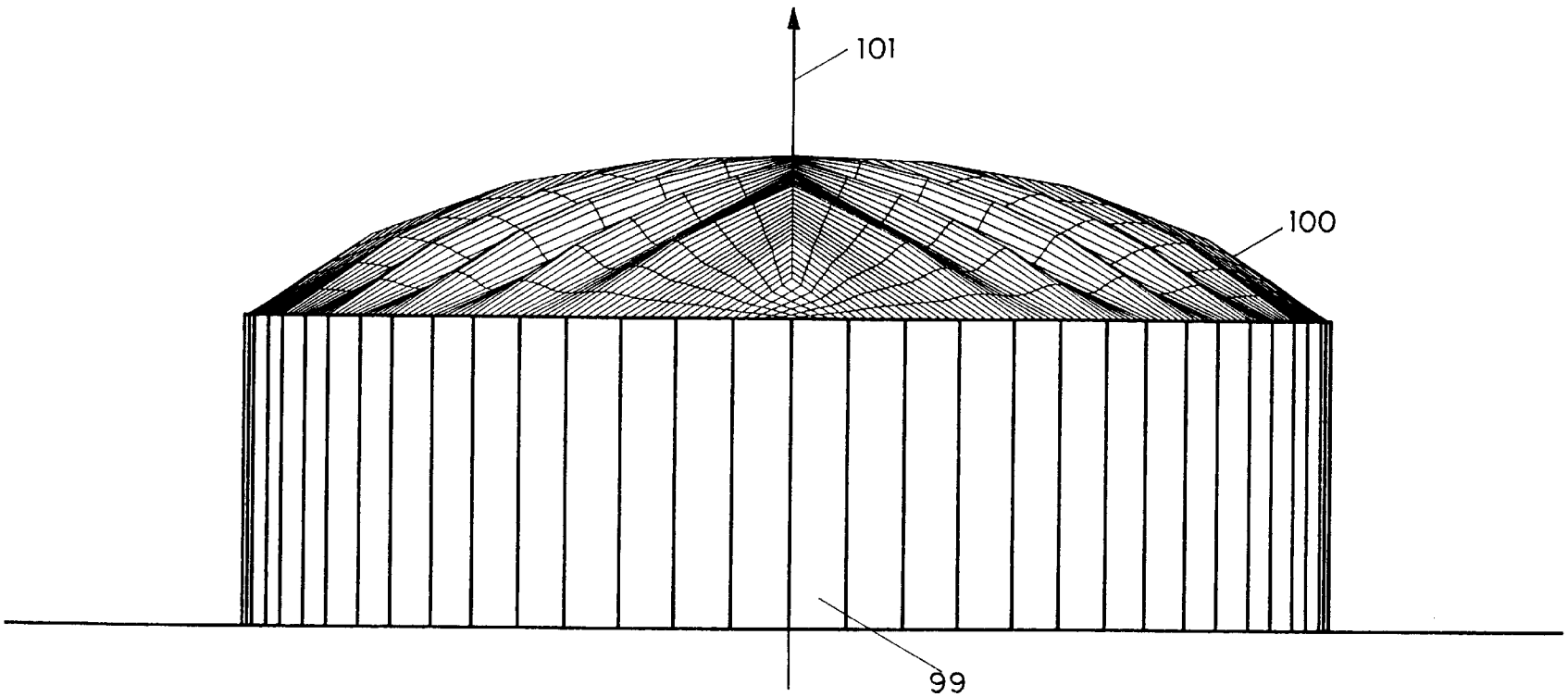
FIG. 1D is an elevated side end of the roof structure in accordance with the first illustrative embodiment of the present invention.

In general, the roof structure of the present invention is constructed from various structural components and subcomponents to provide a self-supporting system that can be supported on a support platform. The self-supporting system is held together with structural integrity under a complex set of compressional and tensional forces maintained in substantial equilibrium and subjectable to static force analysis using methods well known in the art. While each particular embodiment of the roof structure of the present invention will have numerous structural components, in general, each roof structure can be analyzed into two major components, namely: a dome-like portion 102 having a skeletal structure as exemplified in FIGS. 2A to 2D; and a roof covering portion 103 extending over and conforming to the surface boundaries defined by the dome-like portion as exemplified in FIGS. 1A to 1D. As illustrated in FIG. 1A, covering portion 103 of the roof structure of the first illustrative embodiment is characterized by a wavy surface geometry. The exterior geometry (i.e., shape) of roof structure 103 is revealed in FIGS. 1B to 1D. A view of roof structure 100 when tilted about its longitudinal axis is shown in FIG. 1B and elevated side views thereof are shown in FIGS. 1C to 1D. FIGS. 2A to 2D provide similar views of the roof structure of the first illustrative, but with its covering membrane 103 removed in order to reveal the supporting members that form the dome portion.

Figure 2A:
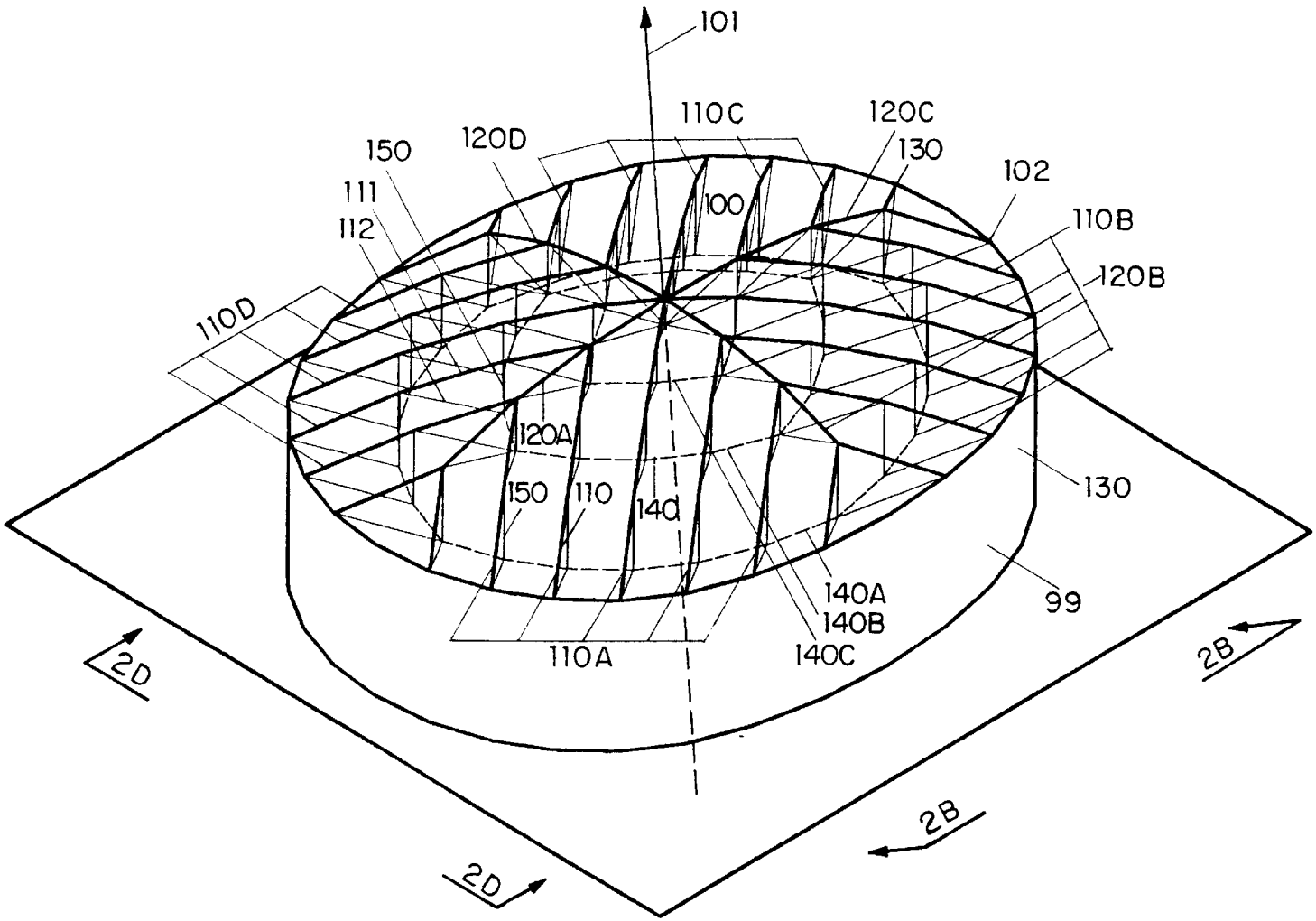
FIG. 2A is a first perspective view of the roof structure of the first illustrative embodiment of the present invention, shown with its covering membrane removed.

As shown in FIG. 2A, the dome portion of the roof structure of the first illustrative embodiment comprises a number of structural components, namely: a central tension structure 160; an outer compression structure 130; four arched collector trussers 120A, 120B, 120C and 120D; four sets of arched parallel trusses 110A, 110B, 110C and 110D; and three sets of hoop-like tension members 140A, 140B and 140C. As shown, the central tension structure is disposed along central axis 101 at a first predetermined height above the underlying area. The outer compression structure 130 is disposed about central axis 101 at second predetermined height above and circumscribing the underlying area. The outer compression structure further has a perimetrical extent which is generally approximatable by a polygon that is defined in terms of a plurality of vertices ($V_1$, $V_2$, . . . $V_n$). Such features of roof structure will be described in greater detail with reference to FIGS. 6B and 6C.

Each arched collector truss 120A, 120B, 120C and 120D has first and second end portions which extend from the central tension assembly to the compression ring substantially along a plane which bisects the angle formed between an adjacent pair of predefined generator planes. As shown, each of these generator planes extends from the central axis to one polygon vertice and is disposed parallel to the central axis.

Each arched parallel truss has first and second end portions and extends from one arched collector truss to the outer compression structure along a plane which is substantially parallel to one the predefined generator planes. Each hoop-like tension member is disposed about the central axis, has a geometry substantially geometrically similar to but smaller than the cross-sectional geometry of the outer compression structure, and operably connects the sets of arched parallel trusses and the sets of arched collector trusses under tensional forces. In this way, the sets of arched parallel trusses and the set of arched collector trusses are supported above the underlying area.

Figure 2B:
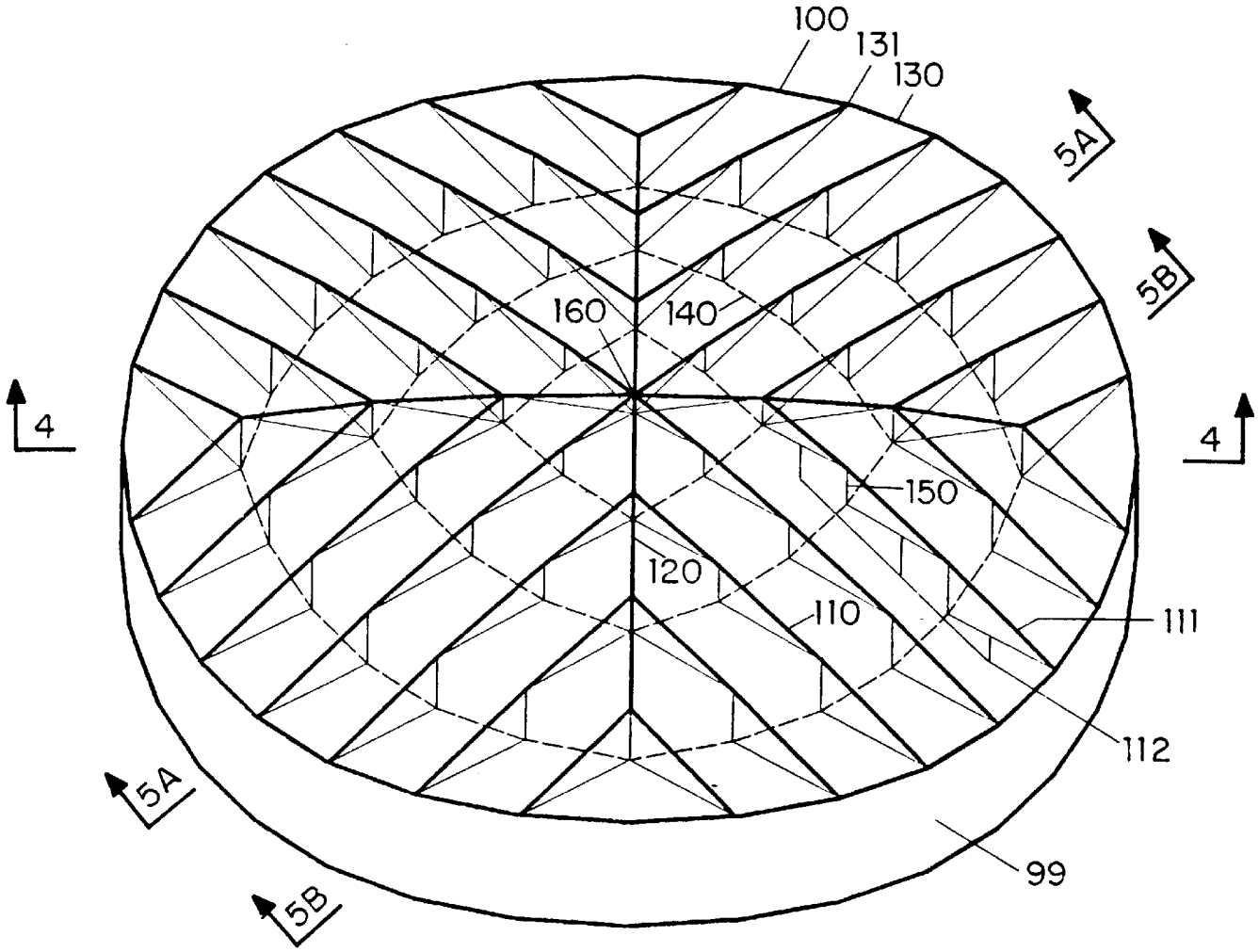
FIG. 2B is a second perspective view of the roof structure of the first illustrative embodiment of the present invention, shown with its covering membrane removed.
Figure 2C:
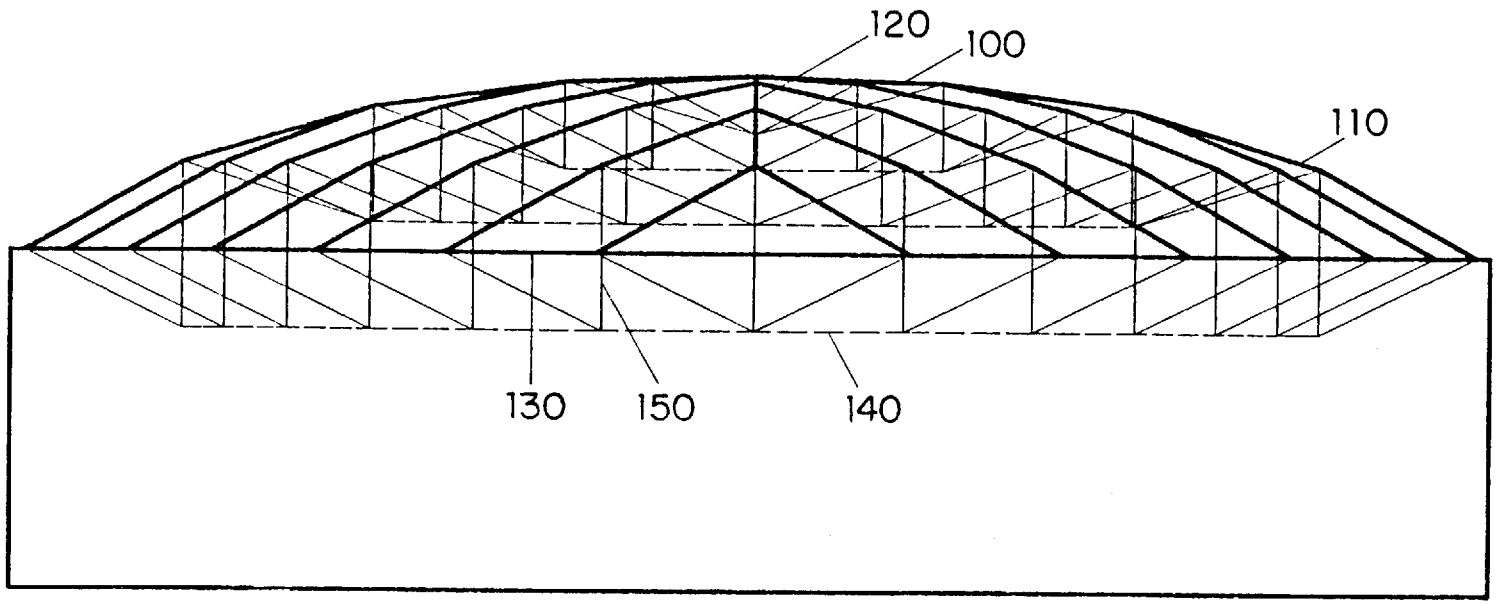
FIG. 2C is an elevated side view of the roof structure of the first illustrative embodiment of the present invention, shown with its covering membrane removed.
Figure 2D:
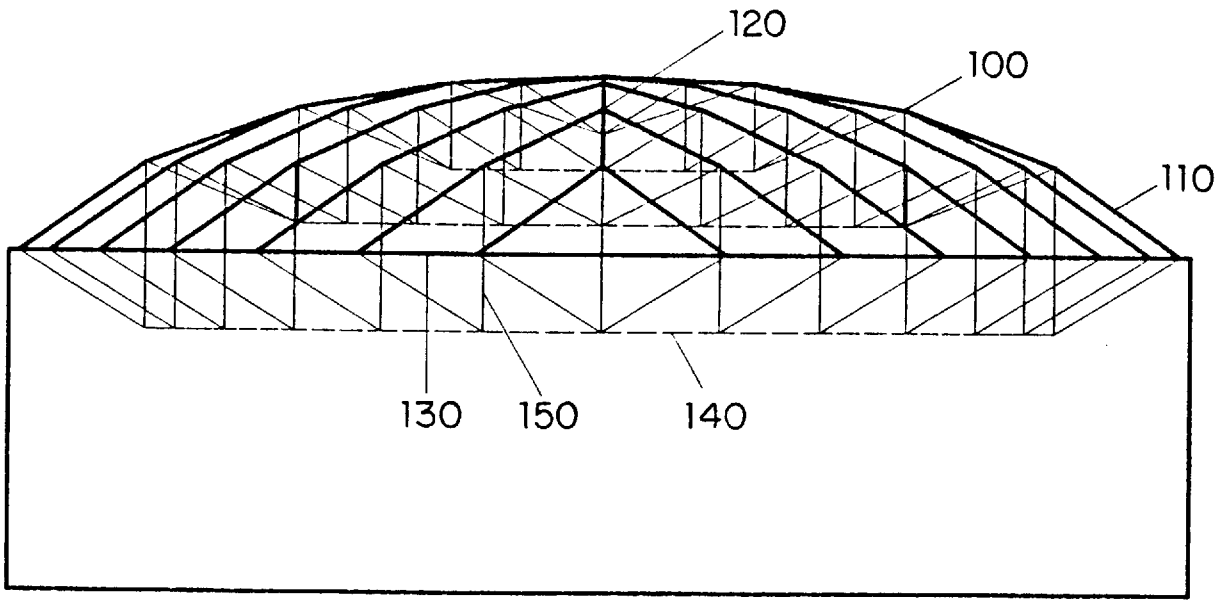
FIG. 2D is an elevated end view showing the roof structure of the first illustrative embodiment of the present invention, shown with covering membrane removed.
Figure 3A:
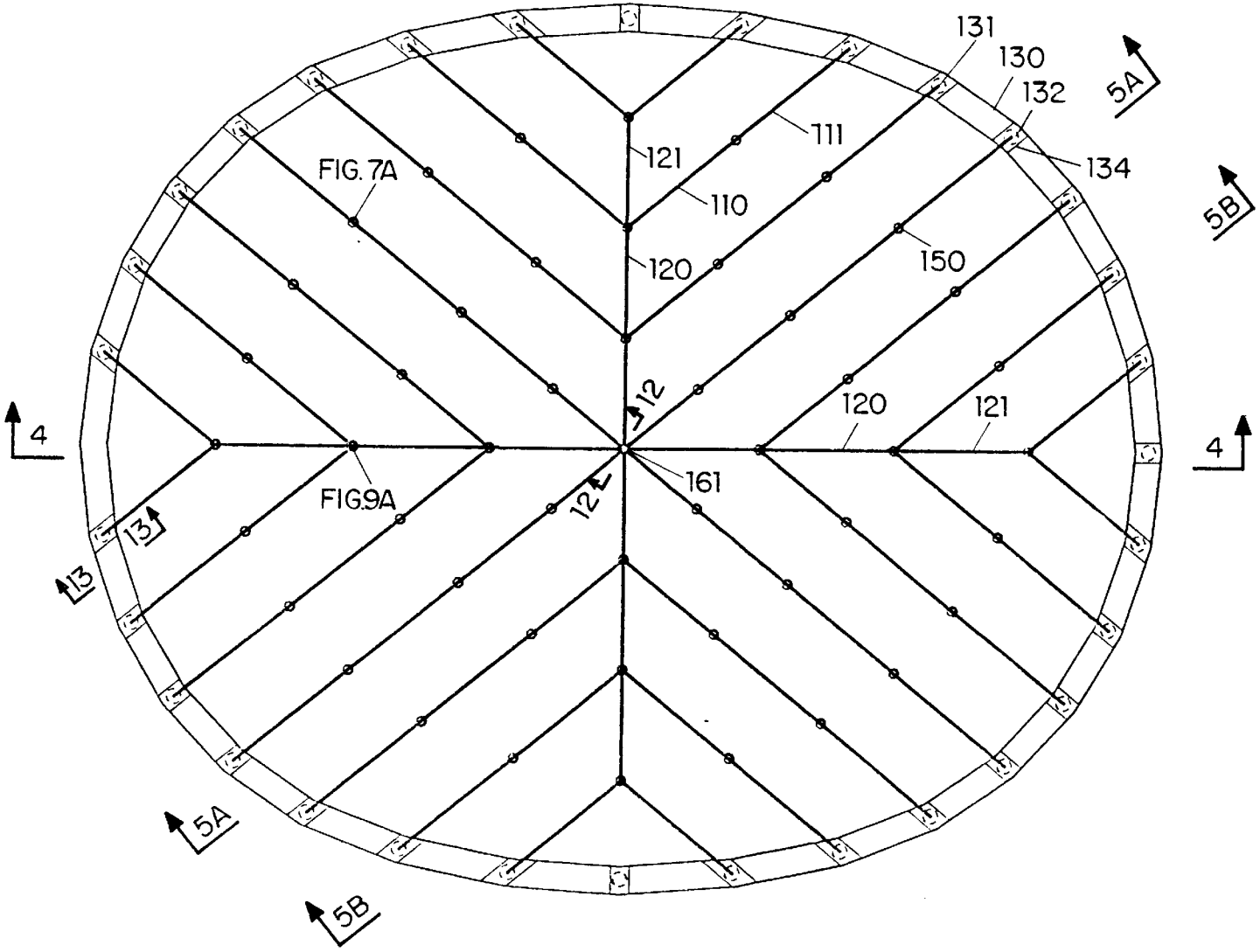
FIG. 3A is a plan view of the roof structure of the first illustrative embodiment of the present invention, showing the top chord tension members of the parallel trusses and the collector trusses thereof.
Figure 3B:
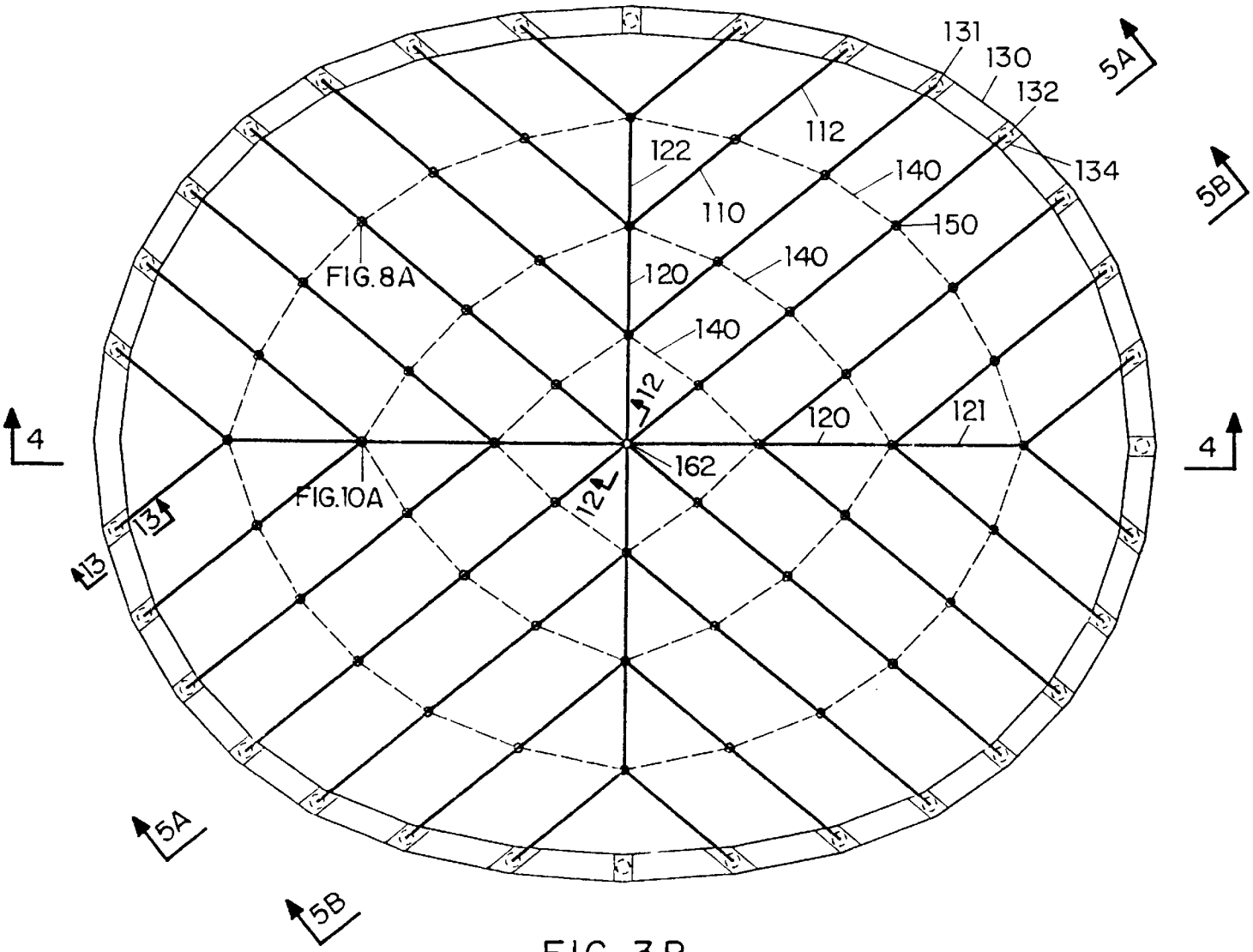
FIG. 3B a plan view of the roof structure of the first illustrative embodiment of the present invention, showing the diagonal tension members of the parallel trusses and the collector trusses and the hoop-like tension members thereof.
Figure 3C:
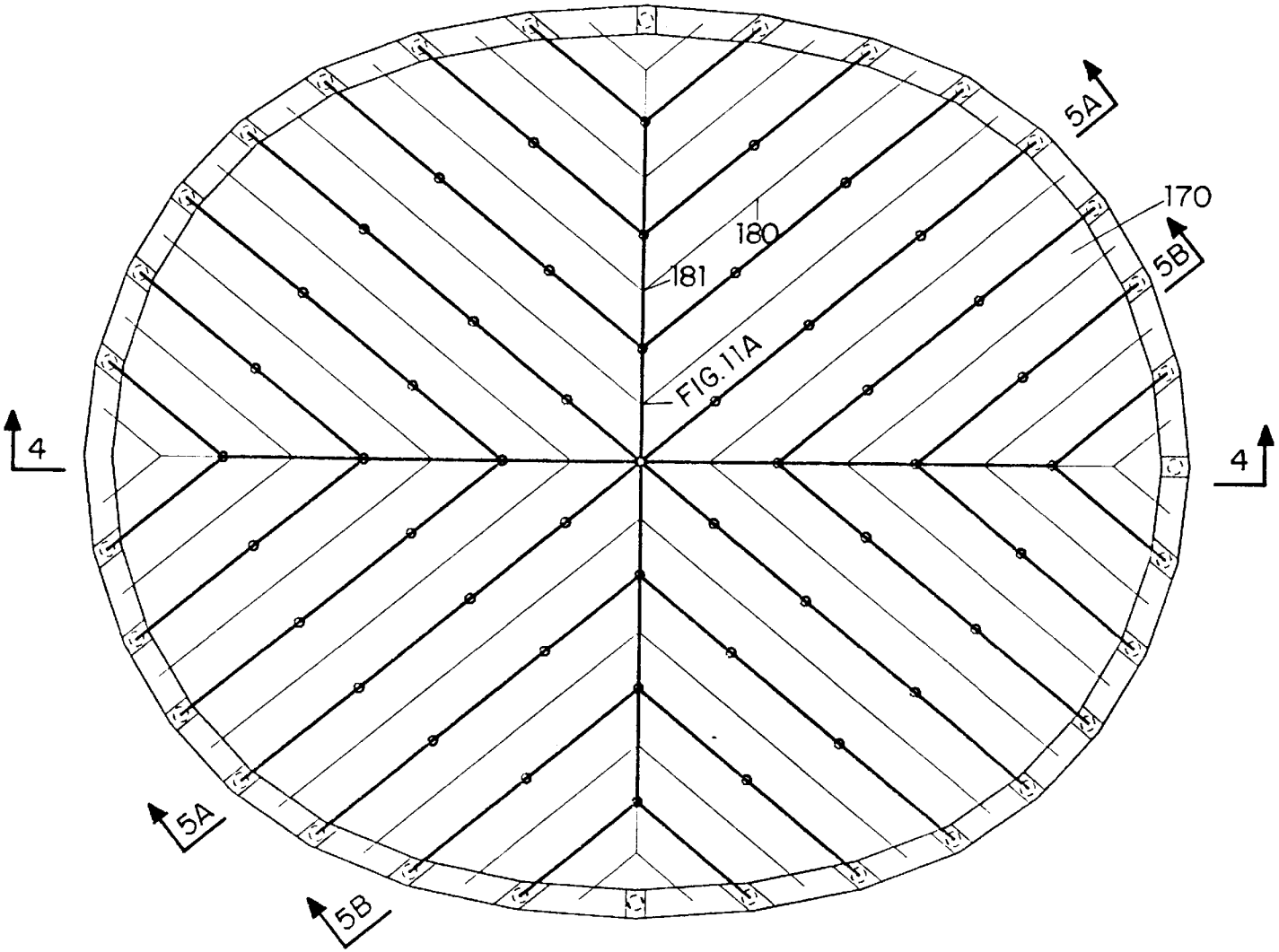
FIG. 3C is a plan view of the roof structure of the first illustrative embodiment of the present invention, showing the top chord tension members of the parallel trusses, the collector trusses and the membrane stiffener tension members thereof.
Figure 3D:
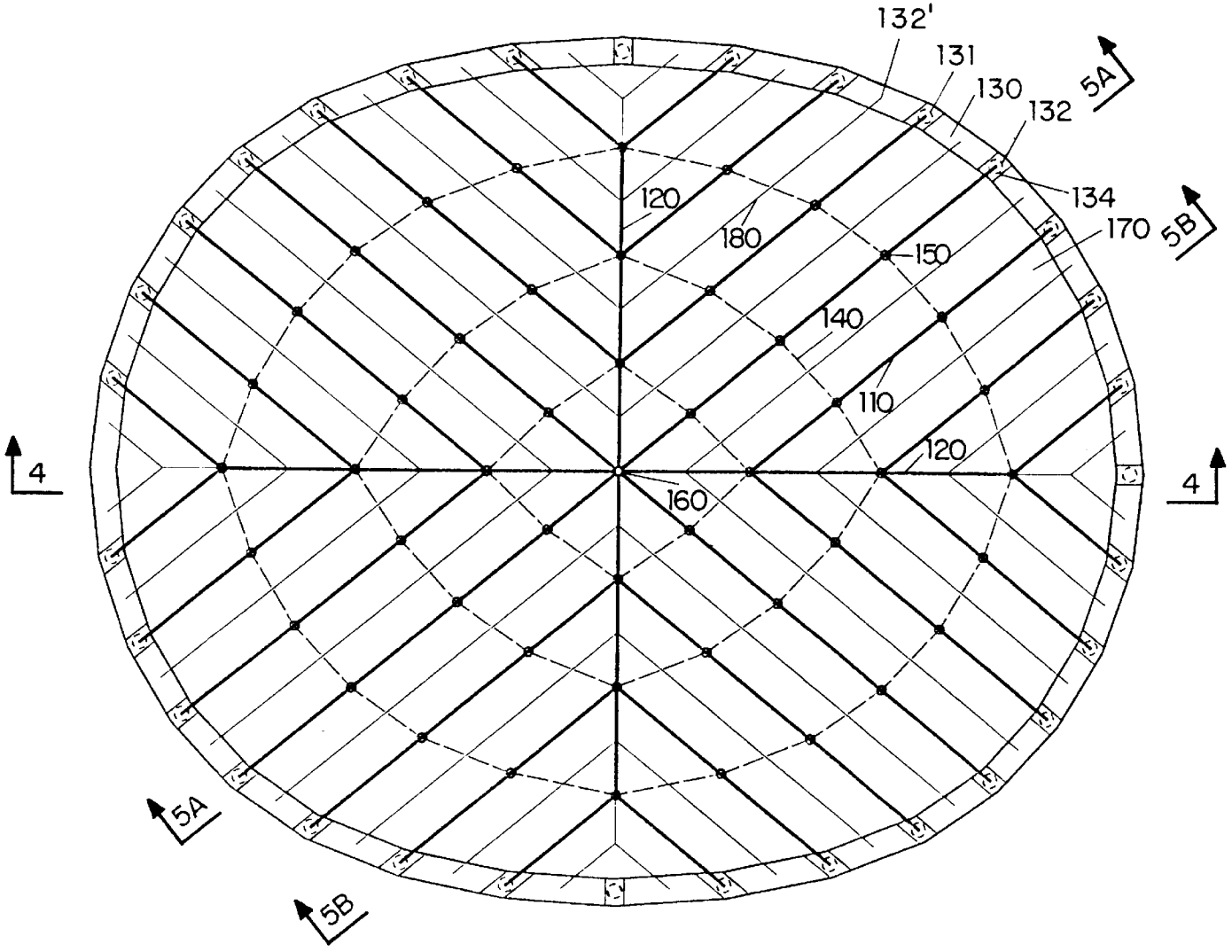
FIG. 3D is a plan view of the roof structure of the first illustrative embodiment of the present invention, showing the top chord tension members and the diagonal tension members of the parallel trusses and the collector trusses, the hoop-like tension members, and the membrane stiffener tension members thereof.

As shown in FIG. 2B, each arched collector truss comprises: a plurality of top chord tension members 111, a plurality of vertical compression members 150, and a plurality of diagonal tension members 112. Each vertical compression member is disposed substantially parallel to the central axis and at the intersection of one the hoop-like tension members and its associated arched collector truss. As illustrated, the plurality of top chord tension members, the plurality of vertical compression members and the plurality of diagonal tension members are disposed within the plane of the arched parallel truss and form a plurality of triangular structures. Each of these triangular structures have first, second and third sides which are formed by a top chord tension member, vertical compression member and a diagonal tension member, respectively.

As shown, each arched parallel truss comprises: a plurality of top chord tension members; a plurality of vertical compression members, and a plurality of diagonal tension members. Each vertical compression member is disposed substantially parallel to the central axis and at the intersection of one hoop-like tension member and its associated arched parallel truss. As shown, the plurality of top chord tension members, the plurality of vertical compression members and the plurality of diagonal tension members are disposed within the plane of the arched parallel truss and form a plurality of triangular structures. Each triangular structure has first, second and third sides which are formed by one the top chord tension member, one vertical compression member and one diagonal tension member, respectively.

As best shown in FIGS. 2A and 2B, one vertical compression member in each arched collector truss serves as a vertical compression member in one arched parallel truss in one of the three or more sets thereof. Also, this same vertical compression member also serves as one vertical compression member in one arched parallel truss in another of the sets thereof. As shown in these drawings, the top chord tension member and the diagonal tension member of each arched parallel truss disposed nearest to the outer compression structure are each supported by the outer compression structure 130.

In the illustrative embodiments of the present invention, the central tension structure 160 comprises a central tension ring to which the first end portion of each arched collector truss is attached. Also, the outer compression structure 130 comprises a compression ring to which the second end portion of each arched collector truss is attached. Preferably, the top chord tension member and each diagonal tension member in each one of the arched parallel trusses is fabricated using high tensile chord, such as cable. Each vertical compression member in each one of arched collector trusses is fabricated using rigid material. Each top chord tension member and each diagonal tension member in each one of arched parallel trusses is fabricated using high tensile chord such as cable.

In the first illustrative embodiment, the enclosure means or roof covering 103 comprises a plurality of membrane panels 170. Each membrane panel 170 is made from lightweight membrane material and is supported between adjacent pairs of the top chord tension members 121 of an adjacent pair of the arched parallel trusses 110, and between the top chord tension member of one the arched collector truss 120 and the outer compression ring 130.

As shown, membrane stiffener tension member 180 is placed over each membrane panel 170, from points 181 to the top chord tension member 121 of the collector truss 120 to points 132 in the compression ring 130, between the two top chord tension members 111 of the parallel trusses 110 that bound the panel. Preferably, each membrane stiffener tension member is fabricated from high tensile cord, such as cable. The outermost top chord tension members 111 and 121 and the outermost diagonal tension members 112 and 122 of the parallel trusses 110 and of the collector trusses 120, respectively, are supported by the compression ring 130 at points 131.

Figure 4:
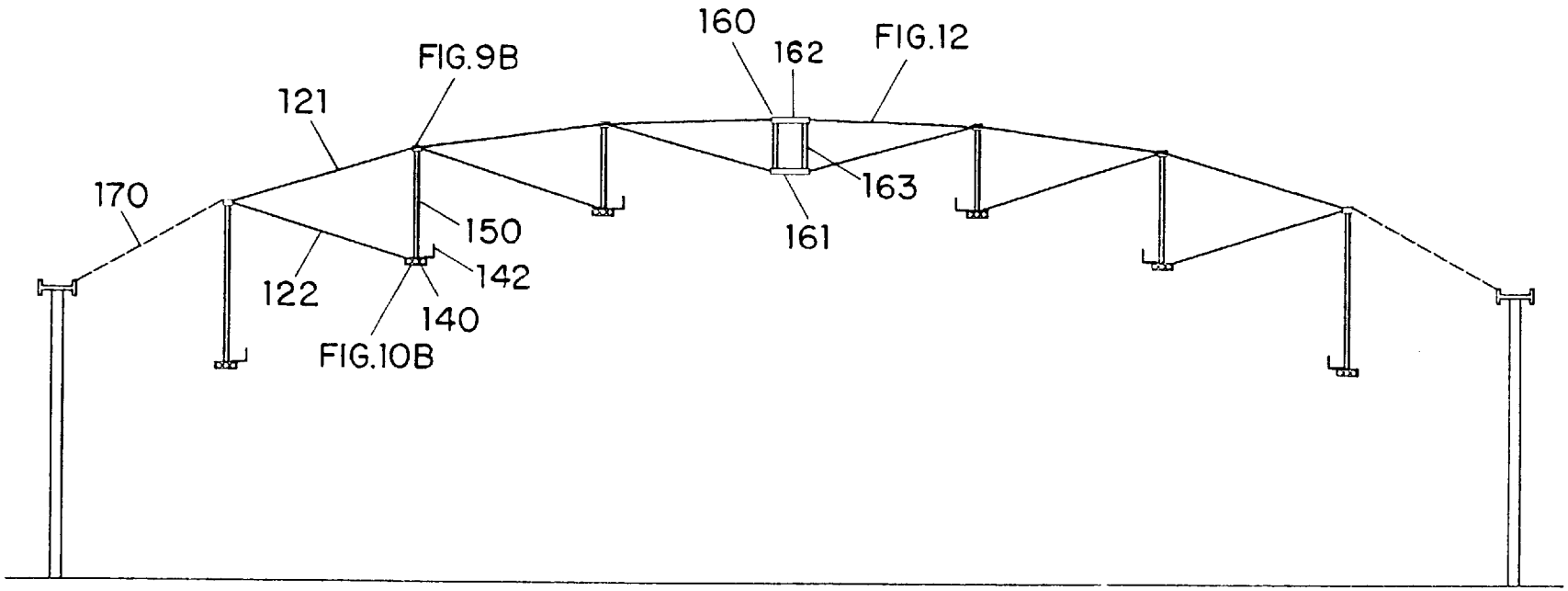
FIG. 4 is a cross-sectional view of the roof structure of the first illustrative embodiment of the present invention, taken at line 4—4 in FIG. 2B and in FIG. 3A to FIG. 3D showing one of the collector trusses.
Figure 5A:
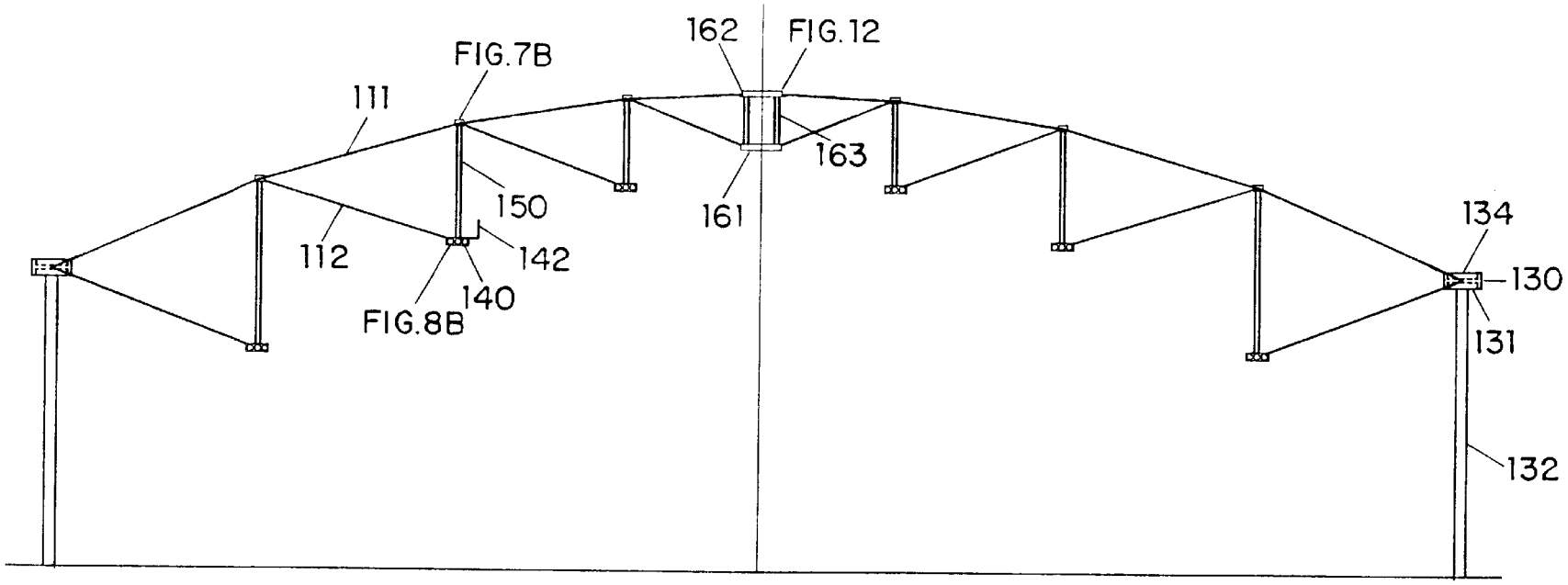
FIG. 5A is a cross-sectional view of the roof structure of the fist illustrative embodiment of the present invention, taken along line 5A—5A in FIG. 2B and in FIG. 3A to FIG. 3D showing one of the parallel trusses.
Figure 5B:
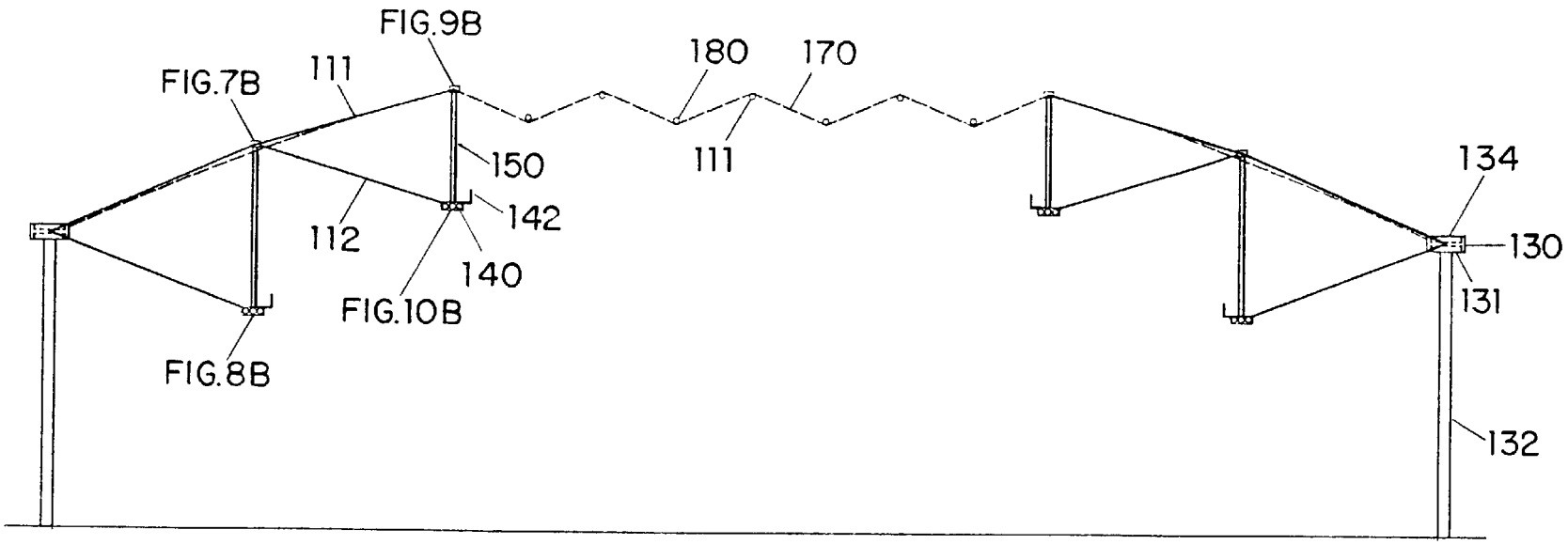
FIG. 5B is a cross-sectional view of the roof structure of the first illustrative embodiment of the present invention, taken along line 5B—5B in FIG. 2B and in FIG. 3A to FIG. 3D, showing one of the parallel trusses.

The substantially horizontal compression ring 130 substantially matches the perimeter of the underlying area and is supported by columns 132. The function compression ring 130 is to provide support to parallel trusses 110 and collector trusses 120. The hoop-like tension members 140 are located at different elevations, as indicated in FIG. 4 and FIGS. 5A and 5B. Each of the parallel trusses 110 is contained in a vertical plane and consists of top chord tension members 111, diagonal tension members 112, and substantially vertical compression members 150, forming vertical triangles in which two sides are tension members 111 and 112 and one side is a compression member 150. Each of the collector trusses 120 is contained in a vertical plan and consists of top chord tension members 121, diagonal tension members 122, and substantially vertical compression members 150, forming vertical triangles in which two dies are tension members 121 and 122 and one side is a compression member 150. Compression members 150 that are shared by a collector truss 120 and two parallel trusses 110 are the common side of three vertical triangles, creating in this way a partial triangulation in plan view. Compression members 150 that are not shared by parallel trusses 110 and a collector truss 120 are part of only one vertical triangle. The innermost top chord tension members 121 and 111 and the innermost diagonal tension members 122 and 112 of the collector trusses 120 and the parallel trusses 110 that do not intersect a collector truss 120 are attached (i.e., linked) to upper and lower central tension members 161 and 162, respectively. The upper and lower central tension members 161 and 162, together with central posts 163, form the central tension assembly 160.

Typically, a series of catwalks 142 are provided along tension-like hoops 140 in order to allow for maintenance crews to install and/or repair lighting and sound systems, electrical conduits, rigging, scoreboards, curtains and other utilities supported from the roof structure.

Having described the various subcomponents comprising these major components of the roof structure of the first illustrative embodiment, it is appropriate at this juncture to describe in detail a preferred method by which the dome portion of the present invention can be designed for a building having a support platform of arbitrary geometry (e.g. oval shaped). From such a description, an appreciation for the versatility and practicality of the roof structure design hereof will be readily acquired by one with ordinary skill in the art.

Figure 6B:
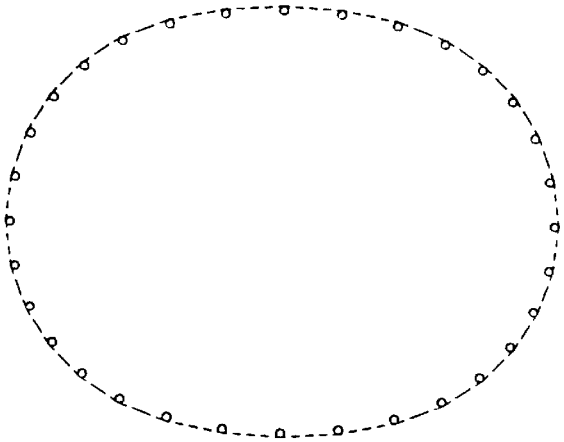
FIG. 6B through FIG. 6K are plan views showing the steps involved in designing the roof structure of the present invention.

In order to develop the geometrical plans for the dome roof structure according to the present invention, the design method (i.e., procedure) set forth in the flow chart of FIGS. 6A1 and 6A2 can used with excellent results. Individual plan views that are produced as the architect performs this step-by-step procedure, are set forth in FIGS. 6B to 6K. This design method will be detailed below.

As indicated at Block A in FIG. 6A1, the first step of the design method is to use architectural specifications in order to identify the physical location of the "building line" 101, as shown in FIG. 6B. Notably, the physical location of the building line 101 determines the physical location of where the roof supporting structure (e.g., walls or columns) 132 will be physically constructed and thus where the roof support platform will be located. Preferably in this plan drawing, the centerline of each wall or support column is drawn, as shown in FIG. 6B.

Figure 6C:
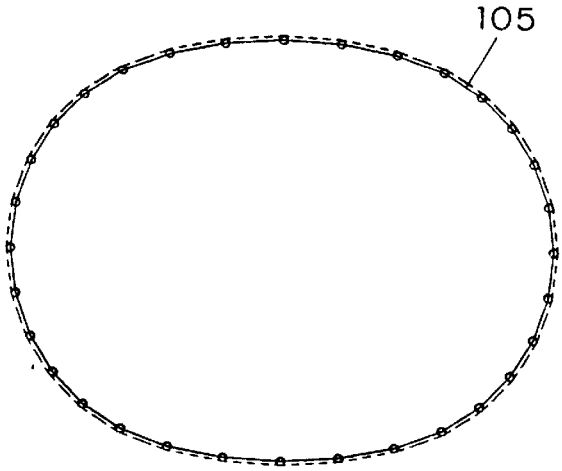
Figure 6D:
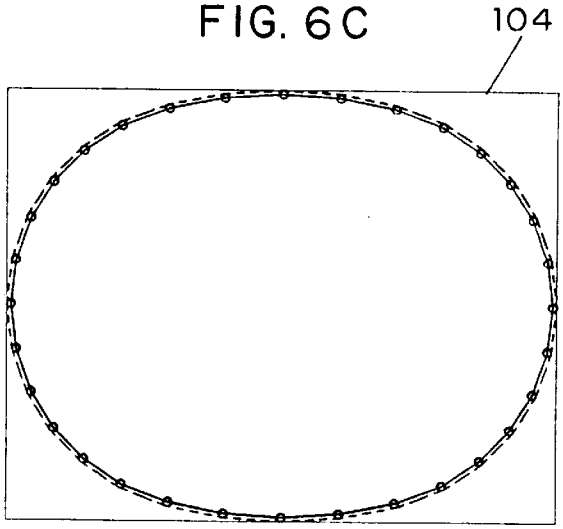
Figure 6E:
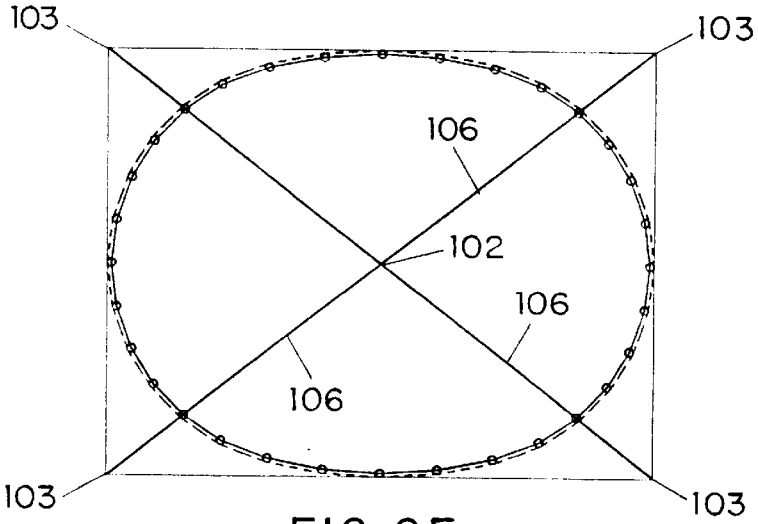
Figure 6F:
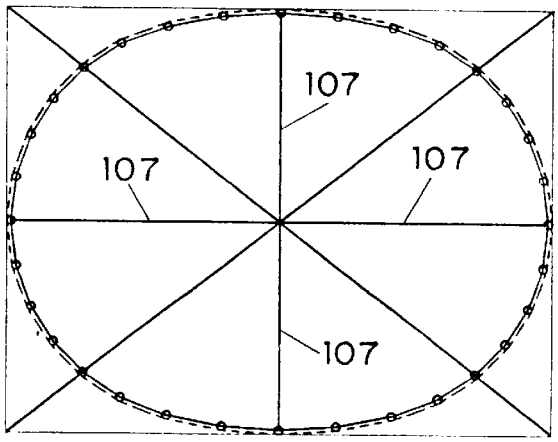

As indicated at Block B in FIG. 6A1, the next step of the method involves defining "the anchor line" 105 by joining the centerlines of the supporting walls or columns 132, as shown in FIG. 6C. At Block C, the next step of the design process involves roughly approximating the perimeter of the building, or building line 101, by a circumscribing polygon 104 having a plurality of vertices, as indicated in FIG. 6D. As indicated at Block D, the next step of the method involves drawing generator lines 106 by joining a central point 102 along the central axis, with the vertices 103 of the circumscribing polygon 104, as shown in FIG. 6E. In general, central point 102 should be preferably located on an axis of symmetry or, even better, at the intersection of two axes of symmetry (i.e., denoted as the central axis) in order to favor repetition of geometry and therefore minimize the number of different connection details required in the design and construction of the roof structure. At Block E, bisector lines 107 are then drawn by simply bisecting the angles formed by each pair of adjacent generator lines 106, as shown in FIG. 6F.

Figure 6G:
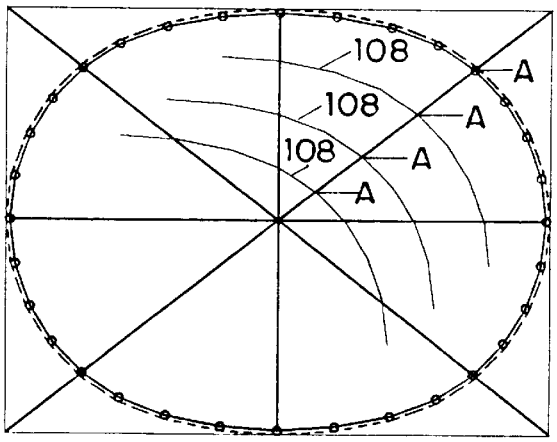
Figure 6H:
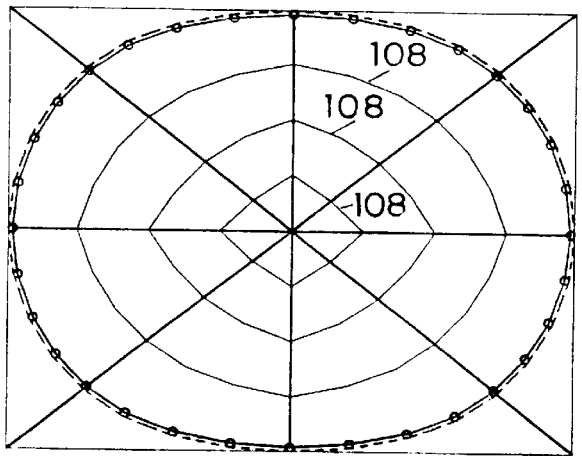

As indicated at Block F in FIG. 6A1, the next step of the design method involves generating the hoop-like lines 108 shown in FIG. 6G. This step is achieved as follows. For each pair of adjacent bisector lines 107, that portion of the anchor line 105 is copied by sliding point A along the generator line 106 towards central point 102, so that point A in the anchor line 105, given by the intersection of the anchor line 105 with the generator line 106, will also be the intersection point between the generator line 106 and the copied lines 108. Then by trimming the portions of the copied lines 108 that extend beyond the pair of bisector lines, the hoop-like lines of FIG. 6H are obtained.

Figure 6I:
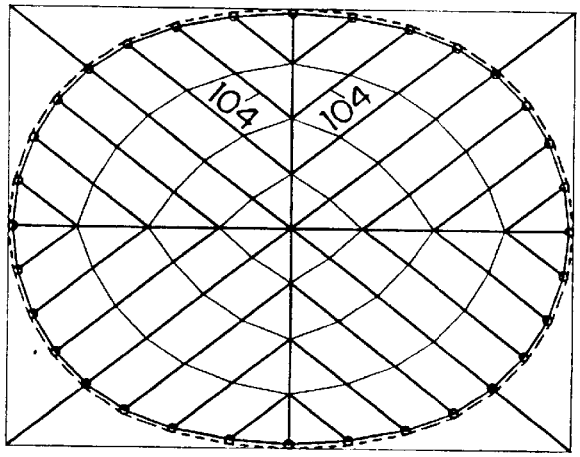
Figure 6J:
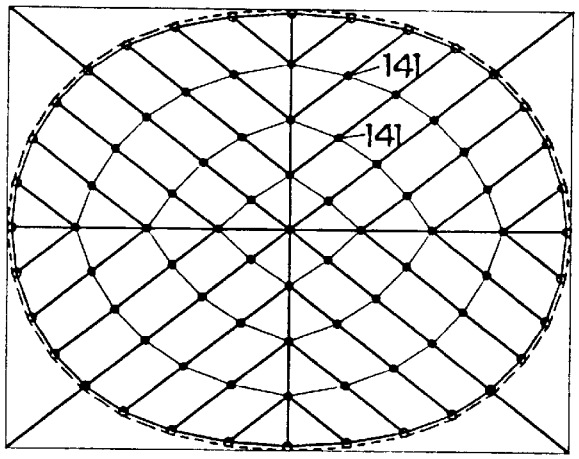

As indicated at Block G of FIG. 6A1, the next step of the method involves drawing plural sets of parallel lines 109, representative of a plural sets of parallel planes. Each set of these lines extends parallel to a generator line and each line in the set extends from the intersection point of one of the hoop-like lines 108 with the bisector lines 107, to the anchor line 105, as shown in FIG. 6I. Notably, the sets of parallel trusses will be located within each sector of the generator line and on these parallel lines. Then at Block H, the location of vertical compression members are defined as the points 141 of intersection of the sets of parallel lines 109 and the generator lines 106, with the hoop-like lines 108, as shown in FIG. 6J. As indicated at Block I in FIG. 6A', the location of the upper and lower central tension members are located at the central point determined in Block D. As indicated at Block J, the location of the compression ring is determined using the anchor line drawn in Block B. Then as indicated at Block K, the drainage and architectural specifications are used in order to define the elevations of the compression ring, the top of the vertical compression members and the upper central tension member. Notably, the top of all vertical compression members located on the same hoop-like line will have the same elevation. At Block L in FIG. 6A1, optimization analysis and architectural specifications are used to define the length of the vertical compression members. Notably, all vertical compression members located on the same hoop-like line will have the same length.

Figure 6K:
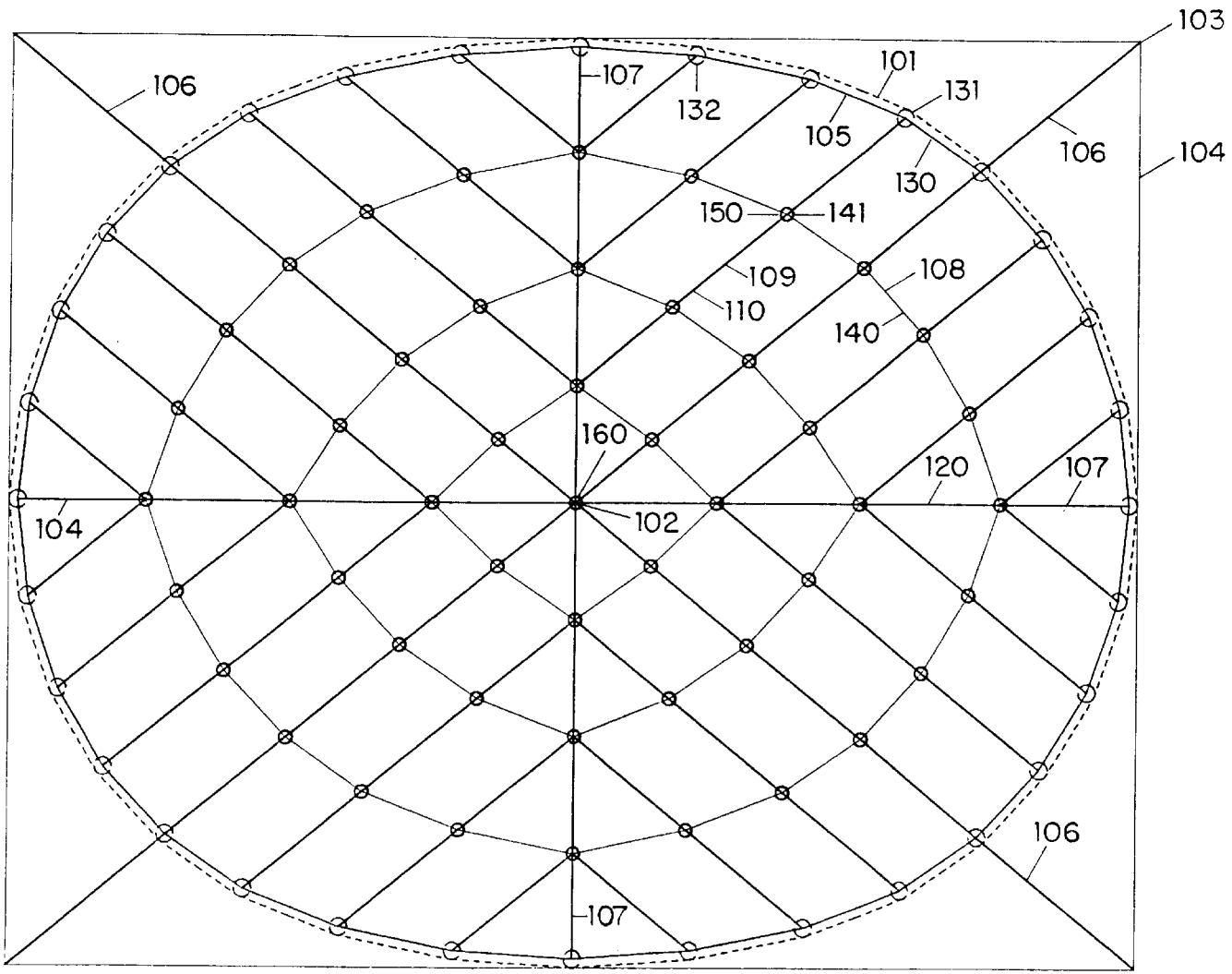

As indicated at Block M of FIG. 6A2, the next step of the design method involves locating the top chord tension members of the arched parallel trusses and the arched collector trusses. As shown in FIG. 6K, top chord tension members associated with each arched parallel truss are located from the anchor point 131, 132 to the top of the outermost vertical compression member located on the same parallel plane, and from the top of each vertical compression member to the top of the next inner vertical compression member located on the same parallel plane. For each parallel truss not located on a generator line, there is a top chord tension member which is located from the top of the innermost vertical compression member to the upper central tension member, as shown in FIG. 6K.

As indicated at Block N in FIG. 6A2, the method involves locating the diagonal tension members associated with each arched parallel truss. For each arched parallel truss, a diagonal tension member is located from the anchor point to the bottom of the outermost vertical compression member located on the same parallel plane, and also from the top of each vertical compression member to the bottom of the next inner vertical compression member located in the same parallel plane. For each parallel truss located on the generator lines, diagonal tension members are also located from the top of the innermost vertical compression member to the lower central tension member.

At Block P of FIG. 6A2, the diagonal tension members associated with each arched collector truss is located from the top of each of vertical compression member located on a bisector line, to the bottom of the next inner vertical compression member located on the same bisector line, and also from the top of each inner most vertical compression member located on a bisector line to the lower central tension member.

At Block Q of FIG. 6A2, the hoop-like tension members 140 are located on the plan drawing of FIG. 6K, by linking the bottom of vertical compression members located on the same hoop-like line. At Block R, the flexible membrane panels are located between adjacent top chord tension members of the parallel trusses. Finally, as indicated at Block S, the membrane stiffener tension members are located from the top chord tension members of the collector trusses to the anchor line 105 in the compression ring between each pair of adjacent parallel trusses. All the above-defined geometric elements and relations are identified in the plan drawing of FIG. 6K.

From the plan drawing of FIG. 6K, the plan location of other structural elements needed to build dome roof structure 100 can be readily identified. Specifically, as indicated in FIG. 6K, the perimeter of the dome roof structure 100, when projected in plan, substantially matches the boundary of the underlying area or building 99. The roof structure 100 is constructed from a plurality of sets of evenly or unevenly spaced arched parallel trusses 110. As shown, each of these arched parallel trusses has a lower end portion and a high end portion. The lower end portions of these arched parallel trusses are supported by outer compression ring 103, at nodes 131 located at the intersection of the anchor line 105 within the parallel lines 109. The high end portions of these arched parallel trusses intersect either one of a set of arched collector trusses 120 or a central tension member assembly 160, as shown. The collector trusses 120 are located, in plan, on the bisector lines 107. When viewed in plan, each parallel truss 110 is located either on a generator line 106 or on one of the parallel lines 109. A series of parallel hoop-like tension members 140 are located at linking points 141 which are disposed at different heights. Substantially vertical compression members 150 are located in plan at the intersection points 141. The lower ends of compression members 150 are attached to the hoop-like tension members 140.

Having described a preferred method of designing the geometrical relations among the various components of the roof structure of the present invention, it is appropriate at this juncture to describe in great detail the mechanisms used to established physical interconnections (i.e., links) among the components in the illustrative embodiments of the present invention.

Figure 7A:
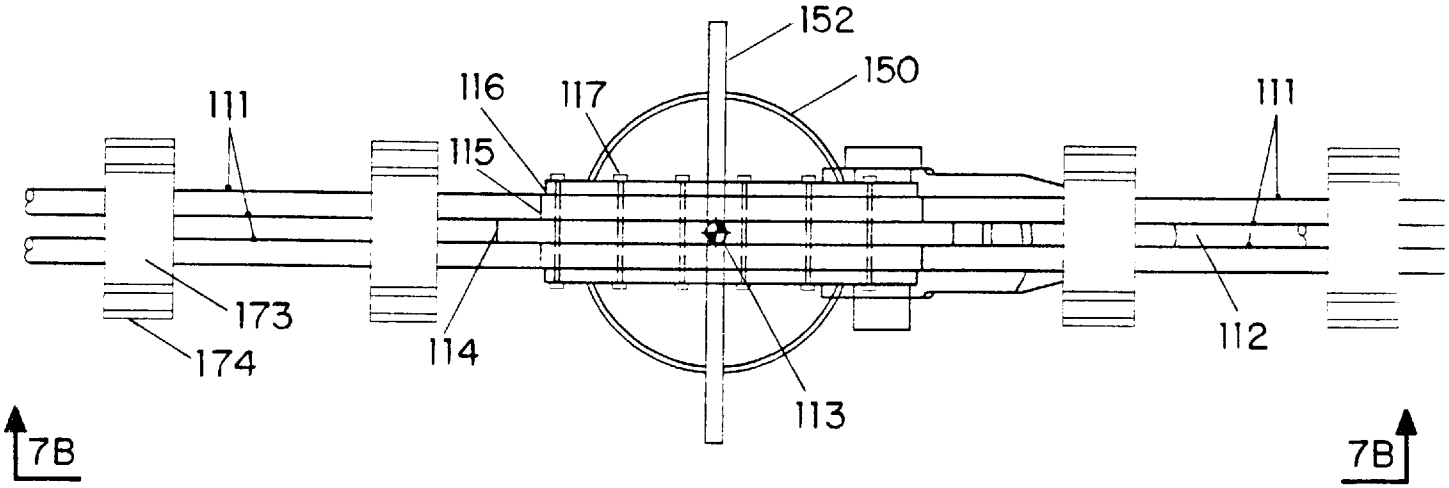
FIG. 7A is a plan view of the connection detail at the top of a compression member in a parallel truss of the roof structure of the first illustrative embodiment.
Figure 7B:
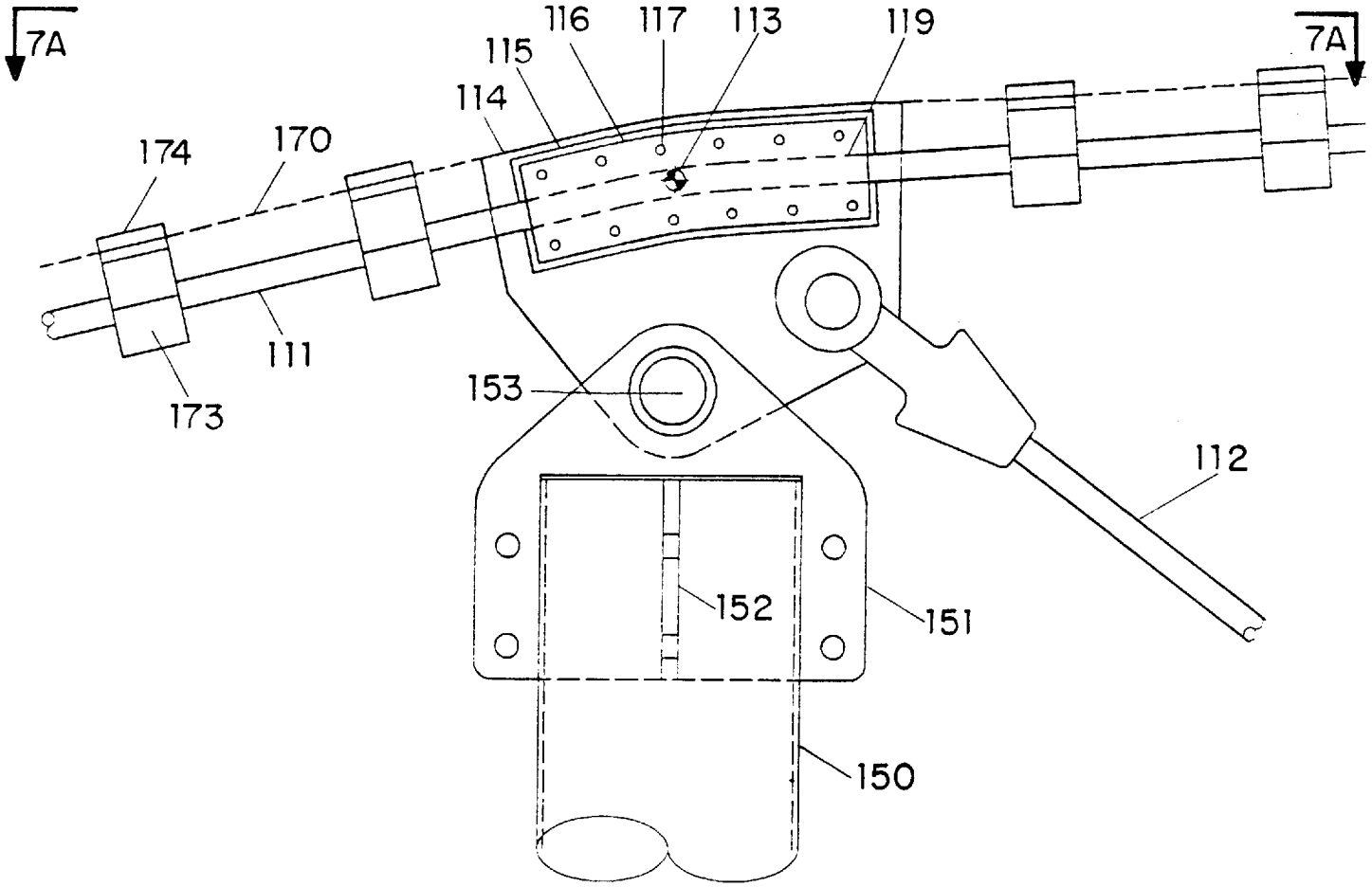
FIG. 7B is an elevated side view of the top portion of a compression member, taken along line 7B—7B in FIG. 7A.

In FIGS. 7A and 7B, a connection mechanism is shown for linking the upper end portion of each compression member 150 to both top chord tension member 111 and diagonal tension member 112 of a parallel truss 110. As illustrated in FIG. 7B, the centerlines of the axial forces along tension members 111 and 112 and the centerlines of the axial forces along compression member 150 intersect each other at point 113 on plate 114. Plates 151 are provided at the top of compression member 150 and are attached to plate 114 by means of pin 153. A plate 152 is provided for rigging plate 151 to compression member 150. Top chord tension members 111 are placed between saddle-like plates 115 and are secured to plate 114 by cover plates 116 and clamping bolts 117, as shown. The clamping force imposed by bolts 117 should be sufficiently large to develop frictional forces which prevent the top chord tension members 111 from slipping in response to differential forces presented under different loading conditions. A soft packing material 119, such as lead or aluminum, ensures that functional forces are developed and are uniformly distributed. As shown in FIG. 7B, the upper end portion of a diagonal tension member 112 is also attached to plate 114.

Figure 7C:
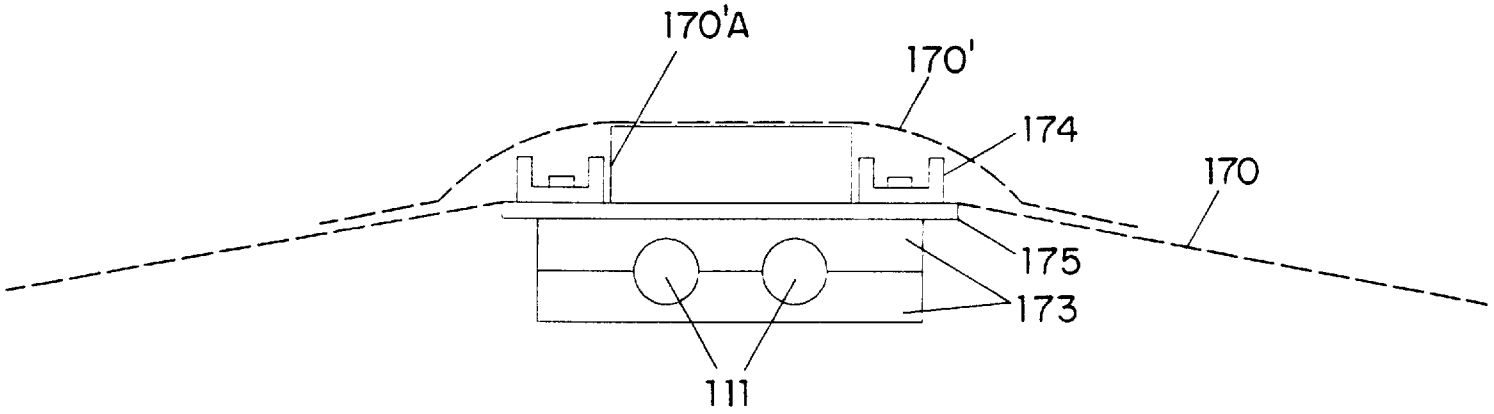
FIG. 7C is a cross-sectional view of the membrane attachment mechanism used to attach the flexible membrane to the top cord stiffener members of the roof structure of the first illustrative embodiment.

In FIGS. 7A, 7B and 7C, a membrane attachment mechanism is explicitly shown for attaching flexible membrane 170 to the top chord tension members 111. As shown in these drawings, a plurality of spaced apart clamps 173 are attached along the top chord tension elements 111 in order to facilitate attachment of the flexible membrane 170 by means of clamping elements 174. Plate 175 is welded to clamps 173. The flexible membrane 170 is held in place against plate 175 by clamping elements 174 and a cover 170' is placed over to seal the connection. The cover 170' and the membrane 170 can be joined by thermal welding or any other means that provides adequate connection strength. A support element **170*a*', such as a channel or a wooden block, can be used to protect the cover 170'. Similar details apply for the attachment of the flexible membrane 170 to the membrane stiffener tension members 180**.

Figure 8A:
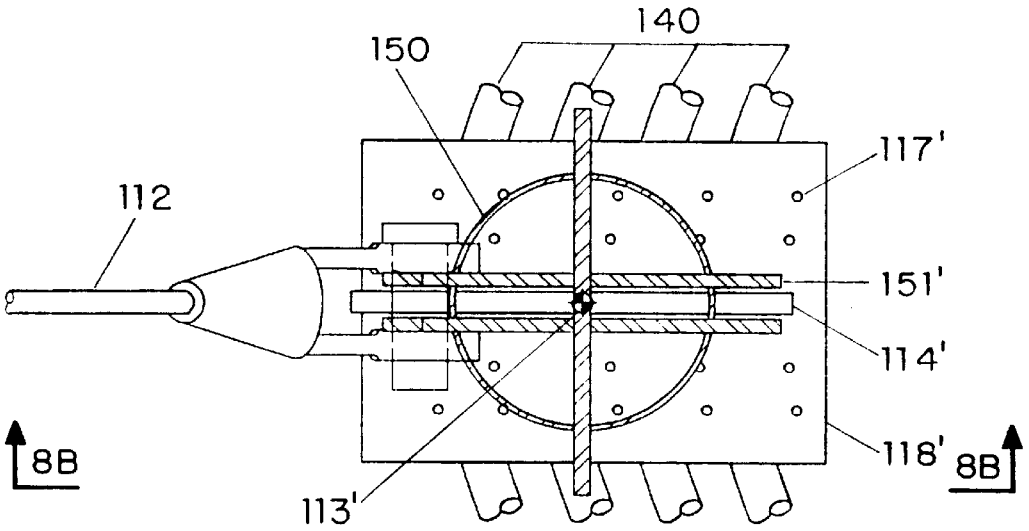
FIG. 8A is an elevated side view of the bottom portion of a compression member in a parallel truss of the roof structure of the first illustrative embodiment.
Figure 8B:
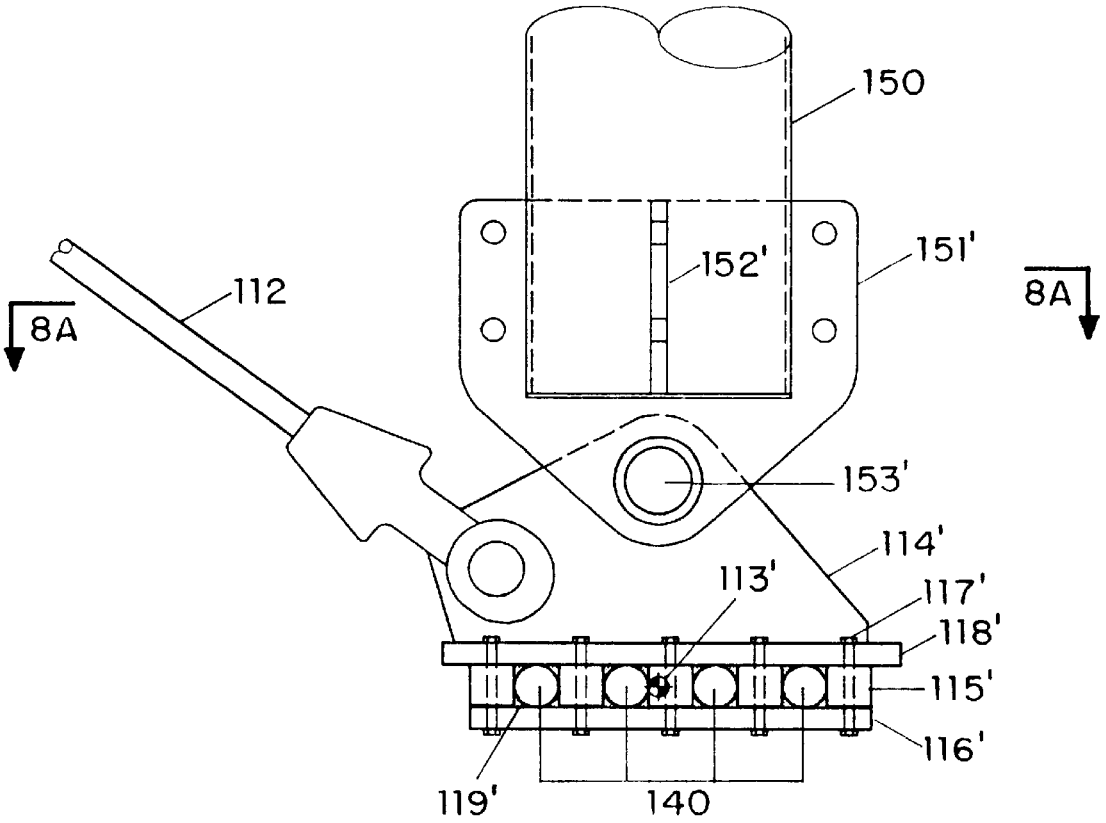
FIG. 8B is an elevated side view of the bottom portion of a compression member, taken along line 8B—8B in FIG. 8A.

In FIGS. 8A and 8B, a connection mechanism is shown for linking the lower end portion of each compression member 150 to the diagonal member 112 of a parallel truss 110 and to one of the hoop-like tension members 140 described above. As illustrated in FIG. 8B, the centerlines of the axial forces of tension members 112 and 140 and the centerlines of the axial forces of compression member 150 intersect each other at point 113' on plate 114'. Plates 151' are provided at the bottom of compression member 150 and are attached to plate 114' by means of pin 153'. A plate 152' is provided for rigging plate 151' to the bottom portion of the compression member 150. The lower end portion of one diagonal tension member 112 is also attached to plate 114'. Hoop-like tension members 140 are placed between saddle-like plates 115' and are secured to plate 118' by cover plate 116' and clamping bolts 117', as shown. The clamping force imposed by bolts 117' should be sufficiently large to develop frictional forces which prevent the hoop-like tension members 140 from slipping in response to differential forces presented under different loading conditions. A soft packing material 119', such as lead or aluminum, ensures that frictional forces are developed and uniformly distributed.

Figure 9A:
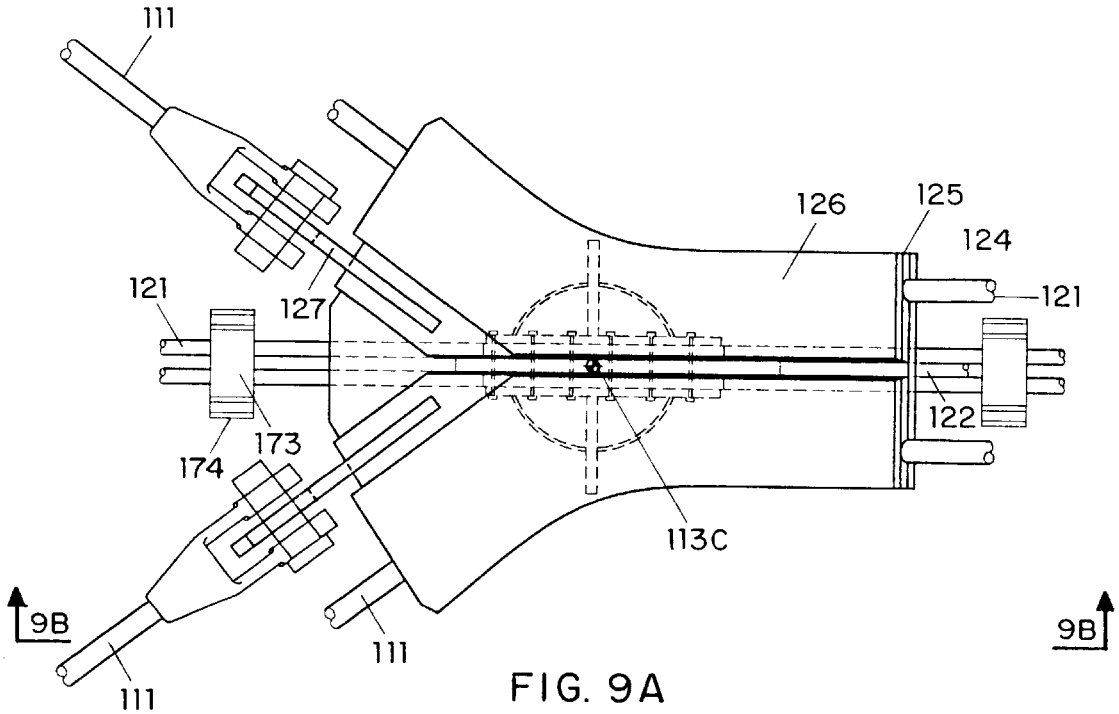
FIG. 9A is a plan view of the connection detail at the top of a compression member in a collector truss of the roof structure of the first illustative embodiment.
Figure 9B:
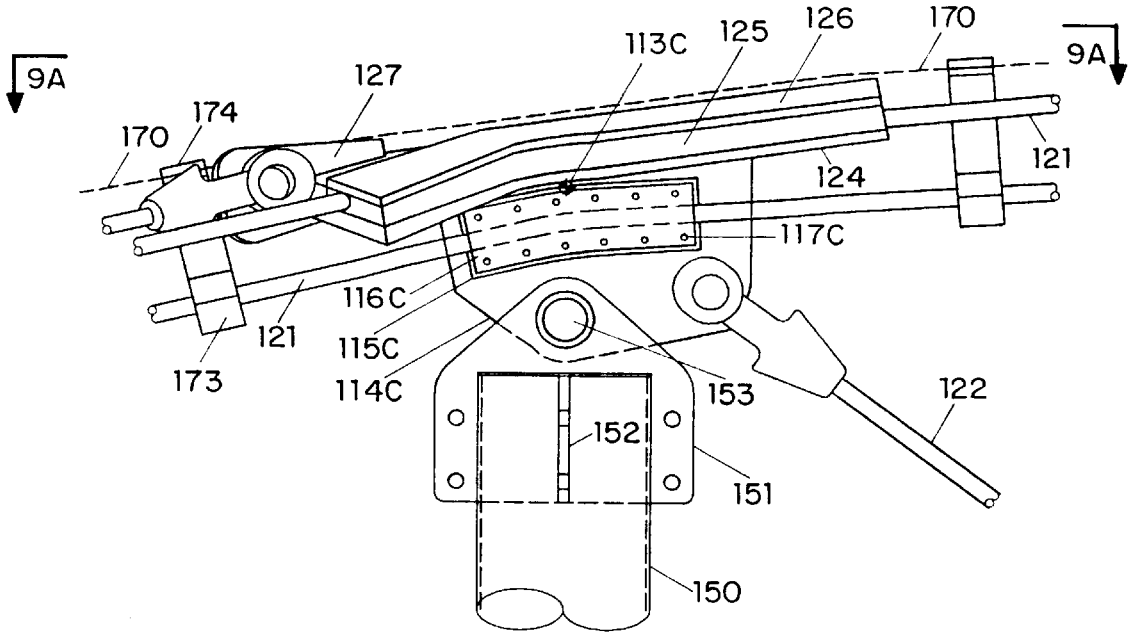
FIG. 9B is an elevated side view of the top of a compression member in a collector truss, taken along line 9B—9B in FIG. 9A.

FIGS. 9A and 9B illustrate a connection mechanism for linking the upper end of compression members 150 and the innermost top chord tension members 111 of the parallel trusses 100, to the top chord tension member 121 and the diagonal tension member 122 of the collector trusses 120. The centerlines of the axial forces of tension members 111, 121 and 122 and of compression member 150 intersect each other at point 113*c*. Plates 151 are provided at the top of compression member 150 to allow attachment to plate 114*c* by means of pin 153. Plates 152 serve construction and rigging purposes. Top chord tension members 121 are placed between saddle-like plates 115*c* and are secured to plate 114*c* by cover plates 116*c* and clamping bolts 117*c*. The clamping force imposed by bolts 117*c* is large enough to develop friction forces to avoid slipping of the top chord tension members 121 due to differential forces under different loading conditions. The upper end of diagonal tension member 122 is also attached to plate 114*c*. The upper end of diagonal tension member 122 is also attached to plate 114*c*. Some of the top chord tension members 111 are placed between saddle-like plates 125 and are secured to bent plate 124 by cover plates 1265. Plate 127 can be used to terminate some of the top chord tension members 111. Finally, bent plate 124 is welded to plate 114*c*.

Figure 10A:
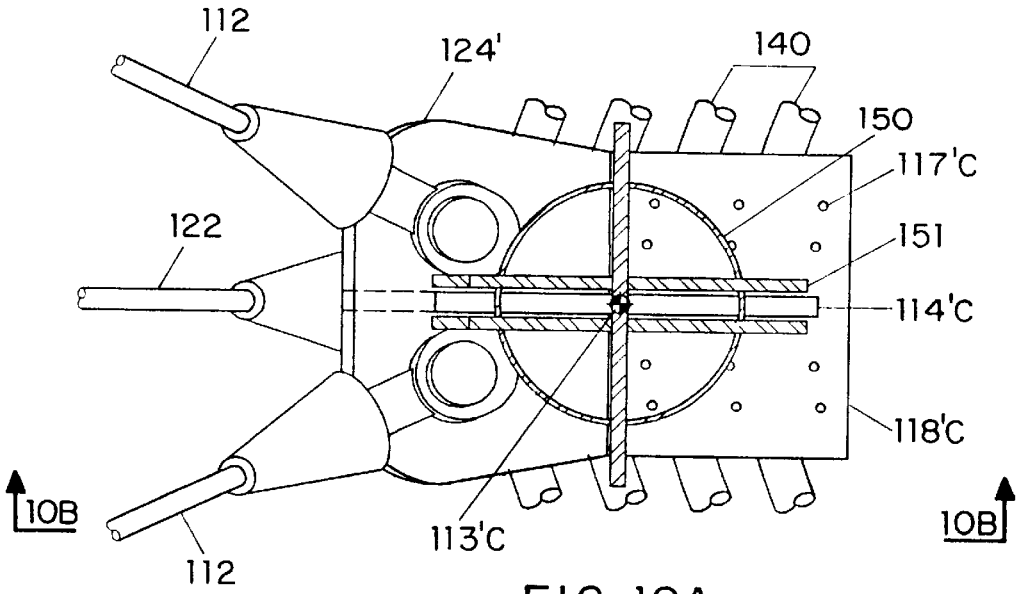
FIG. 10A is a plan view of the connection detail at the bottom of a compression member in a collector truss of the first illustrative embodiment of the roof structure.
Figure 10B:
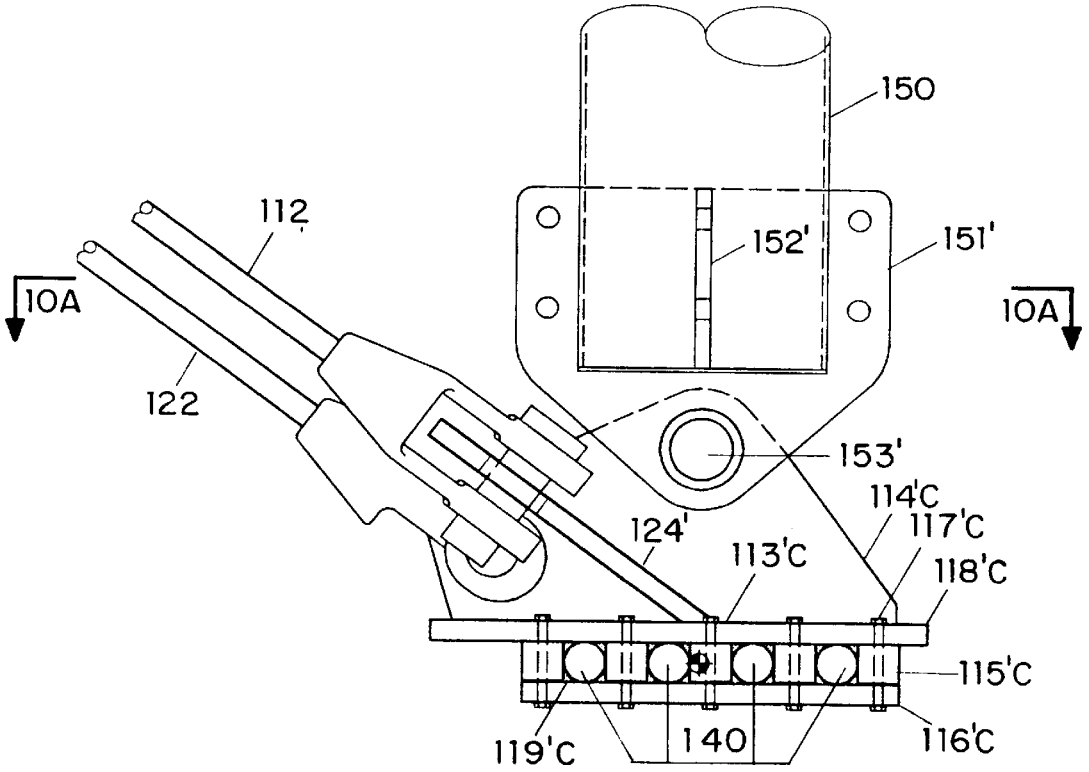
FIG. 10B is an elevated side view of a compression member in a collector truss, taken along line 10B—10B in FIG. 10A.

FIGS. 10A and 10B show the details of a connection mechanism for linking the lower end of compression members 150 and the innermost diagonal tension members 112 of the parallel trusses, to the diagonal tension members 122 of the collector trusses 120 and the hoop-like tension members 140, as shown. The centerlines of the axial forces of tension members 112, 122 and 140 and the centerlines of the axial forces of compression member 150, intersect each other at point 113*c*'. Plates 151' are provided at the bottom of compression member 150 to allow attachment to plate 114*c*' by means of pin 153'. Plates 152' serve construction and rigging purposes. Plate 118*c*' is secured to plate 114*c*'. Hoop-like tension members 140 are placed between saddle-like plates 115*c*' and are secured to plate 118*c*' by cover plates 116*c*' and clamping bolts 117*c*'. The clamping force imposed by bolts 117*c*' should be sufficiently large to develop friction forces to avoid slipping of the hoop-like tension members 140 due to differential forces under different loading conditions. A soft packing material 119*c*', such as lead or aluminum, ensures that frictional forces are developed and are uniformly distributed. The lower end of the diagonal tension member 122 is also attached to plate 114*c*'. Slotted plate 124' is welded to plate 114*c*' in order to receive the lower ends of the innermost diagonal tension members 112 of parallel trusses 110.

Figure 11A:
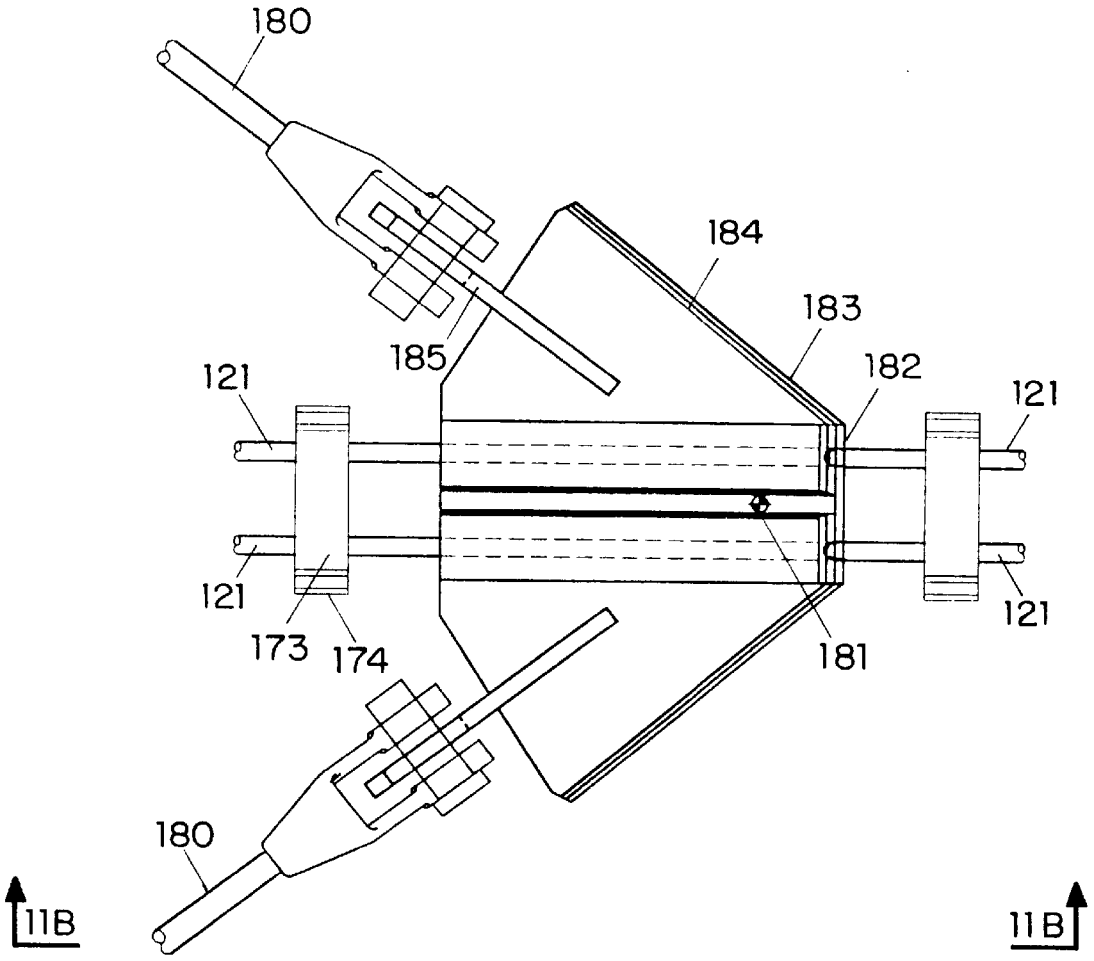
FIG. 11A is a plan view of the connection mechanism between a membrane stiffener tension member and a top chord tension member of a collector truss, in the first illustrative embodiment of the roof structure of the present invention.
Figure 11B:
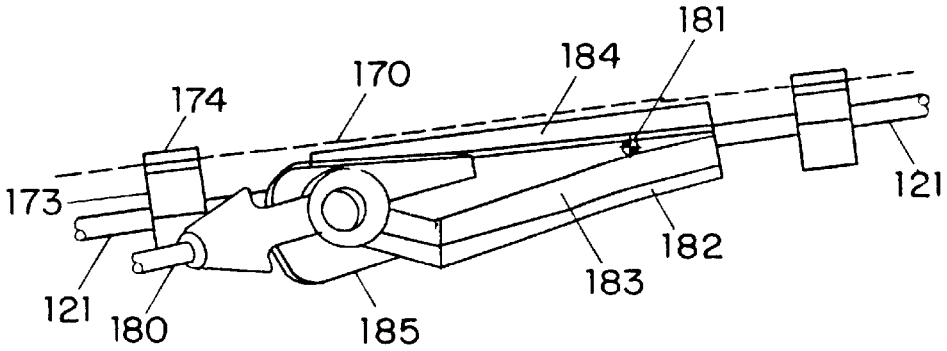
FIG. 11B is an elevated side view of the connection between a membrane stiffener tension member and a top chord-tension member of a collector truss, taken along line 11B—11B in FIG. 11A.

FIGS. 11A and 11B illustrate the details of a connection mechanism for linking the upper end of membrane stiffener tension members 180 to the top chord tension member 121 of the collector trusses 120. The centerlines of the axial forces along tension members 121 and 180 intersect each other at point 181, as shown. Top chord tension members 121 are placed between plates 183 and are secured to bent plate 182 by cover plates 184. Plates 185 are used to connect membrane stiffener tension members 180 to plates 182 and 183.

Figure 12:
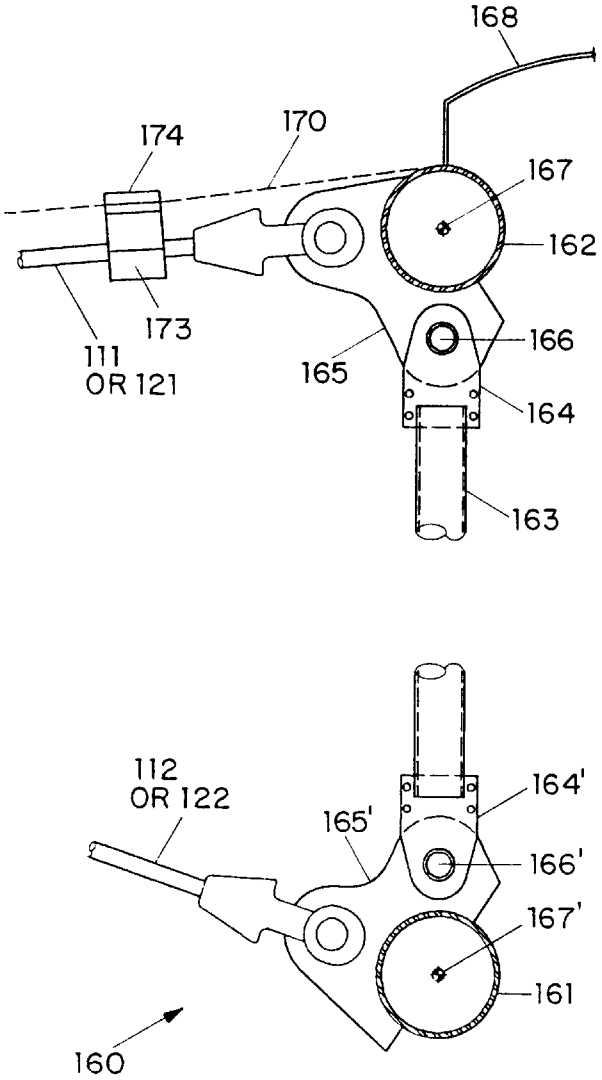
FIG. 12 is a cross-sectional view of the roof structure of the first illustrative embodiment of the present invention, taken through the upper and lower central tension members, along line 12—12 in FIG. 2A.

FIG. 12 provides a cross-sectional view of the central tension assembly 160 in the roof structure of the first illustrative embodiment. The upper central tension member 162 and the lower central tension member 161 are linked by substantially vertical posts 163. Upper and lower central tension members 162 and 161, respectively, each have a circular geometry and in the illustrative embodiment, are formed by bending and welding pipes. Plate 165 is used to connect the top chord tension members 111 of the parallel trusses 110 to post 163 and upper central tension member 162. Plates 164 are located at the top of post 163 to allow the connection using a pin 166. The centerlines of tension members 111 and 162 and the centerlines of compression member 163 intersect each other at point 167. Similarly, Plate 165' is used to connect the diagonal tension members 112 of the parallel trusses 110 to post 163 and lower central tension member 161. Plates 164' are located at the bottom of post 163 to allow the connection using a pin 166'. The centerlines of tension members 112 and 161 and the centerlines of compression member 163 intersect each other at point 167'. A cover 168 is placed over the central opening bound by the upper central tension member 162.

Figure 12A:
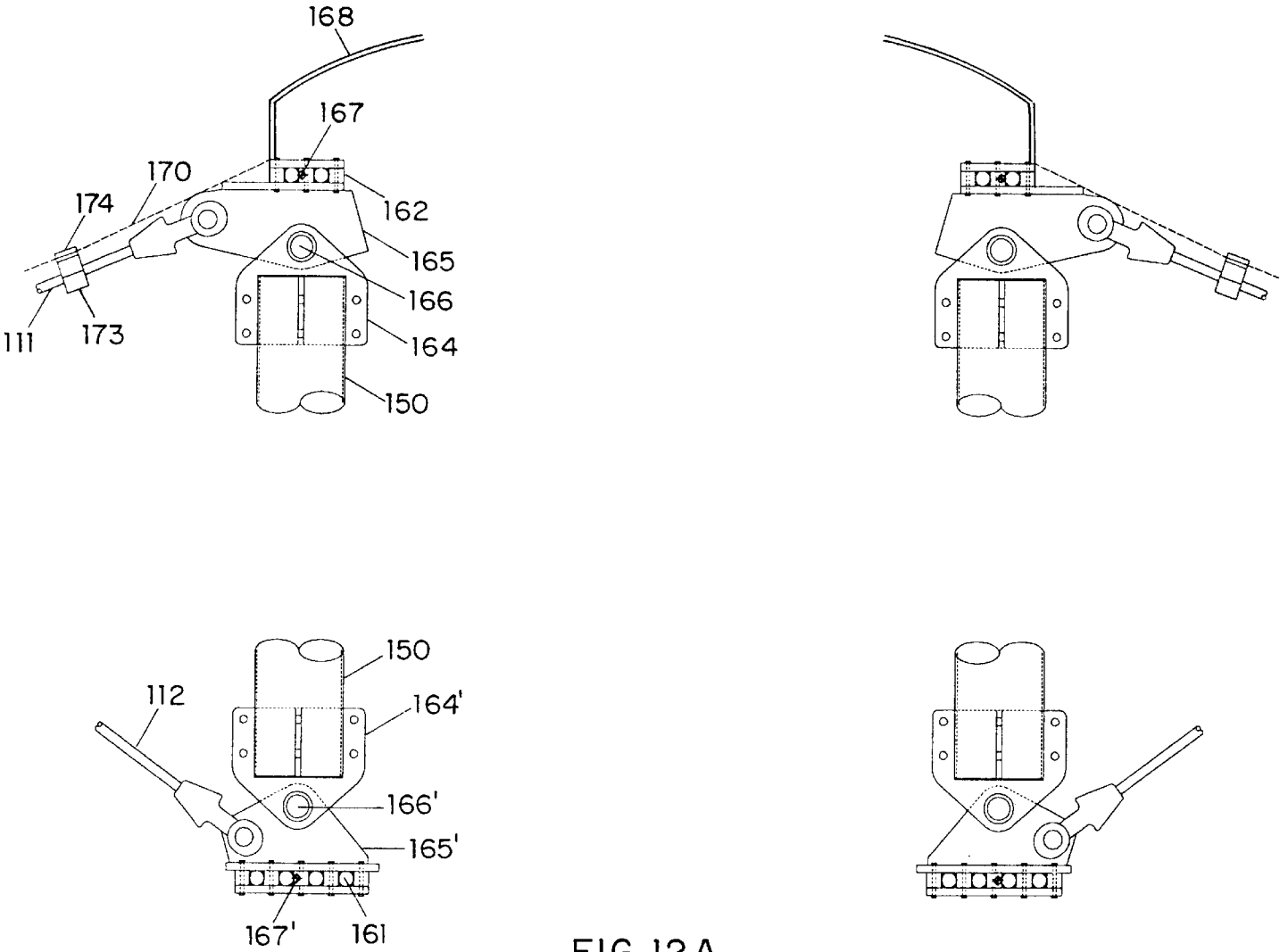
FIG. 12A is a cross-sectional view of the roof structure of an alternative illustrative embodiment of the present invention, taken through the upper and lower central tension members, along line 12—12 in FIG. 2A.

As illustrated in FIG. 12A, the central tension members 161 and 162 can also be detailed following the same guidelines used for the connections of the hoop-like tension members 140. FIG. 12A shows the resulting connection details where the elements in FIG. 12 have been identified with like numerals. The central tension assembly of FIG. 12A can be especially used when the area under roof cover 168 is relatively large. If the roof cover 168 is not used and the central opening is large, then the resulting roof structure becomes a long span canopy.

Figure 13:
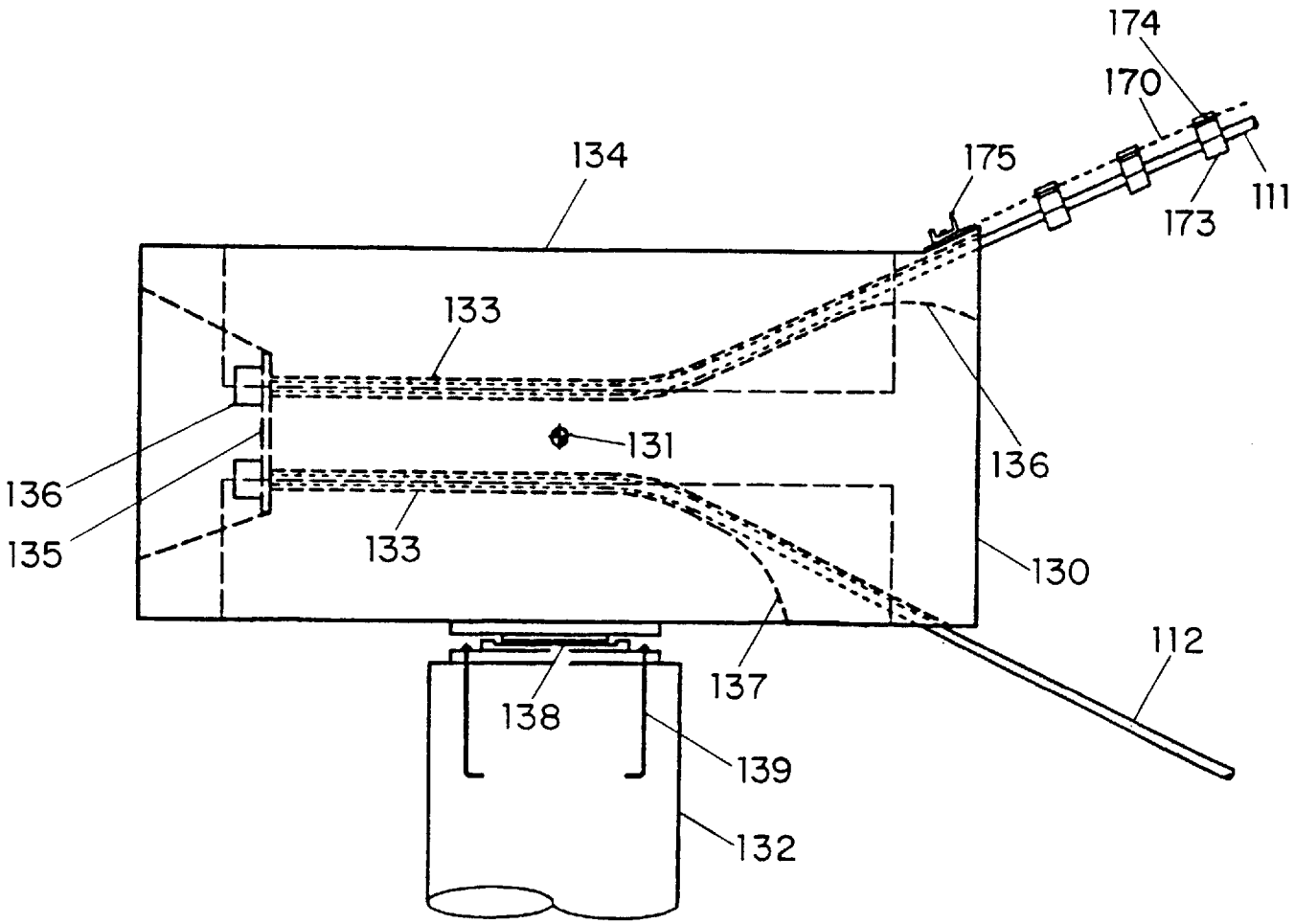
FIG. 13 is a cross-sectional view of the compression ring structure, taken along line 13—13 in FIG. 2A.

FIG. 13 shows a means for attaching the outermost portion of the top chord tension members 111 and 121, and the outermost portion of the diagonal tension members 112 and 122, to the compression ring 130 at point 131. In the preferred embodiment, the lines of action of the tensile forces in tension members 111 and 112, the axial forces in the compression ring 130, and reaction forces from support member 132, intersect each other at point 131 in the compression ring 130 in order to eliminate eccentricities that can cause excessive bending or torsional moments on the compression ring 130. As shown, tension members 111 and 112 are placed inside conduits 133, through an adequately reinforced anchor 134, and are then passed to the exterior side of the compression ring 130 where they are physically anchored by means of a bearing plate 135 and end fittings 136. As shown, saddle-like surfaces 137 are provided in anchor 134 so as to avoid overstressing of the tensions members 111 and 112 during roof erection procedures. In the illustrative embodiment, the compression ring 130 rests on a sliding bearing pot 138 that is connected to column 132 using anchor bolts 139. The function of bearing pot 138 is to allow compression ring 130 to move in the direction perpendicular its centerline, while preventing movement in the tangential direction. The effect of such constraints on compression ring movement is a reduction of stresses due to changes in temperature, and resistance to lateral loads due to wind or earthquakes.

In order for the roof structure 100 to be able to withstand external forces, such that no tension member goes slack and reasonable displacements may take place, the tension members must have a certain amount of prestress. This means that even in the absence of external loads, the forces in the tension members will be nonzero. This is particularly important requirement for the construction stage, as tension members in their unstretched condition will be significantly shorter than in their final stretched position when the roof is completely erected. This implies that during the different construction stages, different members must be stressed in order to be installed into position.

One way to accomplish stressing of the roof structure 100 is to use vertical compression members 150 of fixed length, hang the unstretched hoop-like tension members 140 from the lower end of the compression members 150, and use jacks to pull the lower end of the diagonal tension members 112 and 122 into position at their connection point to the compression member 150.

Another way of stressing the roof structure 100 is to use compression members 150 of variable length, as shown in FIGS. 15A to 15G. The construction of roof structure 100 can proceed using compression members 150 that become shortened in the final stressed roof condition. In this way, hoop-like tension members 140 and diagonal tension members 112 and 122 can be easily installed, and the stressing of the members can take place by elongating the compression members 150 to their final length.

Figure 15:
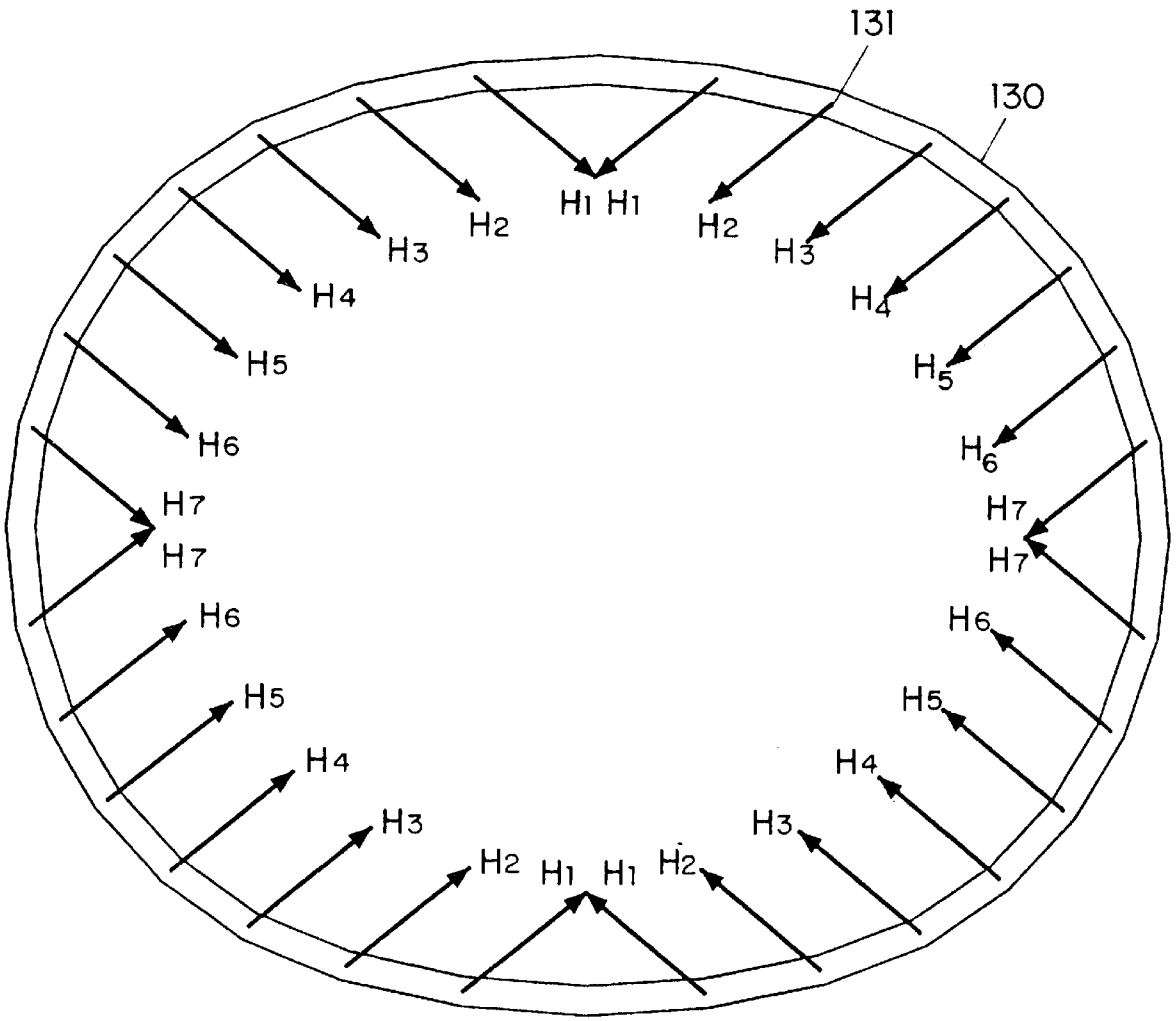
FIG. 15 is a schematic representation showing the forces applied on the compression ring of the roof structure of the present invention.
Figure 15A:
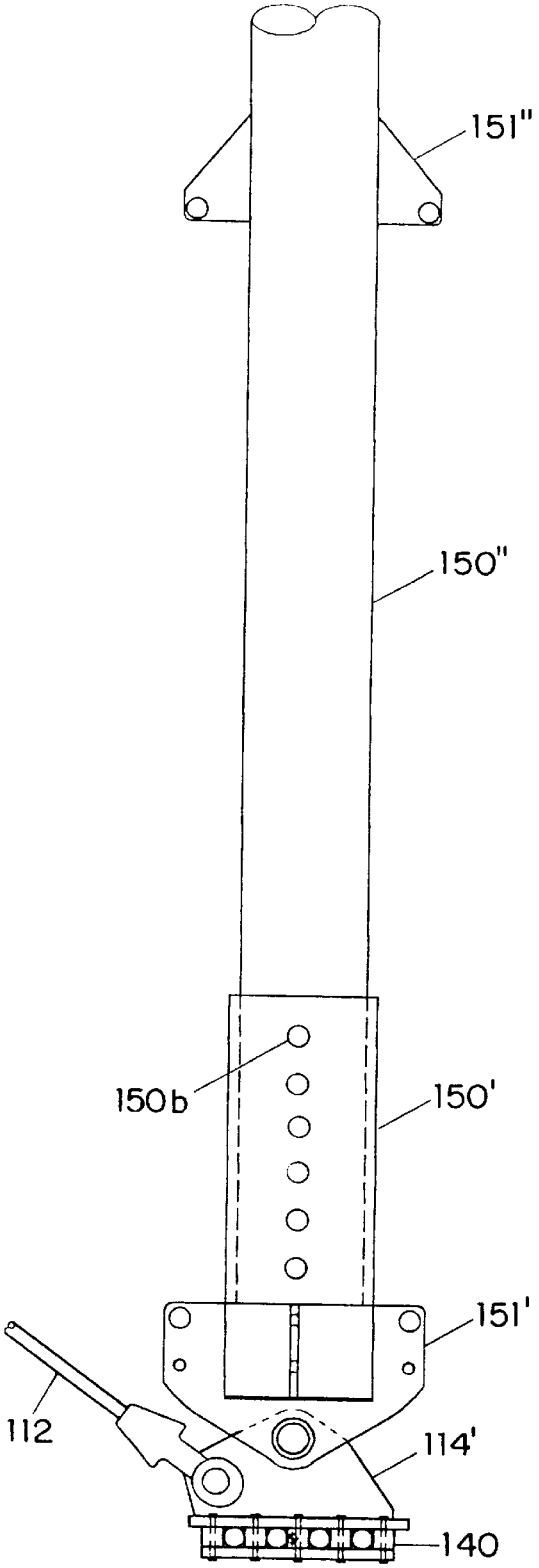
FIG. 15A is an elevated side view of the vertical compression member of the first illustrative embodiment of the present invention.
Figure 15B:
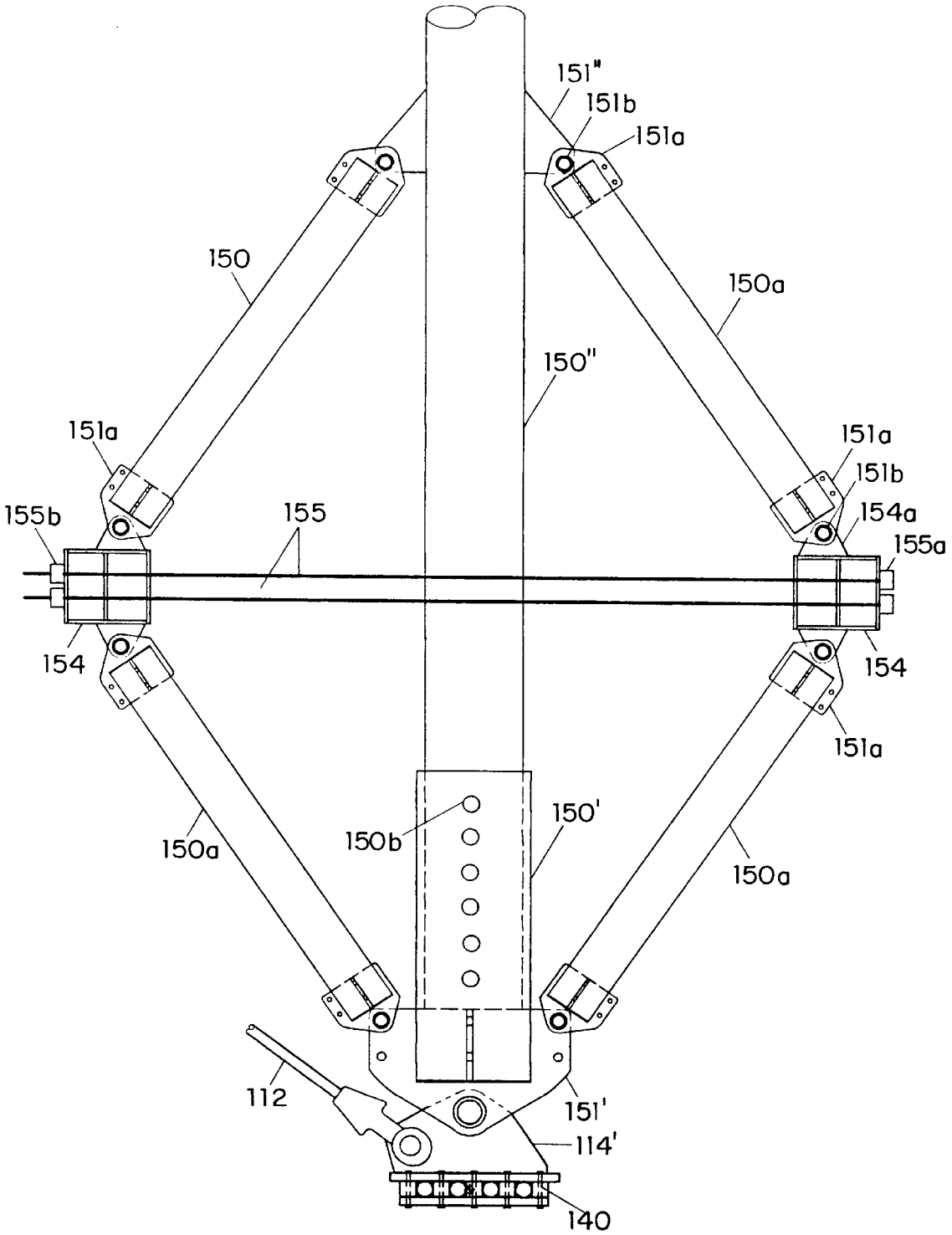
FIGS. 15B and 15C are elevated side views illustrating the vertical compression member of FIG. 15, being erected using specialized apparatus.

FIGS. 15A through FIG. 15E illustrate one method installing a variable length compression member 150 in the roof structure of the present invention. As shown in FIG. 15A, a typical vertical compression members 150, in its unelongated position, is divided into two sections, 150' and 150". The upper section 150" fits inside the hollow lower section 150'. The elongation of compression member 150 can be accomplished by pulling up the portion of section 150" that is inside section 150', using the jack assembly shown in FIG. 15B. As shown, the jack assembly comprises two sets of compression members 150*a*. The first set of compression member 150*a* is hingedly connected between plates 151" in section 150" and plates 514*a*, which are secured to two assemblies of plates 154. The second set of compression members is attached hingedly connected between plates 151' in section 150' and plates 514*a* secured to plate assemblies 154, as shown. All connections of compression members 150*a* to plates 151', 151", and 154*a* are made using pins 151*b* so that free rotations are allowed. A set of cables 155 are threaded through both plate assemblies 154 and are provided with fixed end fittings 155*a* at one plate assembly 154 and with stressing end fittings 155*b* at the other plate assembly 154.

Figure 15C:
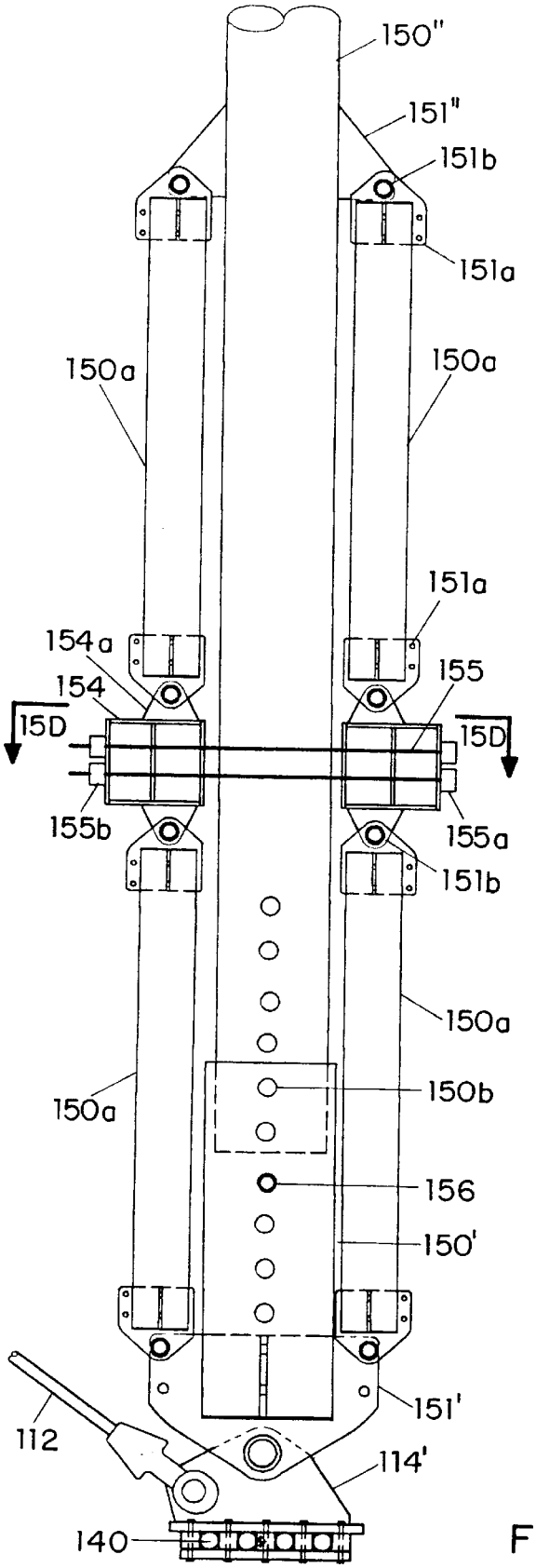
Figure 15D:
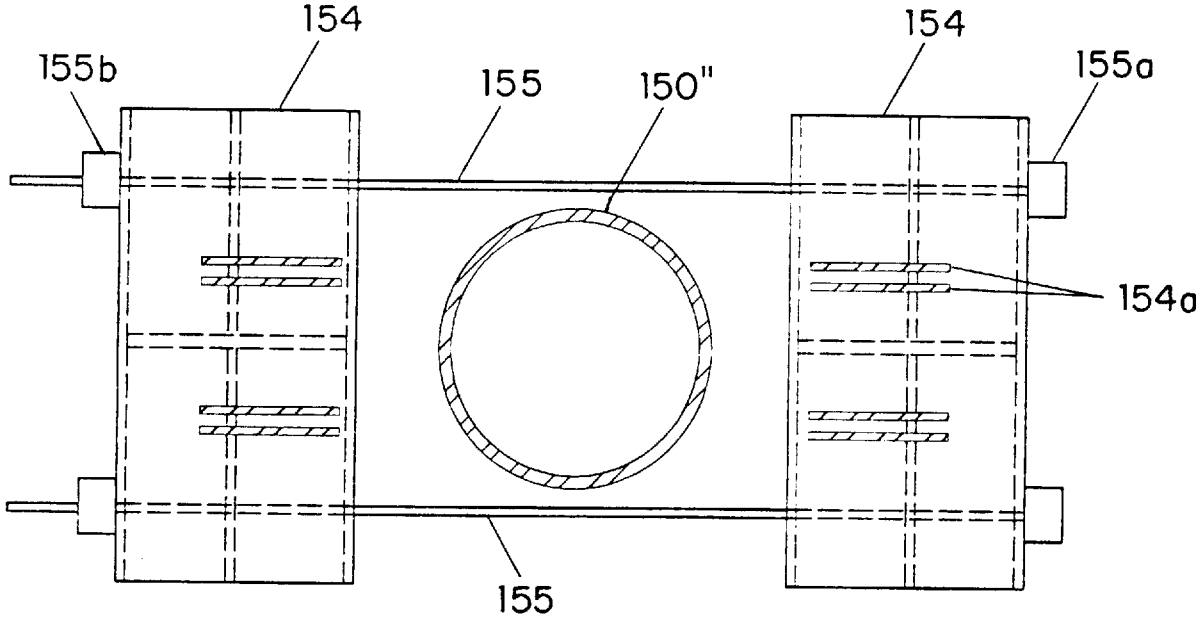
FIG. 15D is a cross-sectional view of the vertical compression member of the first illustrative embodiment, shown in FIG. 15C.
Figure 15E:
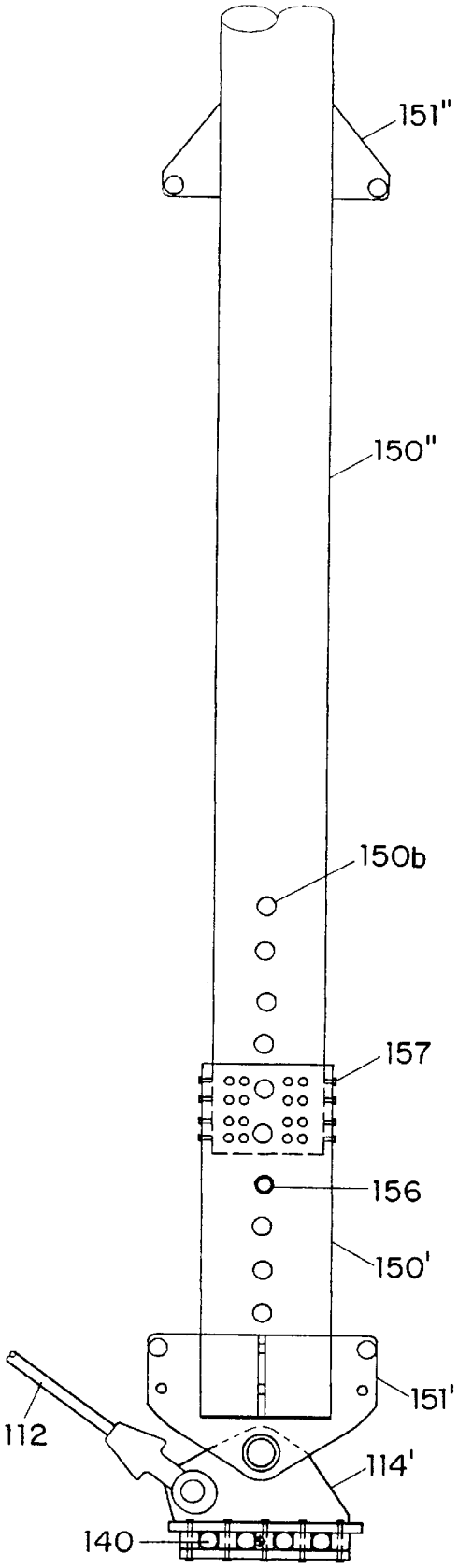
FIG. 15E is an elevated side view of the vertical compression member of the first illustrative embodiment, shown erected, locked into its erected vertical configuration, and with the specialized installation apparatus removed therefrom.

Preferably, the elongation of the compression member 150 is achieved by using hydraulic jacks that pull cables 155 together and shorten their length. At the end of the jacking operation, the compression member 150 is elongated, as shown in FIGS. 15C and 15D. Pins 156 can be used for safety during the jacking operation so that as section 150" moves up, pins 156 are moved up the pin holes 150*b*. At the end of the jacking operation, a set of bolts 157 is used to hold sections 150' and 150" in their final positions. Thereafter, the force in cables 155 is released so that compression members 15*a* and plate assembles 154 can be removed, as shown in FIG. 15E. The jacking equipment and operation can then be moved to another compression member 150. Using the same technique, the stressing of the roof structure 100 can be accomplished using a relatively small jacking force. The length of the compression members 150*a*, the maximum required jacking force, and the amount of required elongation of compression member 150 are the parameters that can be used by the designer and the contractor to optimize the construction of roof structure 100.

Figure 15F:
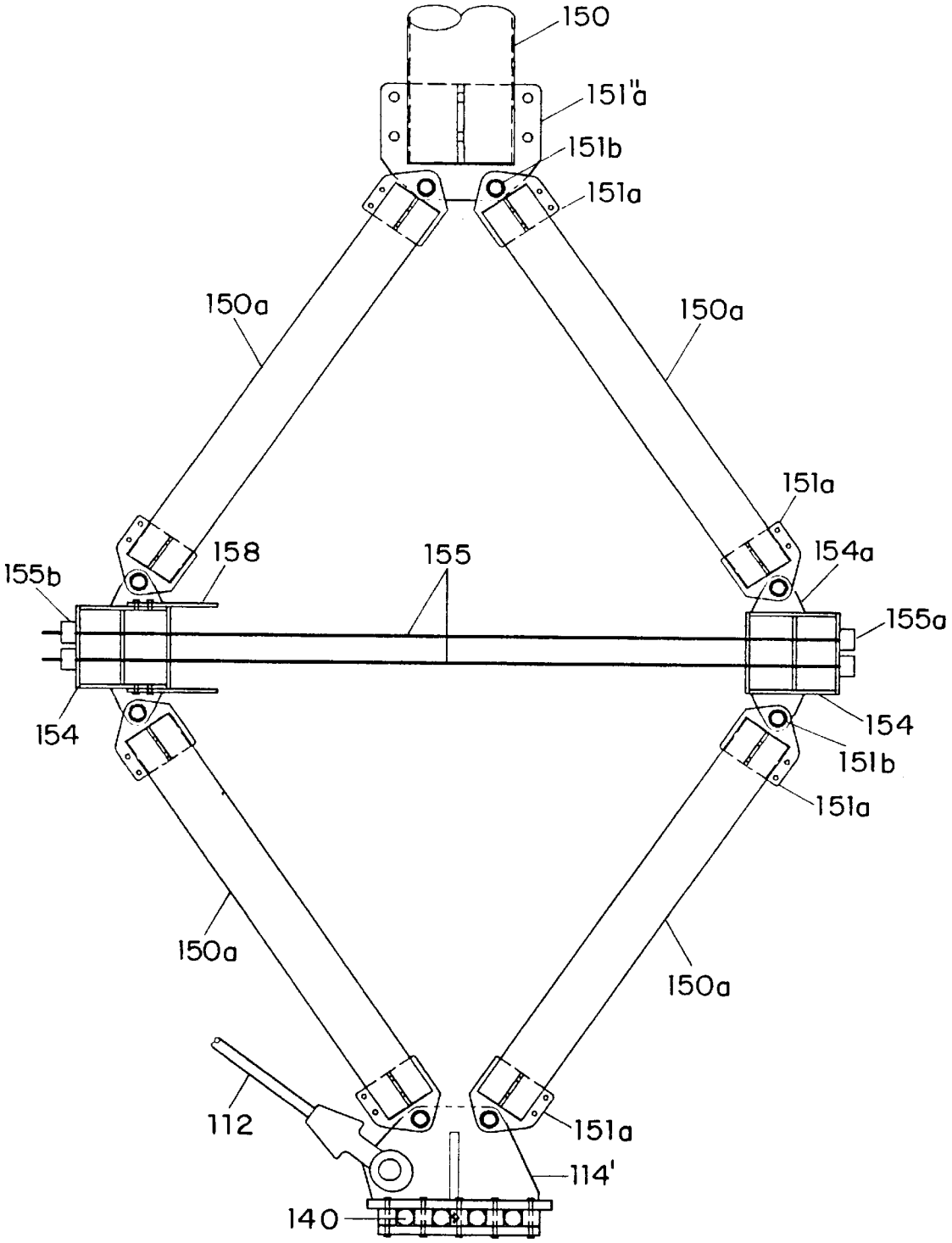
FIG. 15F is an elevated side view of the vertical compression member of an alternative embodiment of the present invention, shown in its non-erected configuration.
Figure 15G:
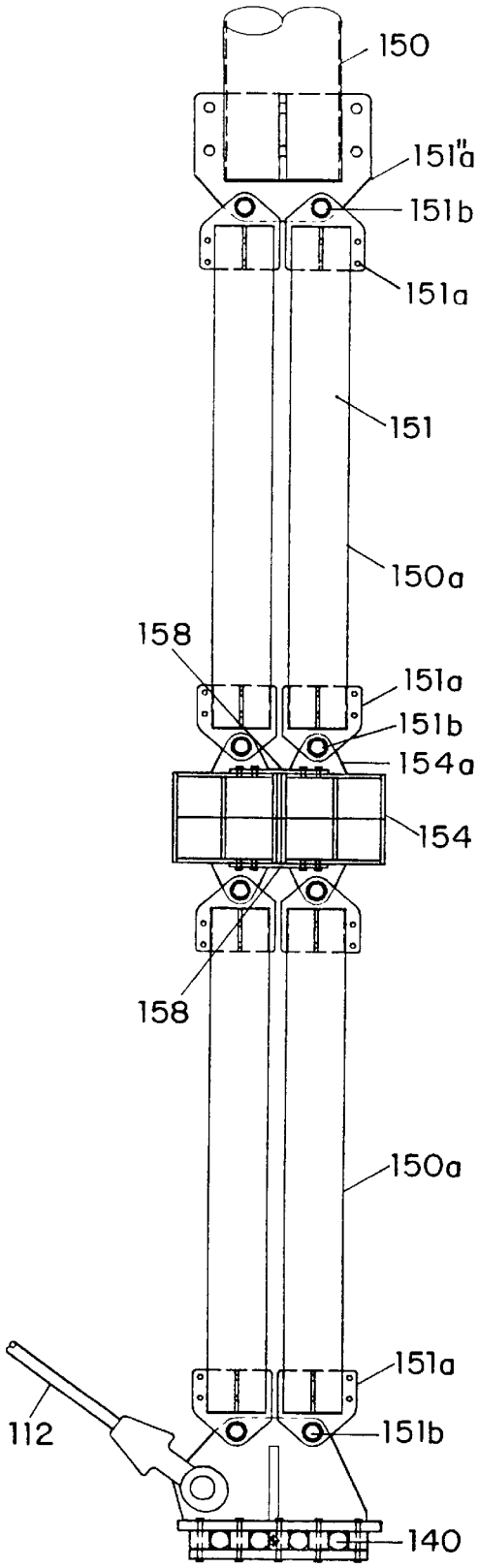
FIG. 15G is an elevated side view of the vertical compression member of the alternative embodiment of the present invention, shown it vertically erected configuration.

In certain projects, it might be advantageous and cost effective to incorporate the above-described elongation technique directly into the design of the compression members 150 so that compression members 150*a* will be a part of compression member 150. This approach is illustrated in FIGS. 15F and 15G. FIG. 15F shows compression member 150 in its unelongated position. The set of compression members 150*a* are attached from one end to plates 151*a*" in compression member 150 and directly to plates 114'. The other end of compression members 150*a* is attached to plates 154*a* that are secured to two plate assemblies 154. All connections of compression members 150*a* to plates 151', 151", and 154*a* are made using pins 151*b* so that free rotations are allowed. A set of cables 155 are threaded through both plate assemblies 154 and provided with fixed end fittings 155*a* at one plate assembly 154 and with stressing end fittings 155*b* at the other plate assembly 154. The elongation of the compression member 150 can then be done by using hydraulic jacks that pull cables 155, straightening up the bent compression members 150*a*. At the end of the jacking operation the compression member will be elongated as shown in FIG. 15G. At the end of the jacking, a set of plates 158 are used to tie plate assemblies 154 together, and thereafter cables 155 are removed. In this illustrative embodiment, compression members 150*a* and plate assemblies 154 form a permanent part of compression member 150. Additional plates 159 can be bolted to compression members 150*a* in order to tie them together and improve stability. Depending on the total length of compression member 150, compression members 150*a* may be only a fraction of the total length of compression member 150, or the full length thereof. It is also possible to reverse the process in order to unstress the roof structure 100, totally or partially, so that it could be feasible to use it as a temporary structure that can be disassembled, stored, and moved somewhere else.

FIRST ILLUSTRATIVE EMBODIMENT OF THE ROOF STRUCTURE WITH RETRACTABLE FLEXIBLE MEMBRANE

In accordance with the present invention, the membrane attachment mechanism shown in FIG. 7C can be easily modified to allow the membrane cover of the roof structure to be retractable. This capability is attributed to the fact that each adjacent set of parallel arched trusses 110 can support a set of parallel tracks along which membrane panels are permitted to move. Modification details for this feature of the present invention are shown in FIGS. 7D and 7E, and 9C and 9D.

Figure 7D:
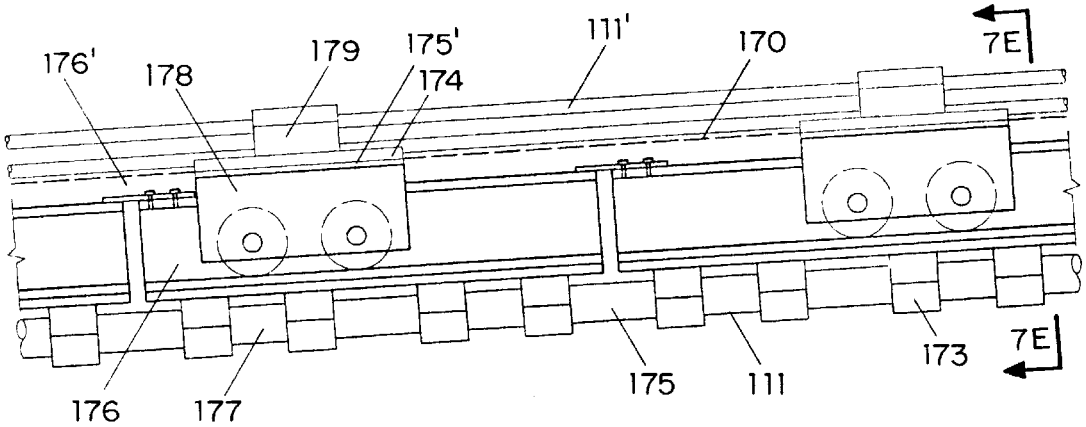
FIG. 7D is an elevated side view of an alternative embodiment of the membrane attachment mechanism of the present invention used in providing the roof structure with a retractable membrane covering.
Figure 7E:
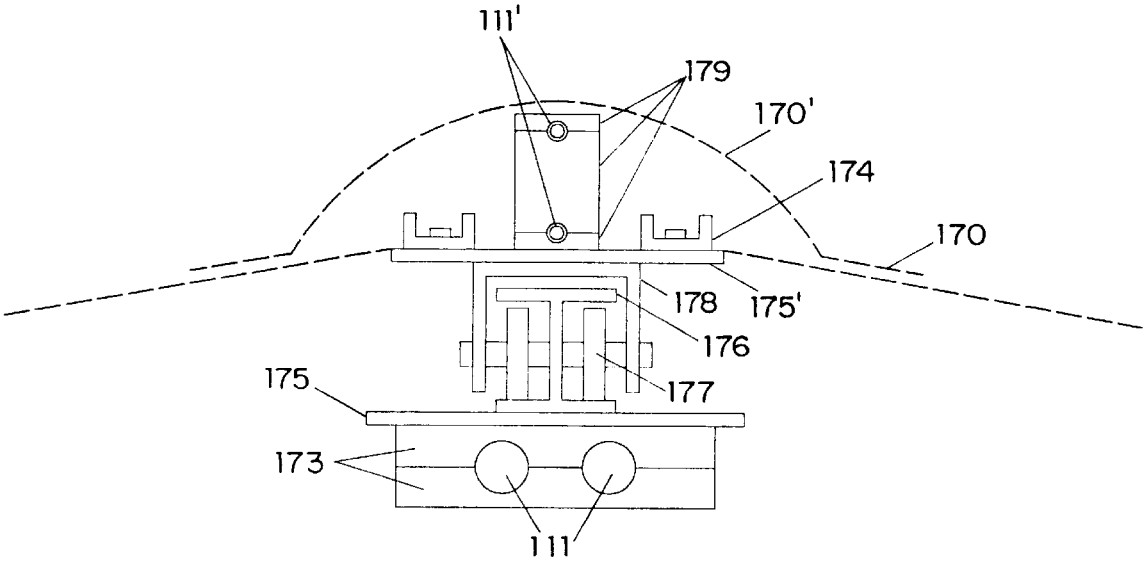
FIG. 7E is a cross sectional view of the membrane attachment mechanism of the alternative embodiment of the present invention, taken along line 7E—7E in FIG. 7D.

As illustrated in FIGS. 7D and 7E, clamps 173 and plate 175 in this embodiment serve the same function of grabbing the top chord tension member 111. A series of rails 176, flexibly linked by means of slotted plates 176' that permit longitudinal movement but restrain transverse movement, are affixed to plates 175, as shown. In order to permit flexible membrane to move relative to the top chord tension member 111, a plurality of spaced apart carriages 178 are disposed therebetween. As shown in FIG. 7E in particular, each carriage 178 has two pairs of spaced apart wheels that are free to ride along rails 176. Each carriage 178 supports a plate 175' to which flexible membrane 170 is attached by means of clamping elements 174. A grooved guide block 179 is mounted upon each plate 175' in order to form an assembly thereof. A closed loop cable 111' runs from the compression ring 130 to the upper end of the innermost top chord tension member 111 and is threaded through the assembly of grooved guide blocks 179. Cable 111' is free to move through the grooves in blocks 179, except at the uppermost, or front, carriage 178. In this way, when cable 111' moves it will push down or pull up the other carriages 178 and consequently move flexible cover 170'. In its expanded configuration, the membrane 170 is stretched out away from the compression ring 130, covering the entire roof surface. In its retracted position, the membrane 170 is collected towards the compression ring 130, leaving most of the roof structure open.

Figure 9C:
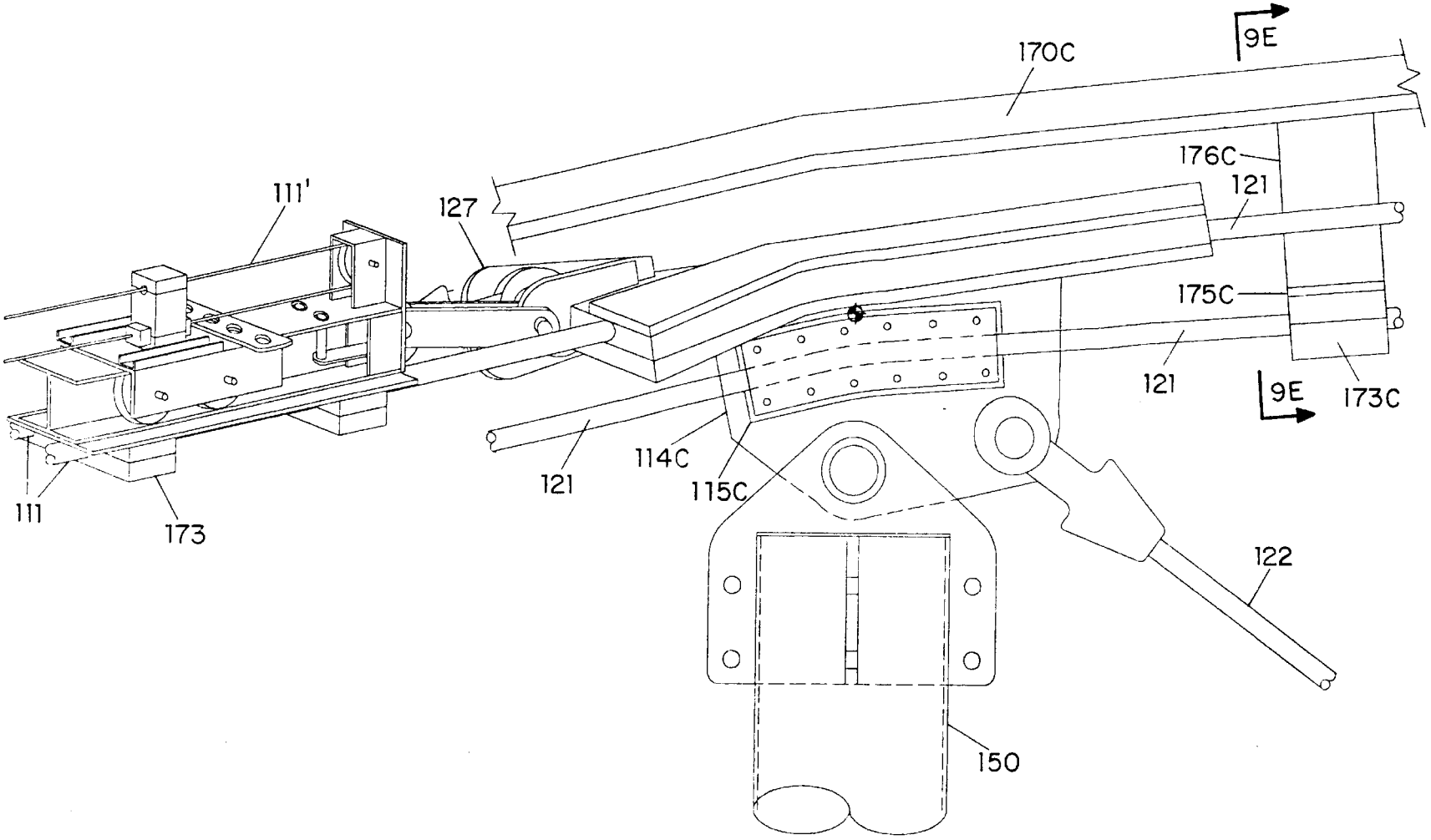
FIG. 9C is an elevated perspective view of the top of a compression member in a collector truss of the roof structure with the retractable membrane covering.
Figure 9D:
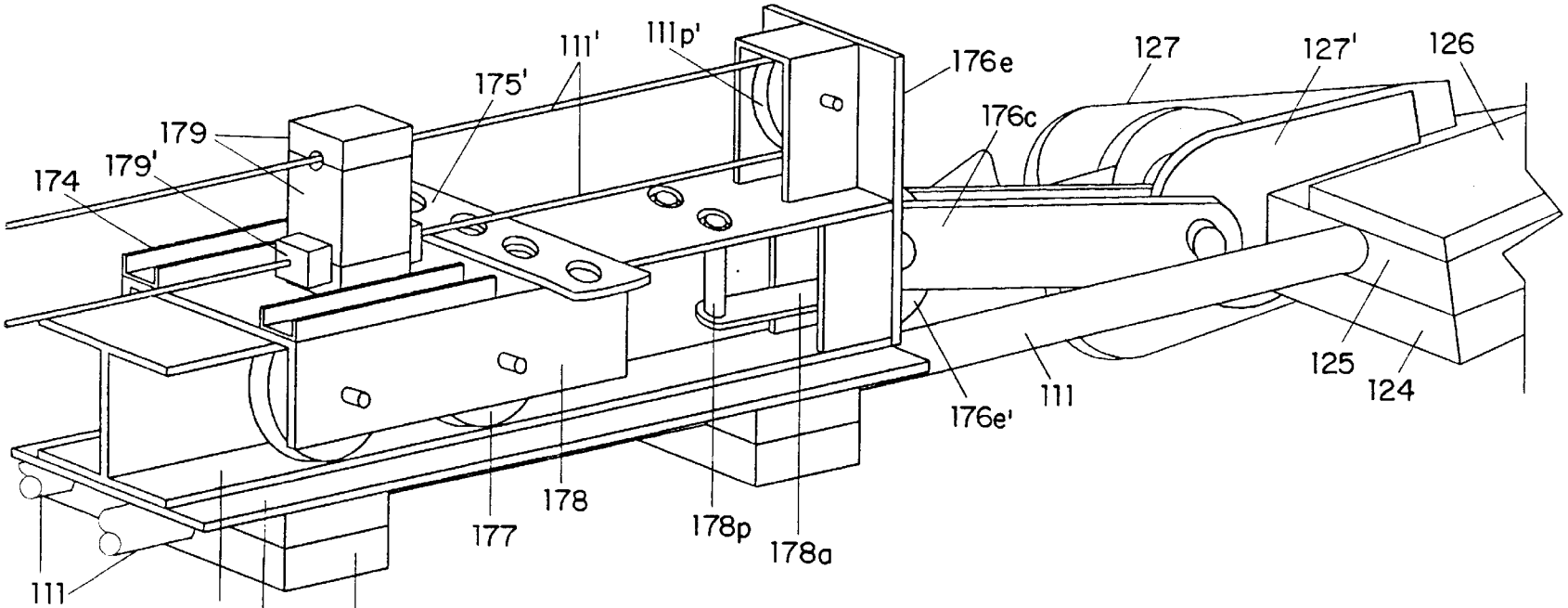
FIG. 9D is a perspective view of the membrane attachment mechanism of the retractable roof structure embodiment.
Figure 9E:
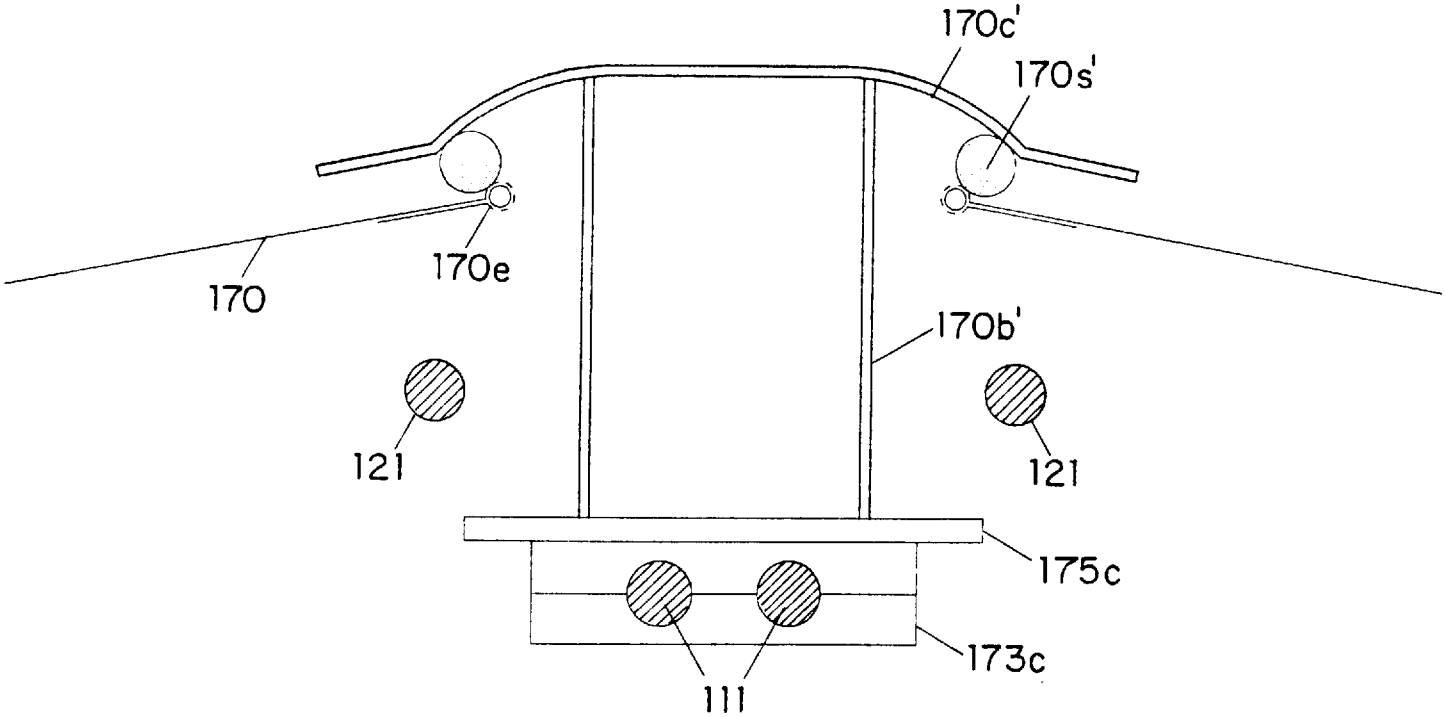
FIG. 9E is a cross-sectional view of the membrane attachment mechanism, taken along line 9E—9E in FIG. 9C.

In the retractable roof cover embodiment shown in FIG. 7D and 7E and described above, it is necessary to anchor the front carriage 178. This anchoring condition is illustrated in FIGS. 9C and 9D. As shown, the front carriage 178 rides on wheels 177 which move along rails 176 that are attached to the top chord tension member 111 of the parallel trusses 110 by means of plate 175 and clamps 173. Cable 111' runs in a continuous closed loop around pulley 111*p*'. The upper portion of cable 111' runs free through the guide blocks 179, whereas the lower portion is secured to blocks 179 by means of a pair of claims 179'. Therefore, when cable 111' is in motion it will pull the front carriage 178 which will push back or pull forward the rest of the carriages 178. FIG. 9D shows the front carriage 178 in its unlocked position. Actuators 178*a* are provided to move pins 178*p* that will fit into pin holes in the front carriage 178 and in plate 175' in order to lock the panels of membrane 170 in a closed position. Although not shown, the system could also incorporate a network of sensors that detect the arrival of the front carriages so that the locking of the membrane panels can be properly coordinated using a central control computer 400. The flexible membrane 170 is secured to plate 175' by clamping elements 174, and additional pin holes are provided in plate 175' in order to attach edge cables 170*e* to reinforce the borders of the panels of membrane 170 as shown in FIG. 9E. The rail 176 is reinforced by an end plate 176*e* to which a plate 176*e*' is secured. A pair of double-pinned plates 176*c* connect plate 176*e*' to a plate 127' which is attached to the plates 124 and 125, located atop the vertical compression members 150 of the collector trusses.

In order to fill the gap between the top chord tension members 121 of the collector trusses 120 and the edge of the panels of the flexible membrane 170, a cover is provided, as shown in FIG. 9E. Clamps 173*c* are attached to the top chord tension members 121 of the collector trusses 120. A plate 175*c*, secured to the clamps 173*c*, provides the base for member 170*b*' which supports cover 170*c*'. As shown, cover 170*c*' extends over the gap between the edge cables 170*e*. When the membrane 170 is in its closed position, pneumatic seals 170*s*' can be inflated to close the space between the cover 170*c*' and the membrane 170.

Figure 13A:
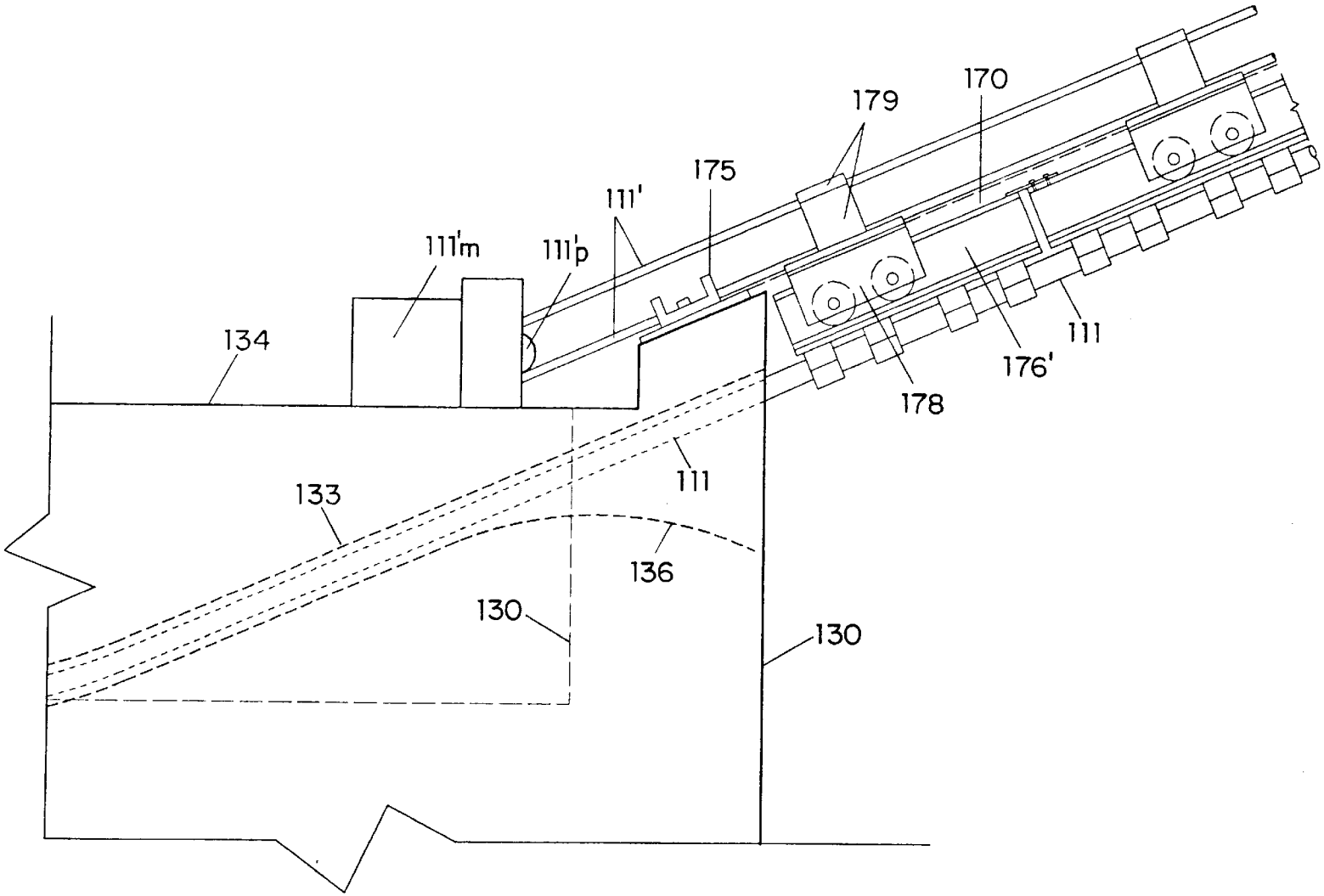
FIG. 13A is a cross-sectional view of the compression ring structure of the roof structure of the present invention with the retractable membrane covering.

When flexible membrane 170 is attached to the top chord tension members 111 by means of the carriages 178, the electric motors 111*m*' are mounted on anchor 134 in order to drive cables 111', as shown in FIG. 13A. In such embodiments, a winch is provided at the anchorage point of the membrane stiffener tension member 180 in order to release the tension in the membrane stiffener tension member 180. By doing so, that the membrane prestress is released and the membrane cover 170 is permitted to move easier. When the membrane 170 is returned to its closed position, the same winch is used to retighten the membrane stiffener tension member 180, and thus, the membrane 170.

METHOD OF CONSTRUCTING THE ROOF STRUCTURE OF PRESENT INVENTION

Figure 14A:
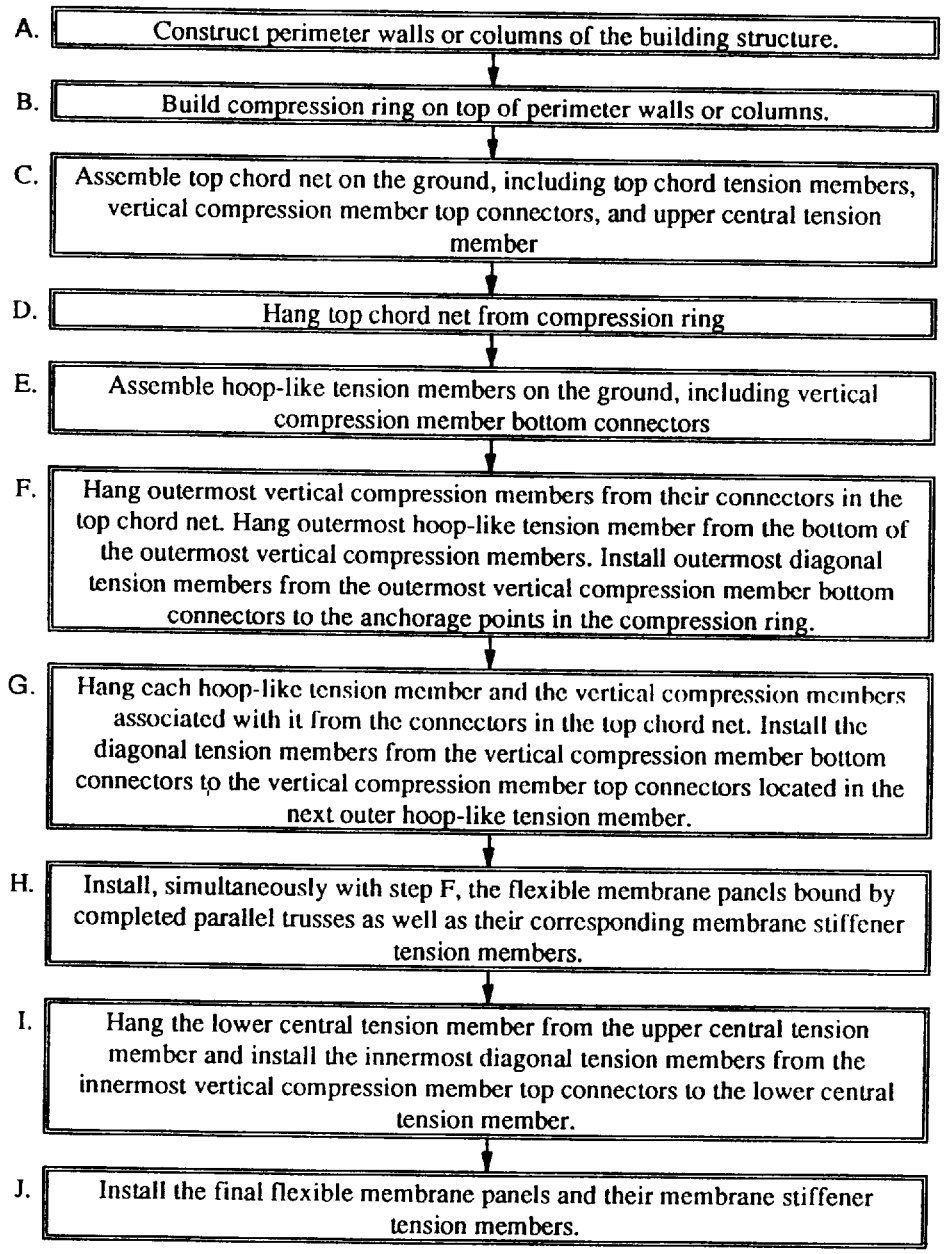
FIG. 14A is a flow chart showing the steps involved in the method of constructing the roof structure hereof in accordance with the principles of the present invention.

FIG. 14A presents a flow chart setting forth the general construction steps that can be followed to efficiently erect the dome roof 100 of the present invention. These steps shall be described below with reference to FIGS. 14B through 14V. Notably, the drawings of FIGS. 14B through 14V are organized in sets of three (e.g., FIGS. 14B, 14C, and 14D) so that two plan views of the upper and lower networks and a cross-sectional view thereof are provided in order to clearly show the progress achieved at each step of the construction process.

As indicated at Block A of FIG. 14A, the first step of the construction process involves constructing perimeter walls or columns (e.g., support columns 132).

Figures 14B, 14C, 14D, 14E, 14F, 14G:
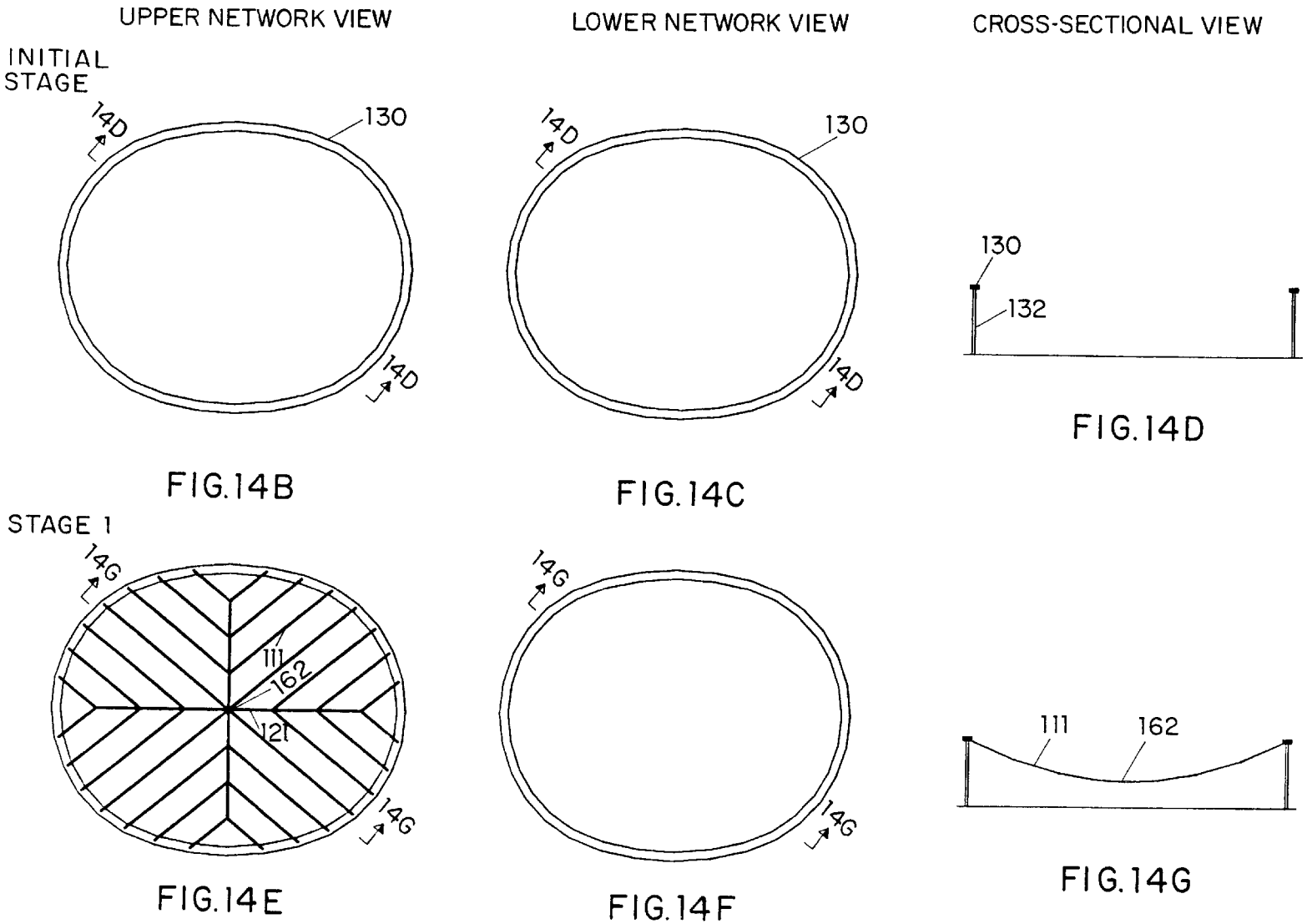
FIGS. 14B through 14V are plan views of the components of the roof structure, illustrating steps involved in the method of constructing the roof structure of the present invention.

As indicated at Block B of FIG. 14B, the next step of the construction process involves building the compression ring 130 on top of the perimeter walls or columns. These steps are schematically illustrated at FIGS. 14B to 14D.

At Block C, the top chord net (i.e., top chord tension members, vertical compression member top connectors and upper central tension member) is assembled on the ground. Then at Block D, the assembled top chord net is hung from the compression ring 130, as illustrated in FIGS. 14E to 14G. As shown in FIG. 14E, the top chord net is formed by top chord tension members 111 and 121 and upper central tension member 162. As shown in FIGS. 14F and 14G, neither diagonal tension members 112 and 122 nor hoop-like tension members 140 have been installed at this stage.

Figure 14J:
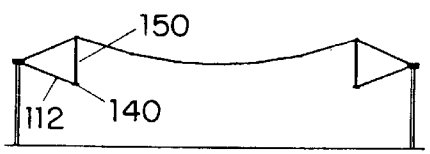
Figure 14M:
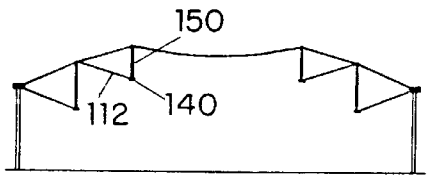
Figure 14I:
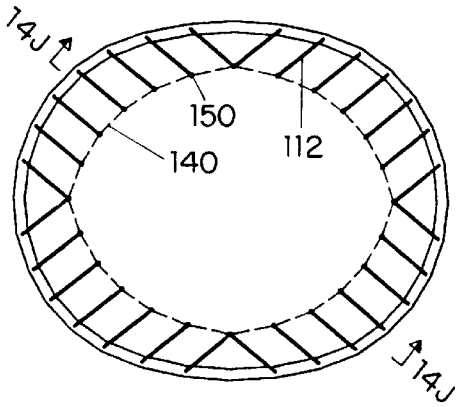
Figure 14L:
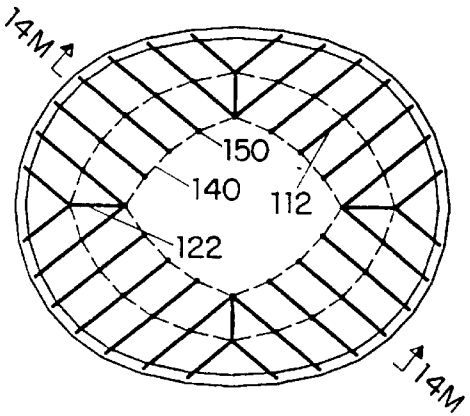
Figure 14H:
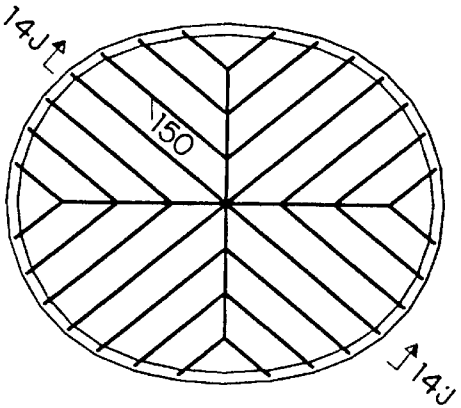

At Block E, the next step of the construction process involves assembling hoop-like tension members (e.g., installing the outermost vertical compression members 150, outermost hoop-like tension member 140, and outermost diagonal tension members 112 and 122), as shown in FIGS. 14H to 14J.

Figure 14K:
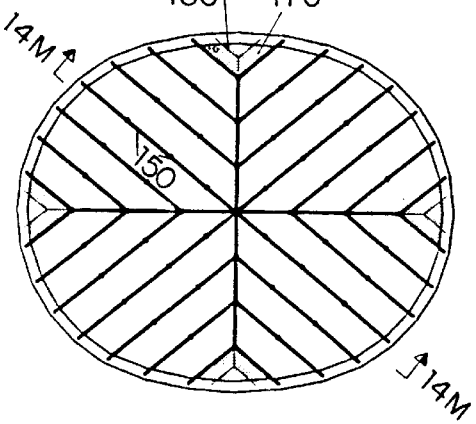
Figure 14P:
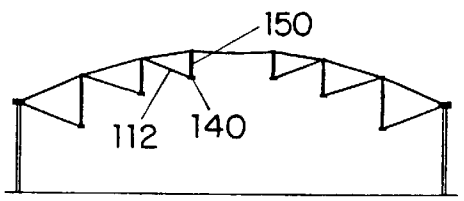
Figure 14S:
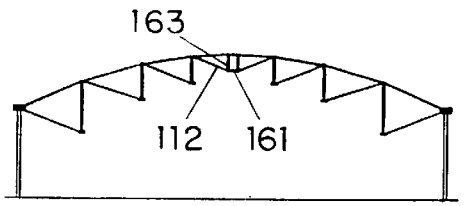
Figure 14O:
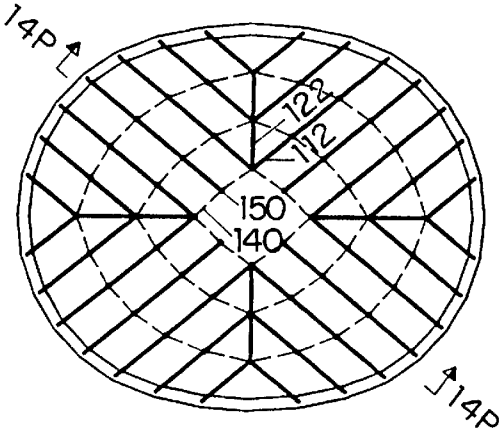
Figure 14R:
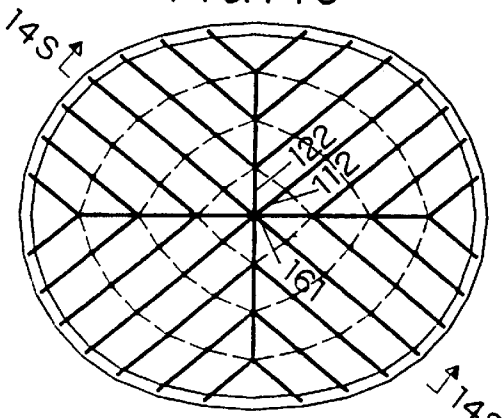

At Block G, the next step of the constuction process, illustrated at FIGS. 14K to 14M, involves hanging each hoop-like tension member 140 and vertical compression member 150. Simultaneously, the outermost diagonal tension members 112 and 122 are installed between the vertical compression member bottom connectors and the vertical compression member top connectors located in the next outer hoop-like tension member.

As indicated at Block H, the flexible membranes 170 bound by completed parallel trusses, as well as their membrane stiffener tension members 180 are simultaneously installed with the operations of step G. Notably, the ability to simultaneously install the flexible membrane 170 with the above-described elements is one of the advantages of the dome roof structure 100 of this invention, as it minimizes the overall construction time.

Figure 14N:
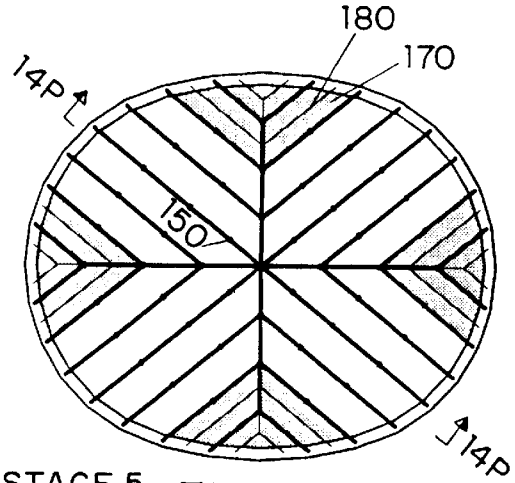

Subsequently, the next inner vertical compression members 150, the next inner hoop-like tension member 140, and the next inner diagonal tension members 112 and 122 are installed, as shown in FIGS. 14N to 14D. As indicated in FIG. 14N, the installation of the flexible membrane 170 and its membrane stiffener tension members 180 proceeds simultaneously for those panels where all the vertical compression members 150 that support them have been installed.

Figure 14Q:
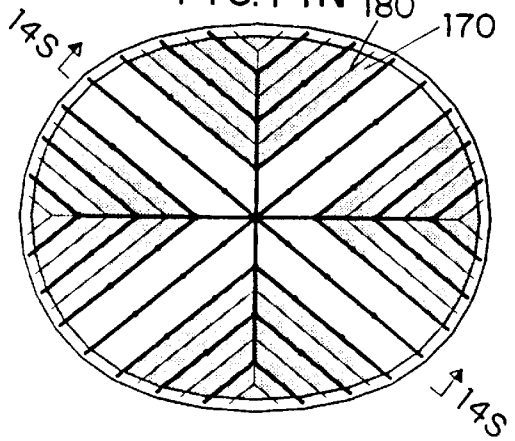
Figure 14V:
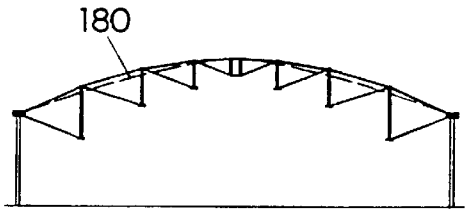
Figure 14U:
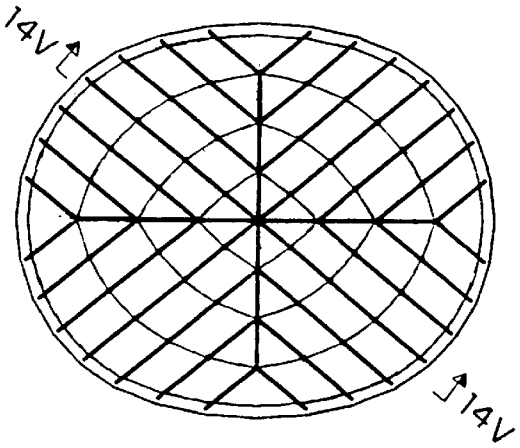
Figure 14T:
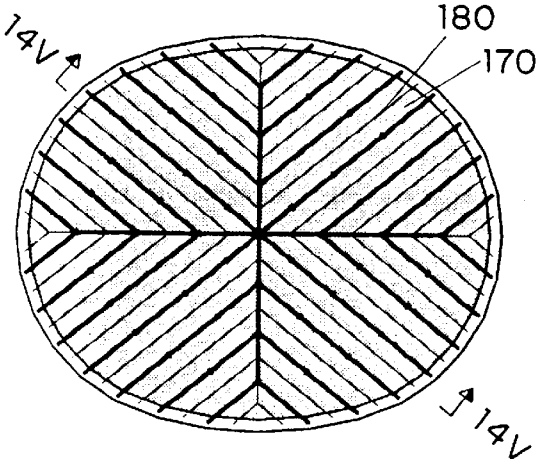

As indicated at Block I of FIG. 14A, the next step of the process involves hanging the lower central tension member 161 from the upper central tension member 163 andusing posts 163 and installing the innermost diagonal tension members 112 and 122 from the innermost vertical compression member top connectors to the lower central tension member 161, as indicated in FIGS. 14Q to 14S. Finally, at Block J, the installation of the flexible membrane 170 and its membrane stiffener tension members continues simultaneously. As indicated at Block J, the dome roof structure 100 is completed by installing the last panels of flexible membrane 170 and their corresponding membrane stiffener tension members 180, as shown in FIGS. 14T through 14V.

One of the unique advantages of the dome roof structure of the present invention is the resulting distribution of forces that the parallel trusses 110 apply, at points 131, to the compression ring 130 of the present invention. As shown in FIG. 15, forces H1 through H7 are the resultant forces of the tension in the top chord tension members 111 and the diagonal tension members 112 by using sets of parallel trusses 110, the resultant force from each set thereof acts along its generator line 106, "pushing in" the vertices 103 of polygon 104. Consequently, for this type of force distribution, where the magnitude of the resultant forces H1 through H7 is approximately the same, the bending moments in the compression ring 130 are relatively small, even for the oval shaped compression ring 130 of the illustrative embodiment, and its design is controlled by axial forces. Advantageously, this unique characteristic of dome roof structure hereof results in economic designs for the compression ring 130, which is one of the most expensive items in this type of roof structure.

ROOF STRUCTURE EMBODIMENT OF THE PRESENT INVENTION WITH RETRACTABLE PANEL SECTIONS

Figure 16A:
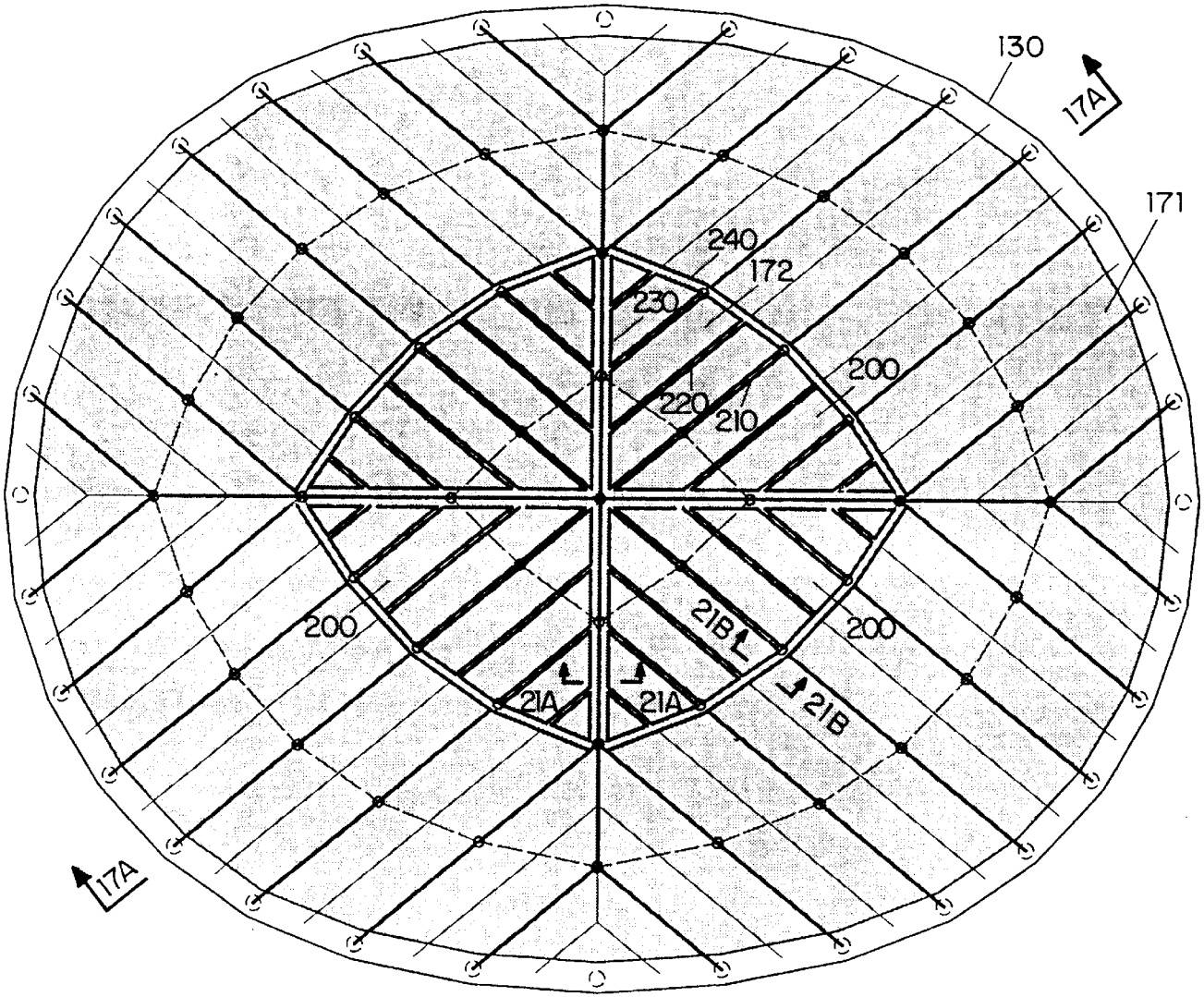
FIG. 16A is a plan view of a roof structure according to a second embodiment of the present invention, having retractable membrane sections, shown in their closed position.
Figure 16B:
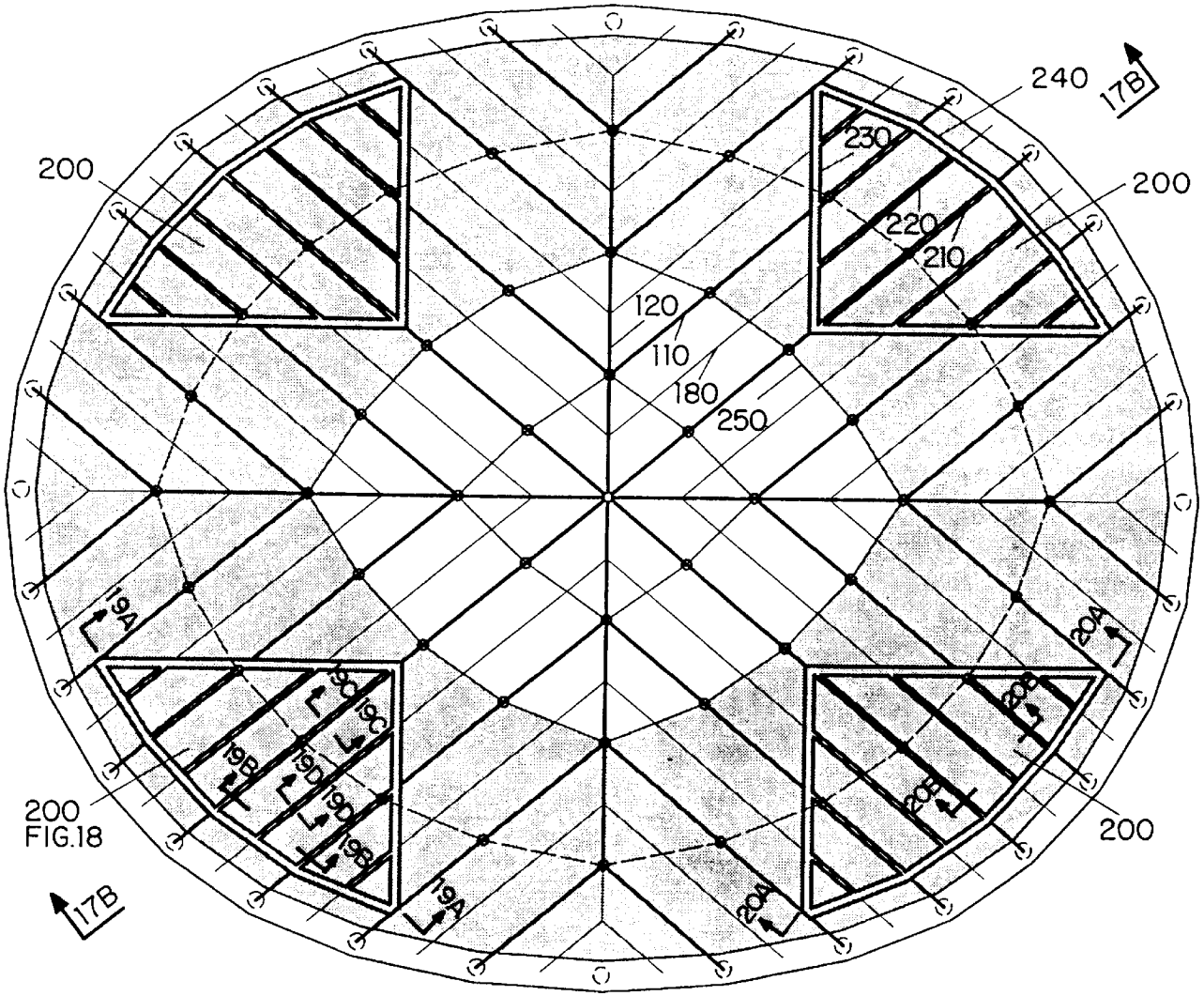
FIG. 16B is a plan view of the roof structure in FIG. 16A, shown with the retractable membrane sections in their open position.
Figure 17A:
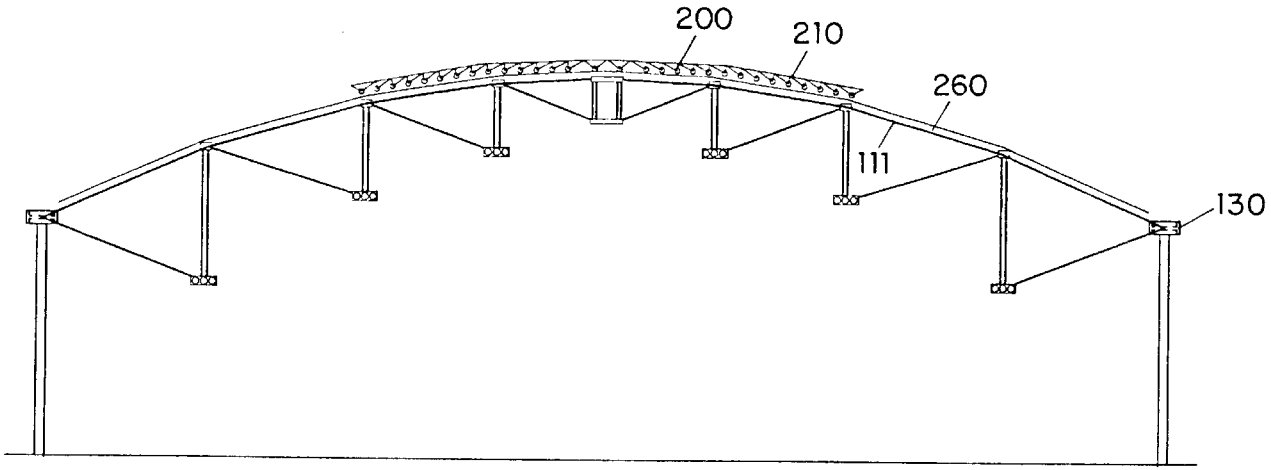
FIG. 17A is a cross-sectional view of the roof structure of the second embodiment, taken along line 17A—17A in FIG. 16A, showing the retractable membrane sections in its closed position.
Figure 17B:
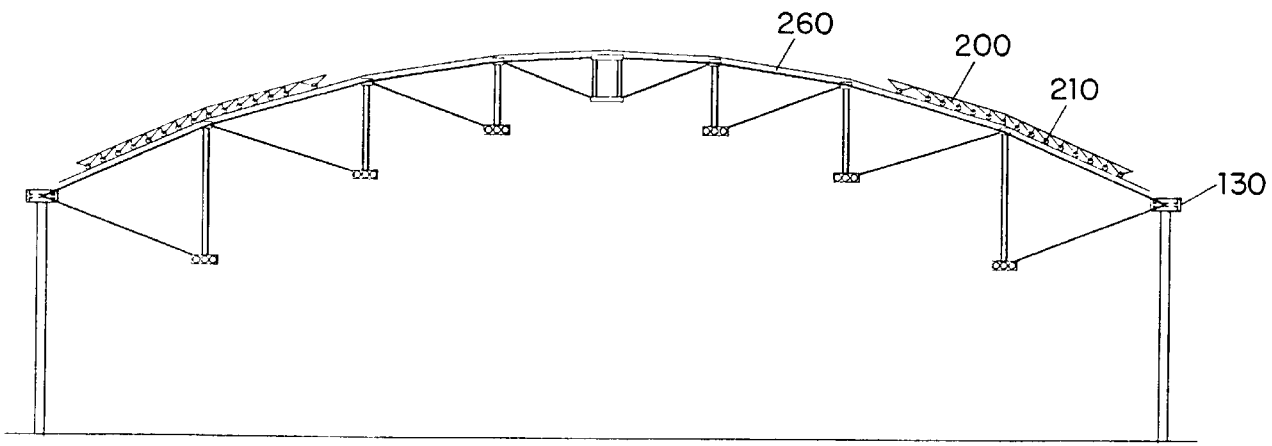
FIG. 17B is a cross-sectional view of the roof structure of the second embodiment of the present invention, taken along line 17B—17B in FIG. 16B, showing the roof in its open position.
Figure 17C:
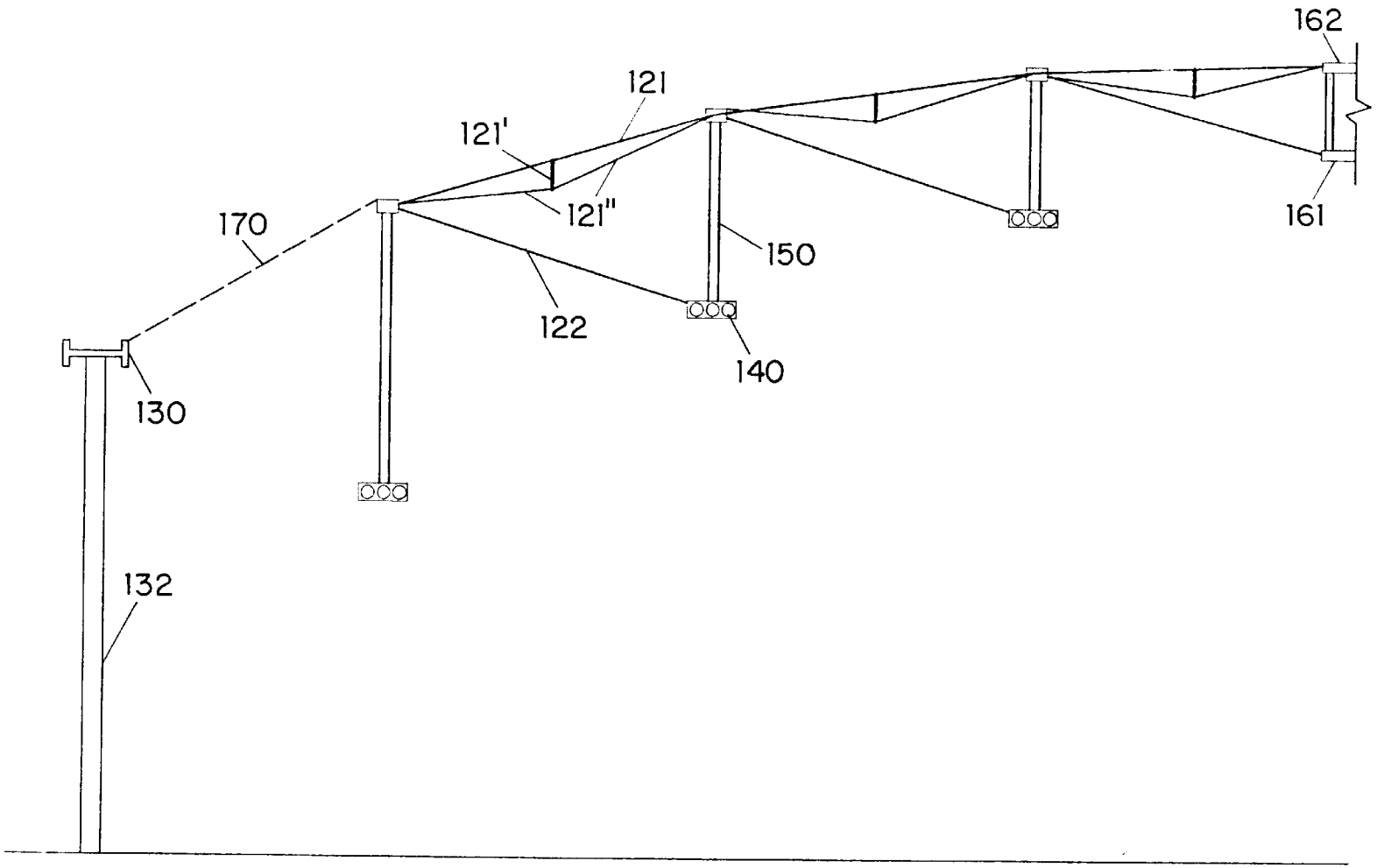
FIG. 17C is a cross-sectional view of the roof structure of the second embodiment of the present invention, showing the details of the roof structure.

It is also possible to incorporate, easily and economically, a set of retractable sections 100 into the dome roof structure 100 of the present invention. FIG. 16A shows a plan view of roof structure 100 with retractable sections 200 in their closed position. FIG. 16B provides the same plan view, but retractable sections 200 are shown in their open position. FIGS. 17A and 17B provide cross-sectional views of the roof structure 100 in its closed and open positions, respectively. In the retractable roof panel embodiment of the present invention, the roof structure has both fixed membrane panels 171 and retractable membrane panels 172. In FIGS. 16A and 16B, the fixed membrane panels 171 and retractable membrane panel 172 have been shaded in order to differentiate more clearly between closed (shaded) roof areas and open (unshaded) roof areas. As shown, fixed panels 171 are placed between top chord tension members III of the parallel trusses 110, beyond the retractable sections 200, either from an edge tension member 250 or from the top chord tension member 121 of the collector trusses 120 to the compression ring 130. A membrane stiffener tension member 180 is placed over each fixed panel 171 either from the edge tension member 250 or from the top chord tension member 1212 of the collector trusses 120 to the compression ring 130, between the two top chord tension members 111 of the parallel trusses 110 that bound the panel 171. A set of membrane sections 172 that ride on the top chord tension members 111 of the parallel trusses 110 can be retracted in order to open the central area of the roof structure 100, leaving the parallel trusses 100 and the collector trusses 120 exposed without any membrane cover.

Figure 18:
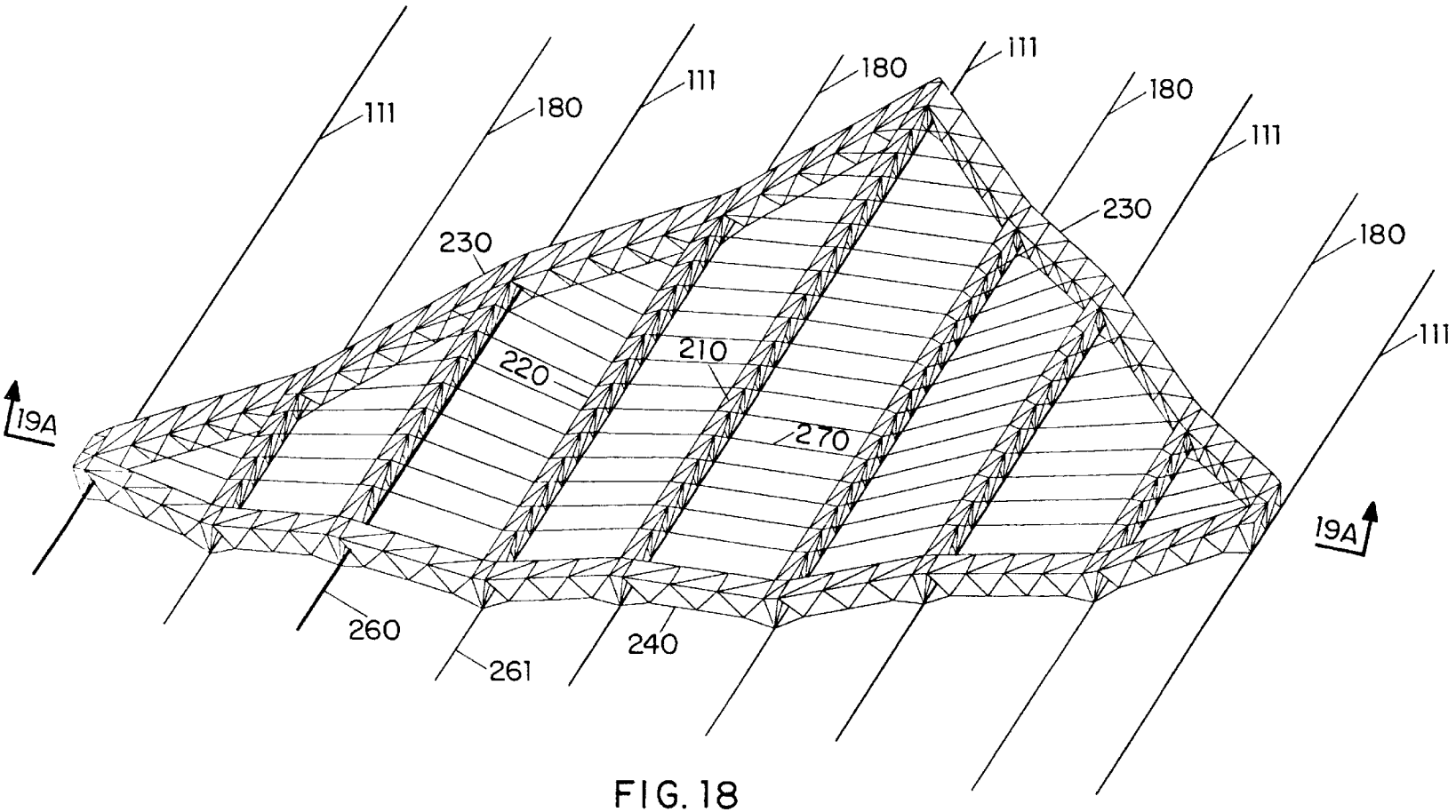
FIG. 18 is an isometric view of one of the retractable sections employed in the roof structure of the second embodiment of the present invention.

FIG. 18 provides an isometric view of one of the retractable sections 200. As shown, each retractable membrane section 200 rides on a different set of parallel trusses 110. In each retractable membrane section 200, the membrane panels 172 are attached to a set of light space trusses 210. Membrane stiffener tension members 180 are also connected to the retractable panels 172 by means of light space trusses 220 that are suspended from the light space trusses 210 by means of tension members 270. Additional side edge space trusses 230 and lower edge space trusses 240 are provided around the perimeter of each retractable section 200. Space trusses 210 and 220 are horizontally rigid to withstand the forces imposed by the membrane, but vertically flexible in order to accommodate the geometry of the top chord tension members 111 of the parallel trusses 110 when the retractable sections 200 travel between their open and their closed positions. Edge space trusses 230 and 240 are rigid in both, horizontal and vertical directions. The lightweight space trusses 210 and 220 travel along flexible rails 260 and 261 that are attached to the top chord tension members 111 of the parallel trusses 110 and to the membrane stiffener tension members 180.

Figure 19A:
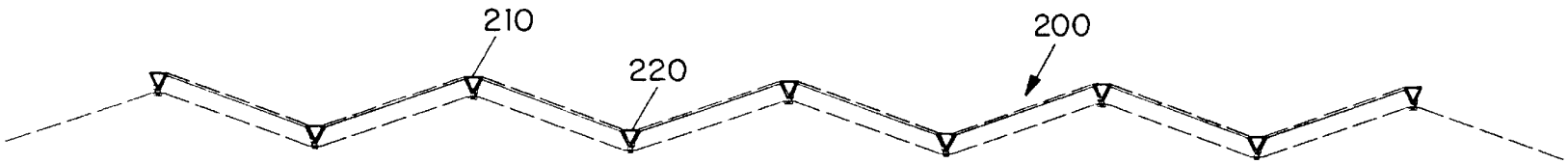
FIG. 19A is a cross-sectional view of one of the retractable sections, taken along line 19A—19A in FIG. 16B.
Figure 19B:
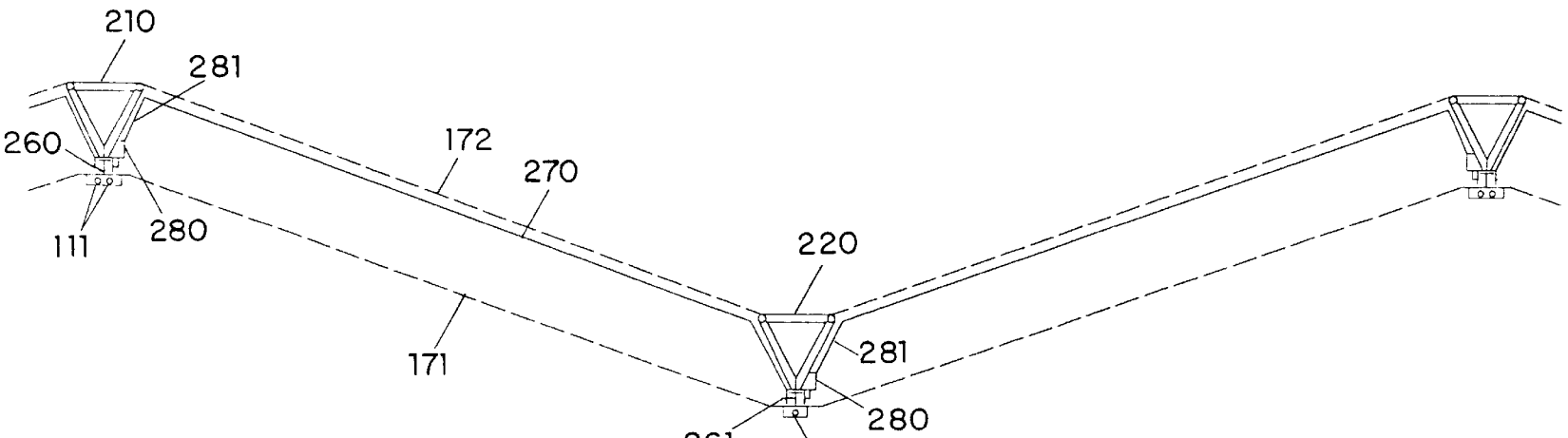
FIG. 19B is an enlarged view of a portion of the retractable section of FIG. 19A.

FIG. 19A provides a cross-sectional view of a retractable roof section 200 which can be used to realize retractable roof structure of the present invention. As shown, each retractable section comprises a number of V-shaped panels arranged upon a plurality of space trusses 210 and 220. FIG. 19B shows greater detail of a portion of the retractable section of FIG. 19A. As shown, motors 280 are mounted to each of the space trusses 210 and 220. The function of motors 280 are to move each retractable section 200 between its closed and open positions in response to electrical power signals supplied to the motors 280 by a power supply operated under the control of a central control computer 400 system strategically located within the building. In order to provide electrical power to motors 280, only one of the top chord tension members III needs to be an electrical conductor, since distribution cables 270 can provide electrical energy to motors 280 located on other top chord members 111 and on the membrane tension members 180.

Figure 19C:
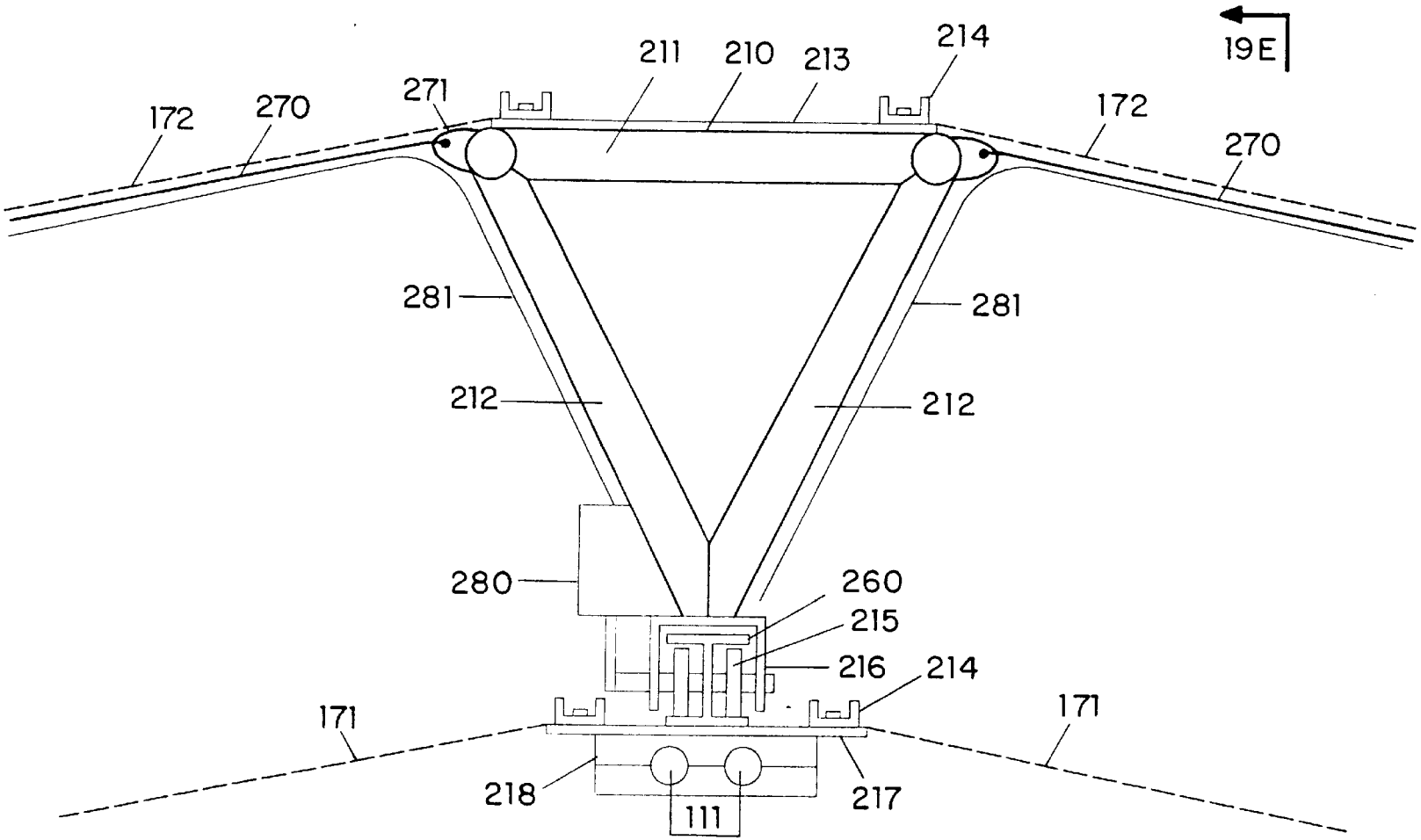
FIG. 19C is an enlarged view of a section of the space trusses of FIG. 19B, disposed on the top chord tension members of the parallel trusses.
Figure 19D:
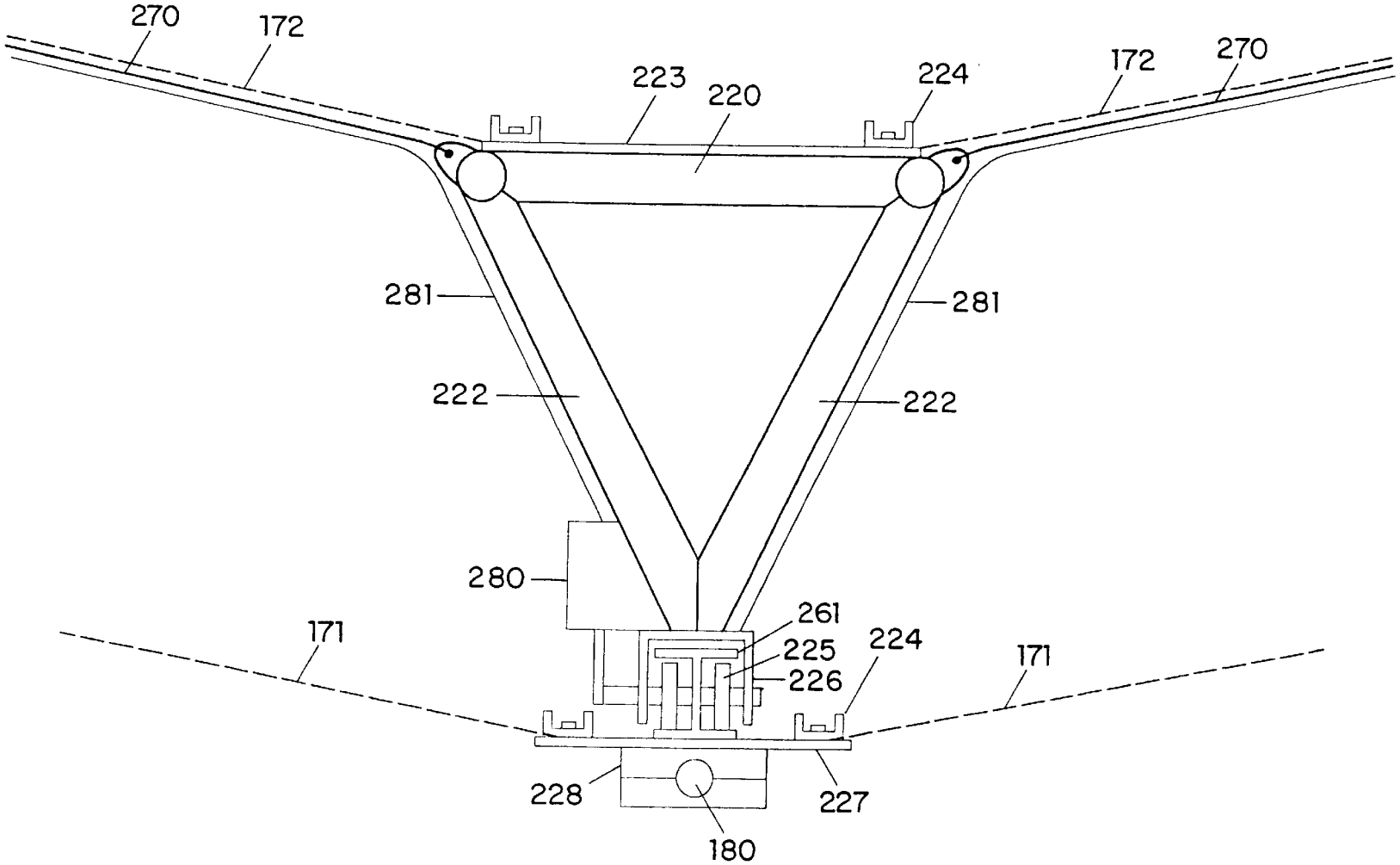
FIG. 19D is an enlarged view of section of the space trusses of FIG. 19B disposed on the membrane stiffener tension member.
Figure 19E:
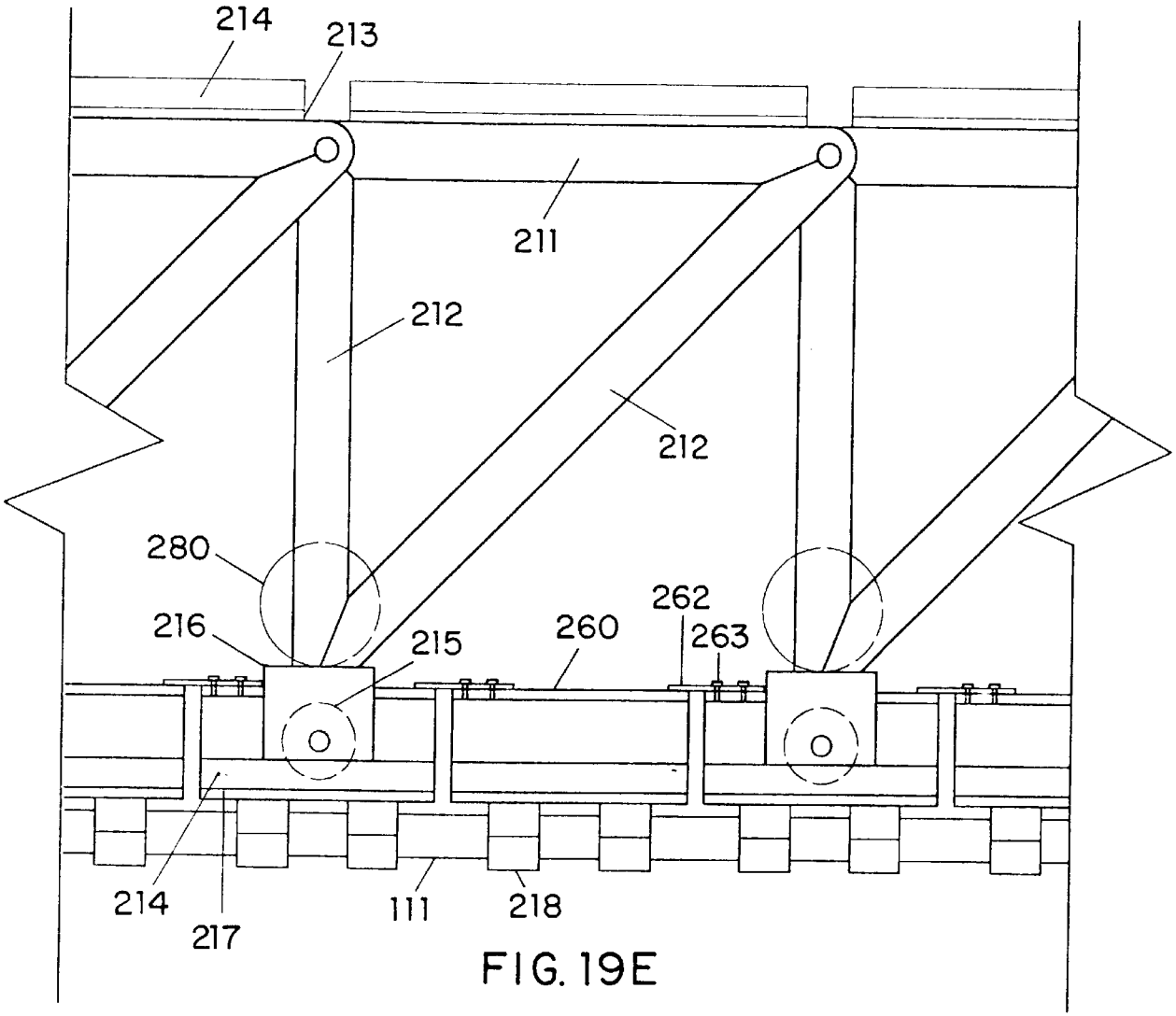
FIG. 19E is an elevated side view of the space trusses, taken along line 19E—19E in FIGS. 19C and 19D.

Details regarding space trusses 210 and 220 are presented in FIGS. 19C through 19E. As shown in FIG. 19C, space truss 210 is constructed from a plane top truss 211 and two plane side trusses 212. Retractable membrane panels 172 are attached to plates 213, secured to top truss 211, by means of clamping elements 214. Trusses 210 can ride along the top chord tension member 111 of the parallel trusses 110 on wheels 215 that are secured by plates 216. Wheels 215 travel on a rail 260 that is attached to plates 217. Clamping elements 218 connect plates 217 to the top chord tension members 111. Fixed membrane panels 171 are clamped to plates 217 by elements 214. Similarly, as FIG. 19D indicates, space truss 200 is made of a plane top truss 221, and to plane side trusses 222. Retractable membrane panels 172 are attached to plates 223, secured to top truss 221, by means of clamping elements 224. Trusses 220 can ride along membrane stiffener tension member 180 on wheels 225 that are secured by plates 226. Wheels 225 travel on a rail 261 that is attached to plates 227. Clamping elements 228 connect plates 227 to the membrane stiffener tension member 180.

As shown in FIG. 19C, fixed membrane panels 171 are clamped to plates 227 by elements 224. Space trusses 220 are suspender from space trusses 210 by means of tension elements 270 and attachment plates 271. Both, space trusses 210 and 220, are flexible enough to accommodate the changing geometry of the to chord tension members 111 and the membrane stiffener tension members 180 as retractable sections 200 are in motion. This flexible behavior the space trusses can be accomplished using the design shown in FIG. 19E. Space trusses 220 are detailed in a similar manner. FIG. 19E shows that the plane side trusses 212 do not have a bottom chord and are provided with hinges 219 in order to allow relative rotations. Rails 260 are made of a series of segments 261 flexibly linked by plates 262 and bolts 263 allowing relative rotations between segments.

Figure 20A:
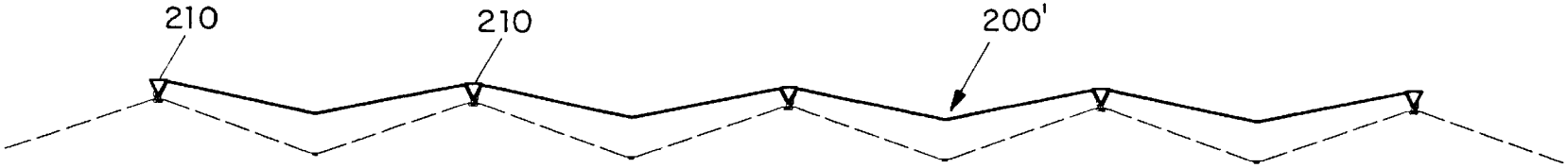
FIG. 20A is a cross-sectional view of a first alternative embodiment of the retractable membrane sections, also taken along line 19A—19A in FIG. 16B.
Figure 20B:
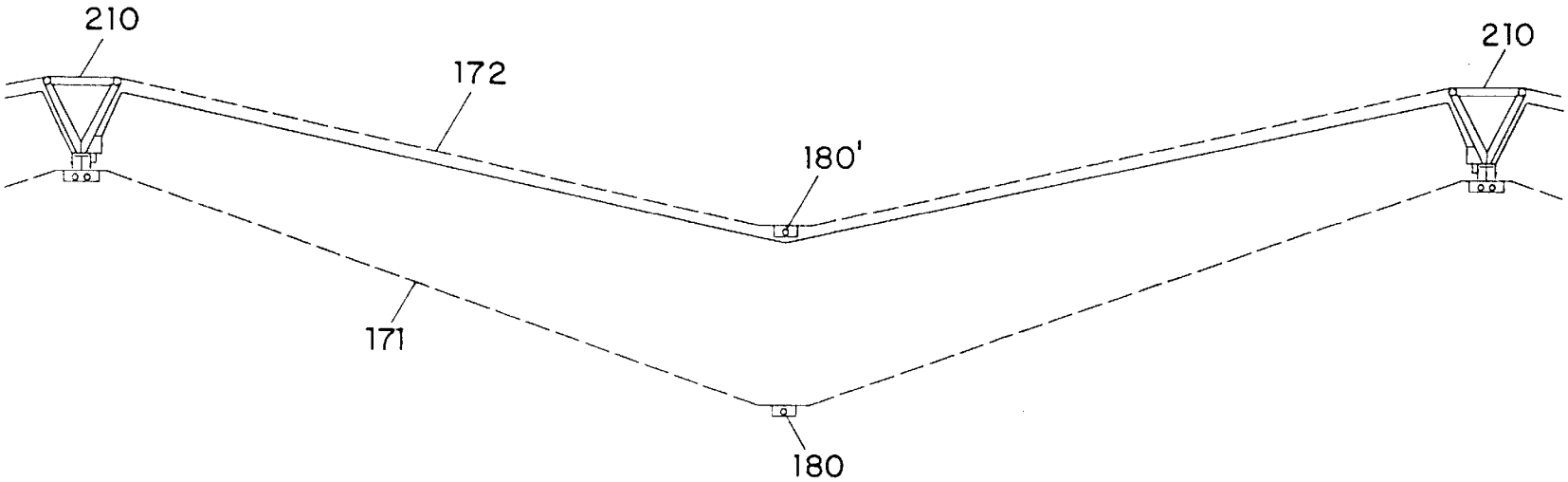
FIG. 20B is an enlarged view of a portion of the retractable membrane section shown in FIG. 20A.

FIGS. 20A and 20B show a second illustrative embodiment of a retractable roof section 200' which also can be used to realize the retractable roof structure of the present invention. This embodiment is based on the same general idea of attaching retractable membrane panels to an assembly of lightweight space trusses which ride on the top chord tension members 111 of the parallel trusses 110. FIG. 20A provides a cross-sectional view of retractable section 200' illustrating that the arrangement of the space trusses 210 is the same as in FIG. 19A, but without requiring space trusses 220 and tension elements 270. FIG. 20B provides an enlarged view of a portion of retractable section 200' shown in FIG. 20A revealing more structural and functional detail. Also, retractable panels 172 have their own membrane stiffener tension number 180' which spans between space trusses 230 and 240, as shown.

Figure 20C:
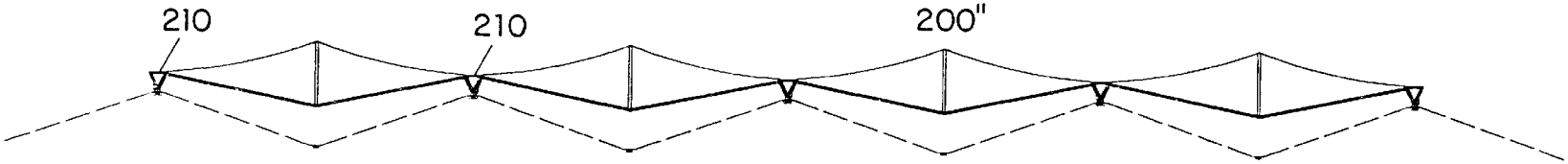
FIG. 20C is a cross-sectional view of a second alternative embodiment of the retractable membrane sections, also taken along line 19C—19C in FIG. 16B.
Figure 20D:
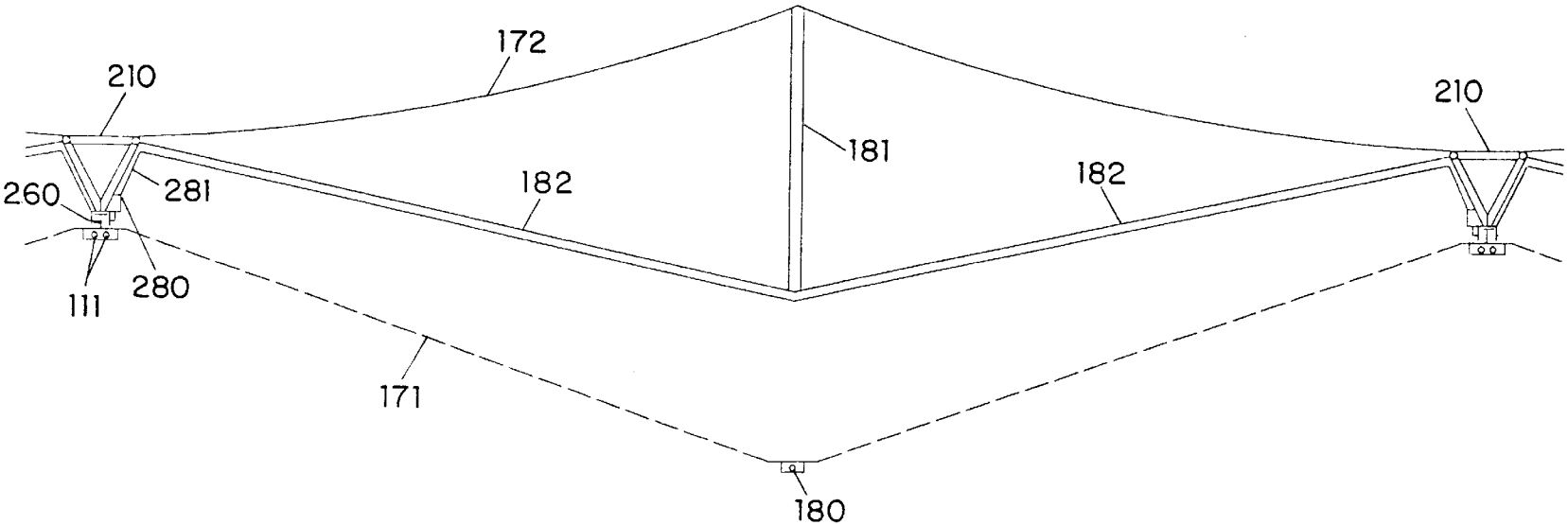
FIG. 20D is an enlarged view of a portion of the retractable membrane section shown in FIG. 20C.

FIGS. 20C and 20D show a third illustrative embodiment of retractable roof section 200', which also can be used to realize the retractable roof structure of the present invention. In this alternative embodiment, tension in the membrane panels 172 is introduced by a series of poles 181 that are supported at their lower end by tension members 182, secured to space trusses 210.

Figure 20E:
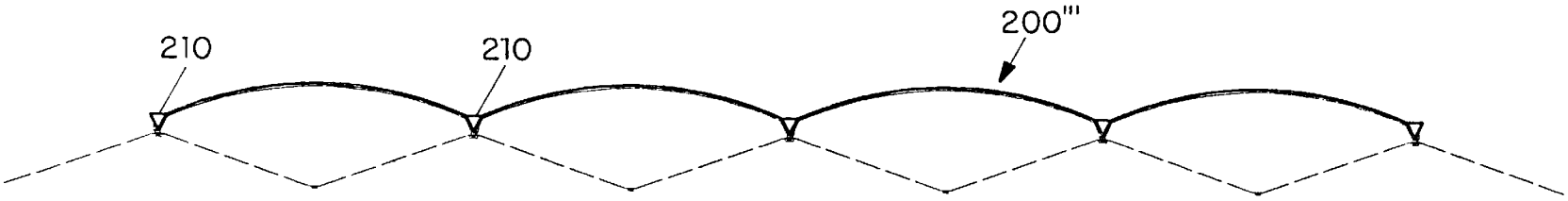
FIG. 20E is a cross-sectional view of a third alternative embodiment of the retractable membrane sections, also taken along line 19E—19E in FIG. 16B.
Figure 20F:
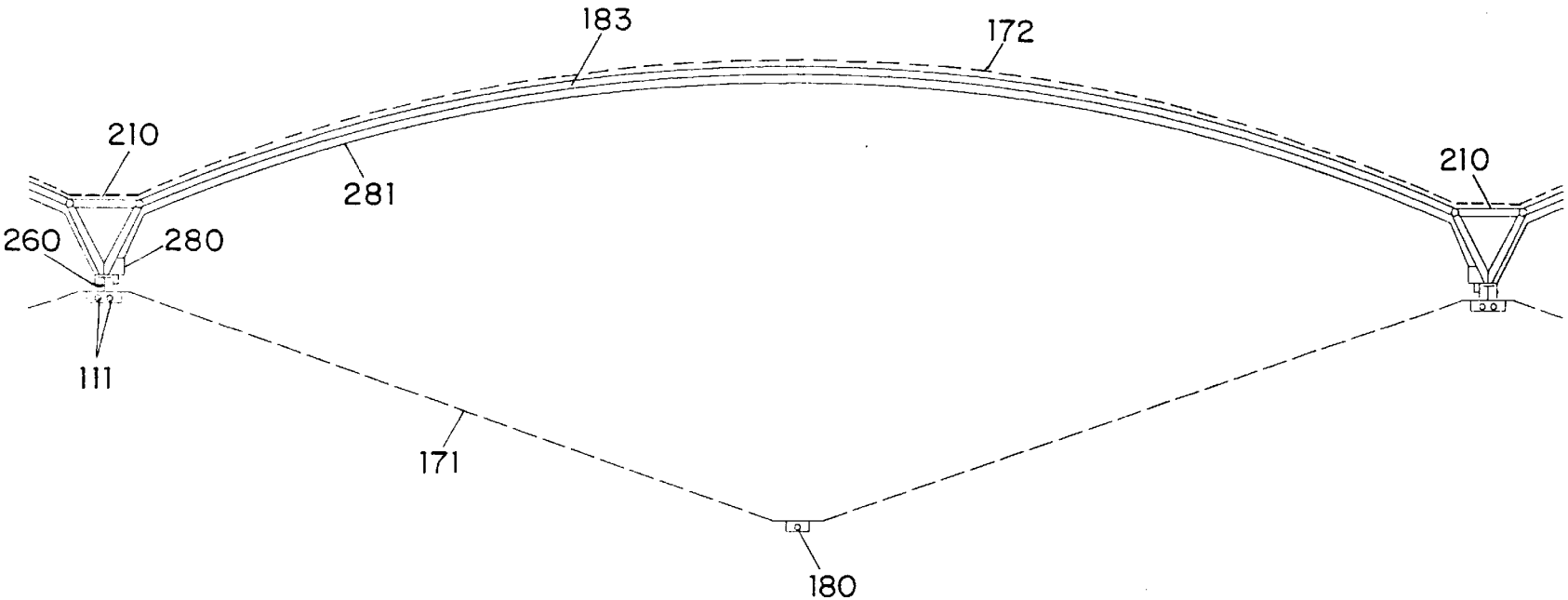
FIG. 20F is an enlarged view of a portion of retractable membrane section shown in FIG. 20E.

FIGS. 20E and 20F shows a fourth illustrative embodiment of retractable roof section 200''', which also can be used to realize the retractable roof structure of the present invention. In this alternative embodiment, tension in the membrane panels 172 is created by a set of arches 183 that span between space trusses 210 in order to provide support to the membranes 172.

Figure 20G:
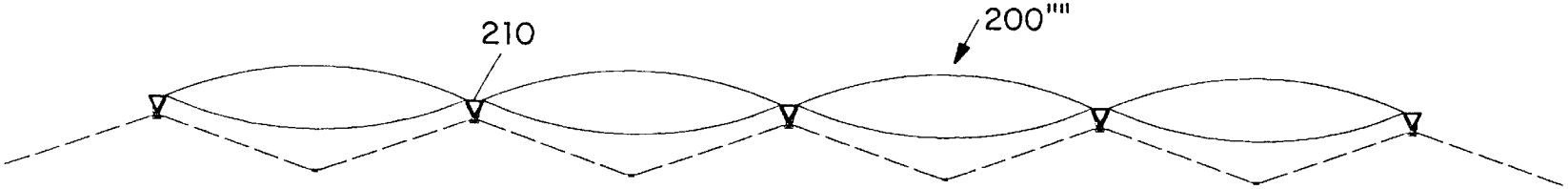
FIG. 20G is a cross-sectional view of a fourth alternative embodiment of the retractable membrane sections, also taken along line 19G—19G in FIG. 16B.
Figure 20H:
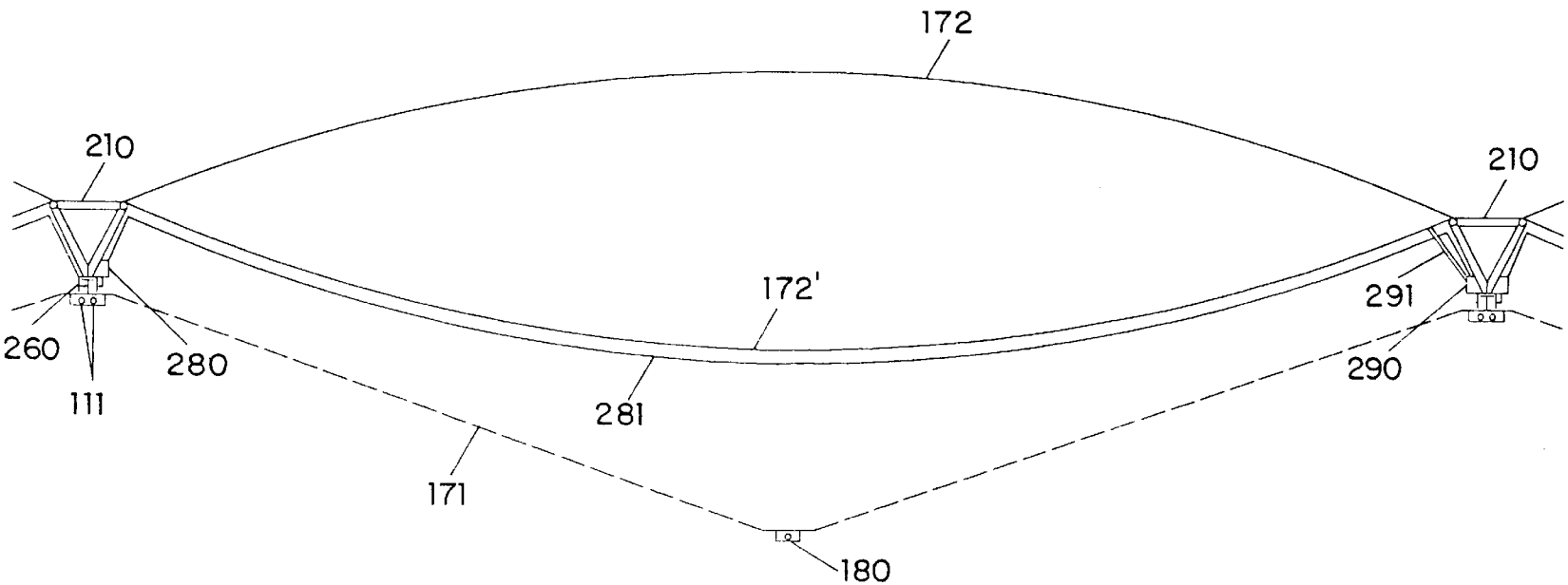
FIG. 20H is an enlarged view of a portion of retractable membrane section shown in FIG. 20G.

FIGS. 20G and 20H show a fifth illustrative embodiment of retractable roof section 200'''', which also can be used to realize the retractable roof structure of the present invention. In this illustrative embodiment, tension in the membrane panels 172 is introduced by an inflatable cushion disposed between flexible membranes 172 and 172' bounded by adjacent space. As shown, an air pump 290 and hose 191 are used to inflate the cushion panels. Preferably, all cushion panels in each retractable section 200'''' may be connected to a single air pump, simplifying the construction of the retractable roof structure.

The advantages of the above-described alternative embodiments is that they do not require a constant membrane slope from the top chord tension members 111 towards the membrane stiffener tension members 180 in the membrane. Thus, there is no need to use posts 121' and tension members 121" in order to connect the membrane stiffener tension members 180 to the top chord tension members 121 of the collector trusses 120.

Figure 21A:
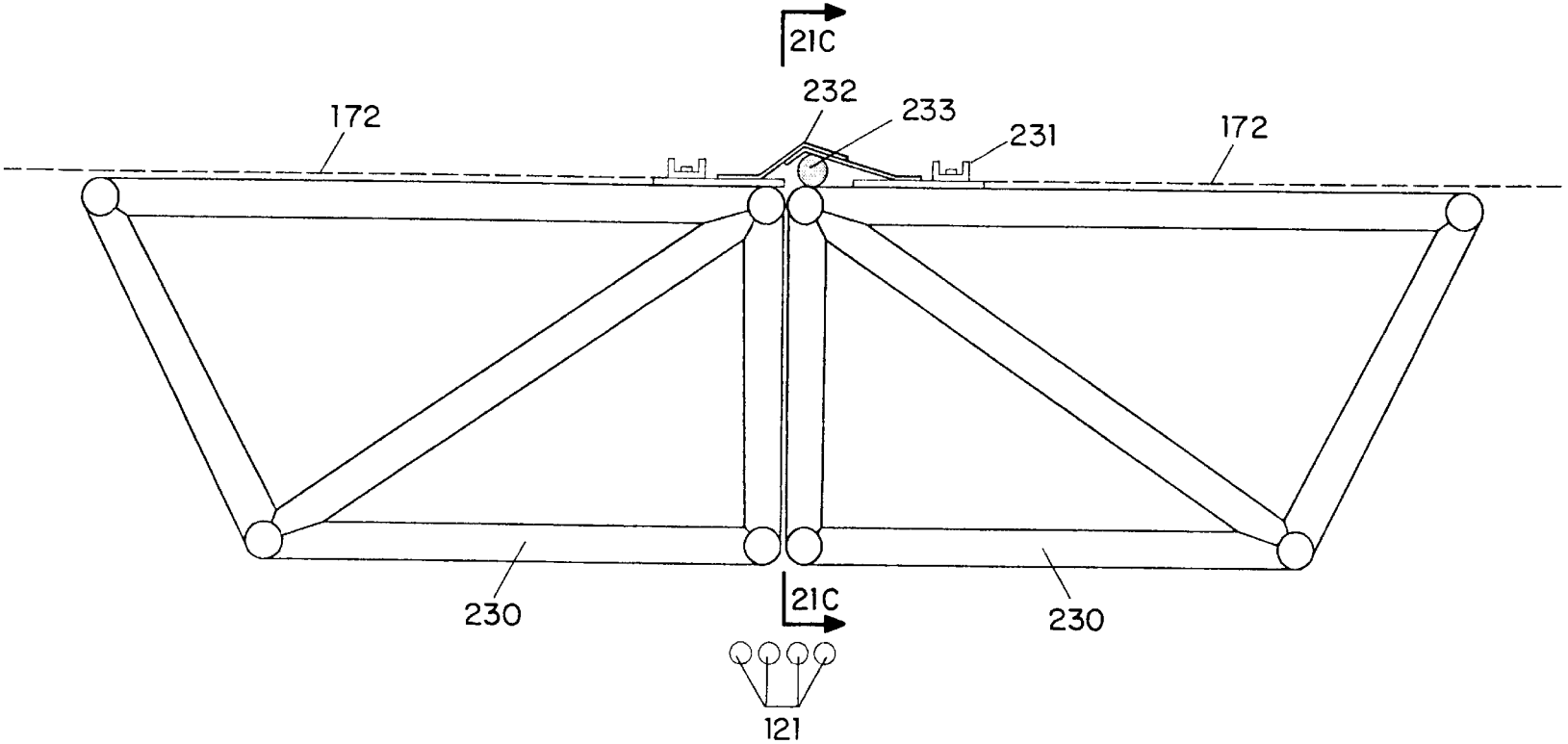
FIG. 21A is a cross-sectional view of a retractable membrane section, taken along line 21A—21A in FIG. 16A, showing the edge space trusses at the interface between two retractable roof sections in their closed position.
Figure 21B:
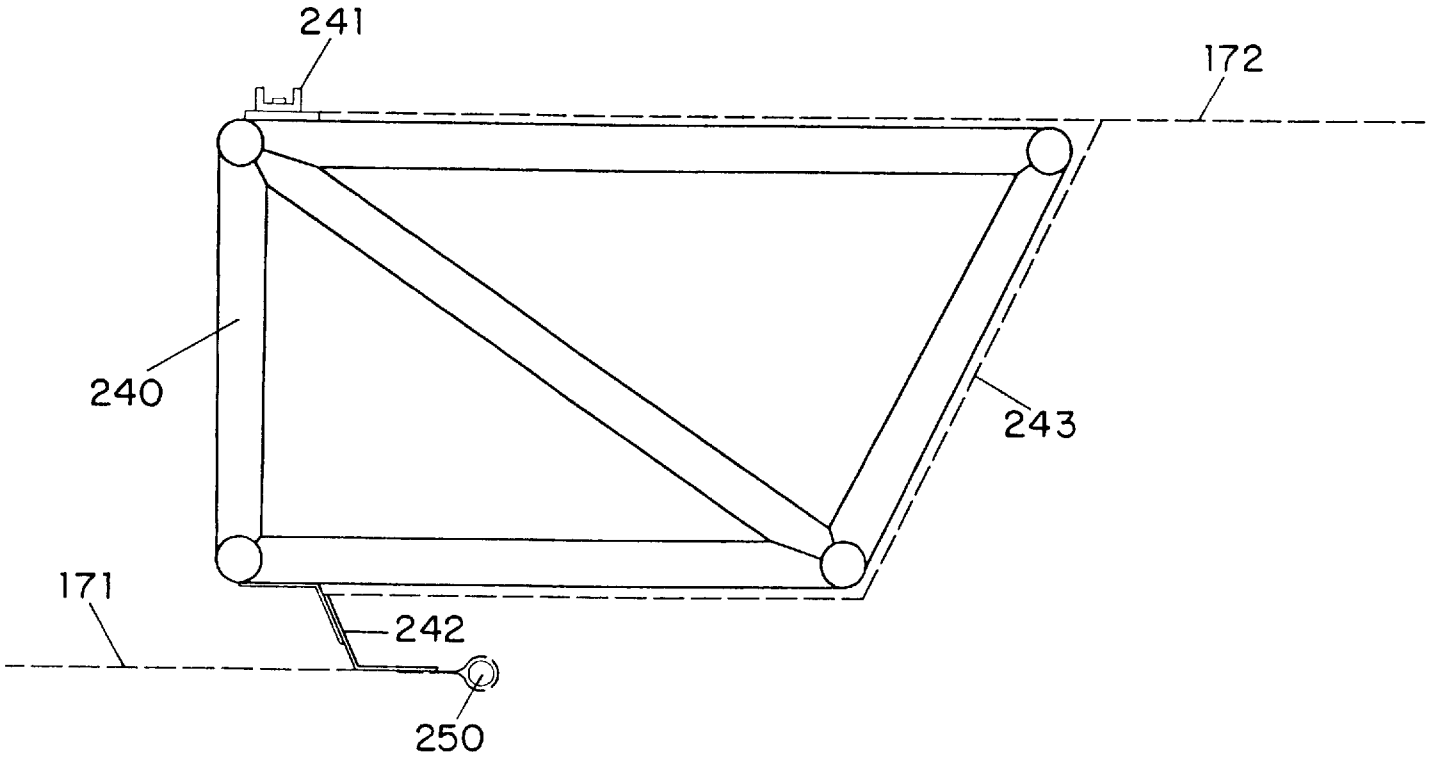
FIG. 21B is a cross-sectional view of a retractable membrane section, taken along line 21B—21B in FIG. 16A, showing one of the edge space trusses at the interface between a retractable section and the fixed part of the roof.
Figure 21C:
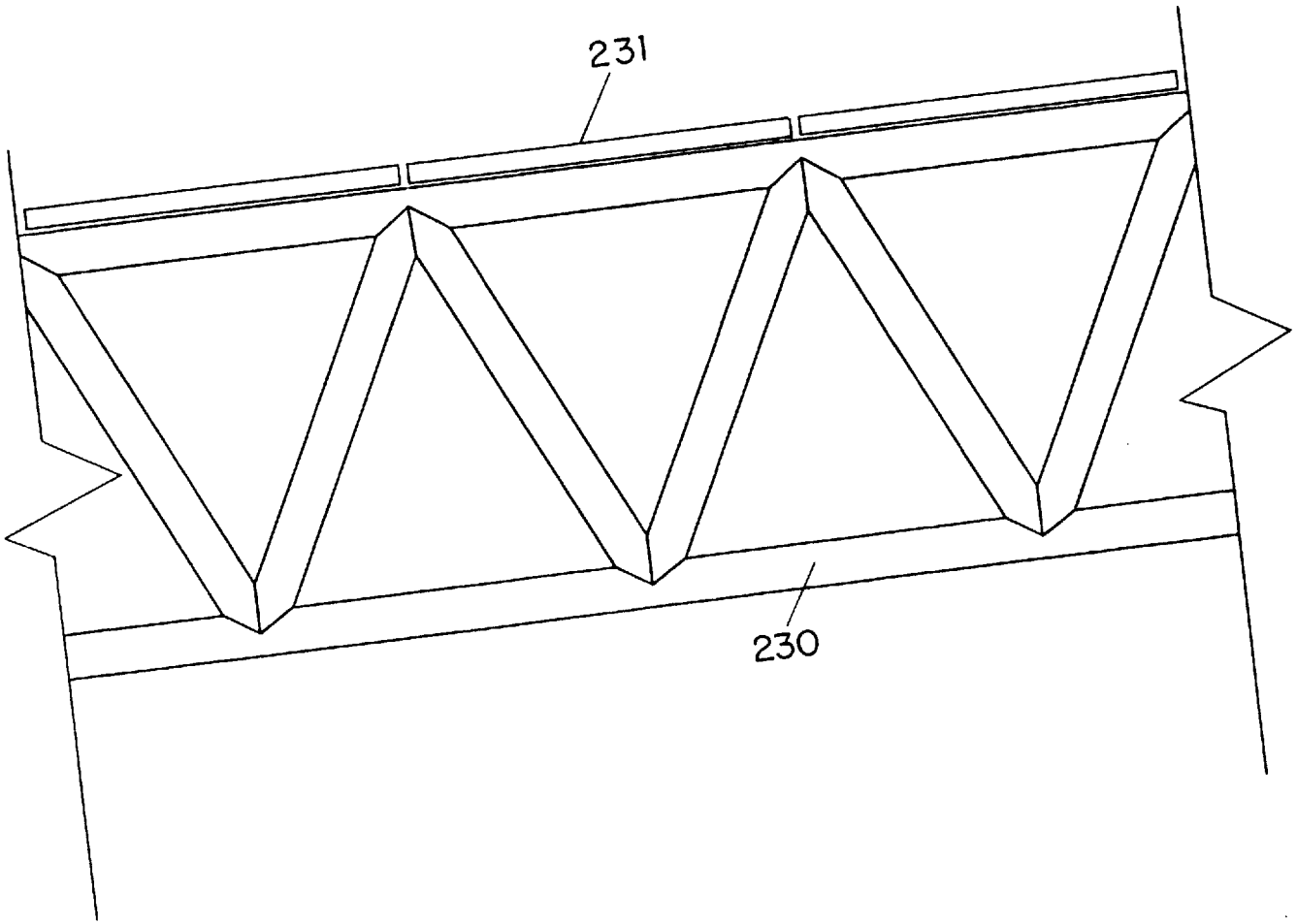
FIG. 21C is an elevated view of the edge space trusses, taken along line 21C—21C in FIG. 21A.

Whether the V-shaped retractable panel or the cushion panels are used to construct the retractable roof structure of the present invention, edge space trusses 230 and 240 are required. FIG. 21A provides a cross-sectional view of side edge space trusses 230, at the interface between two retractable roof sections 200 disposed in their closed position. The retractable membrane panels 172 are attached to the top chord by means of clamping elements 231. Flexible covers 232 and a pneumatic seal 233 are installed to ensure that unwanted elements, such as dirt, dust, rain, etc., are kept outside the roof structure. FIG. 24B provides a similar cross-sectional view at the lower edge space truss 240, as illustrated in FIG. 21B, where the interface between the retractable roof sections 200 and the fixed roof is shown in the closed roof position. The retractable membrane panels 172 are attached to the top chord by means of clamping elements 241. Flexible covers 242 are also provided. Both space trusses 230 and 240 are rigid in both the horizontal and vertical directions. FIG. 21C provides an elevational view of the space trusses 230. Space trusses 240 are detailed in a similar manner.

Figure 22A:
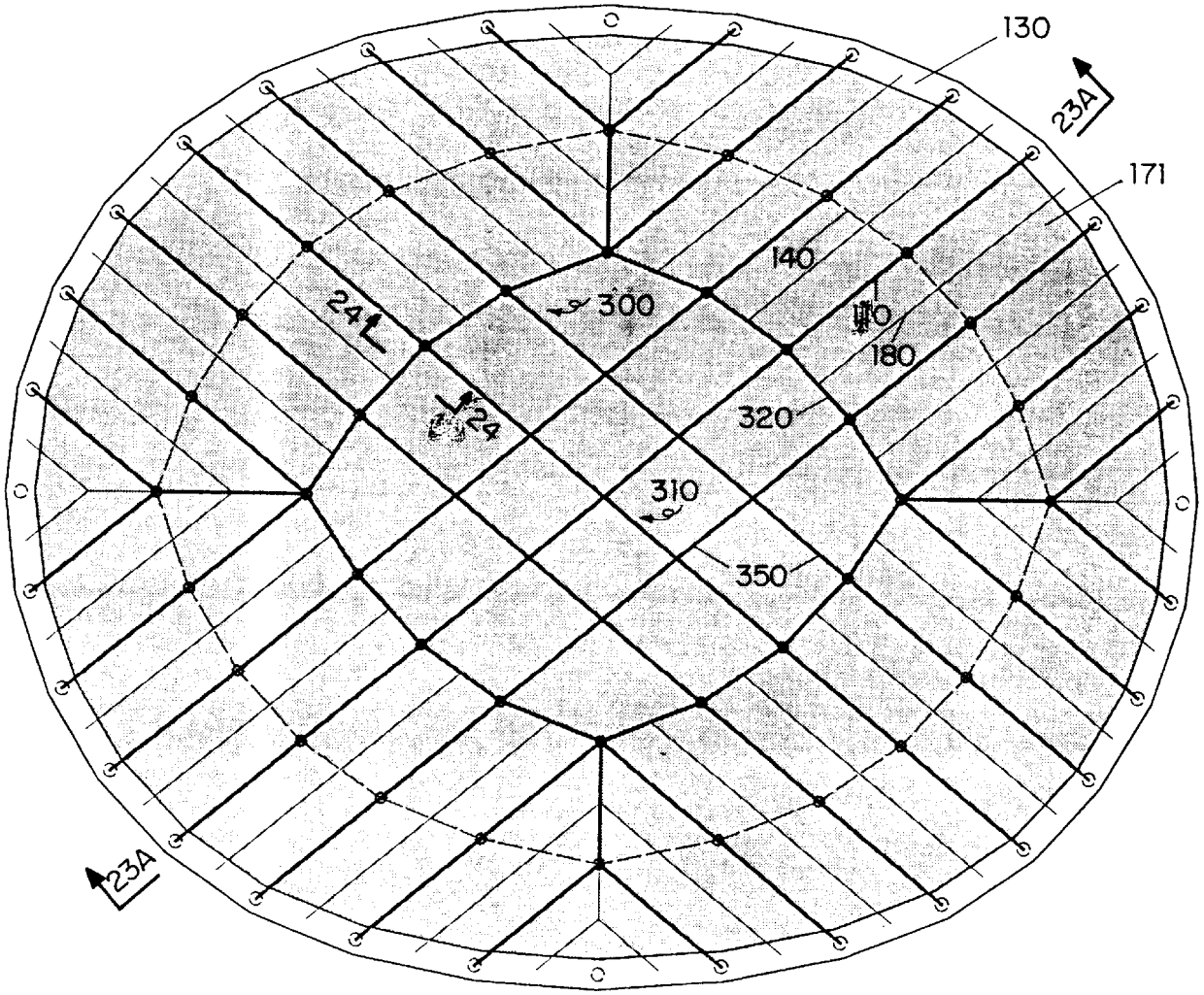
FIG. 22A is a plan view of another embodiment of the retractable roof structure of the present invention, showing its retractable membrane section moved to its closed position.

FIGS. 22A through 26A illustrate another way of incorporating a retractable roof covering section into the dome roof structure of the present invention. In this alternative embodiment, an inflated retractable section 300 is employed. FIG. 22A provides a plan view of dome roof structure of this alternative embodiment of the present invention, shown with retractable section 300 disposed in its closed position. FIGS. 22B and 22C provide plan views of retractable section 300 shown in its open position. FIG. 23A shows a cross-sectional view of the dome roof structure disposed in its closed position. FIGS. 23B and 23C show cross-sectional view of a roof structure disposed in its open position.

Figure 22B:
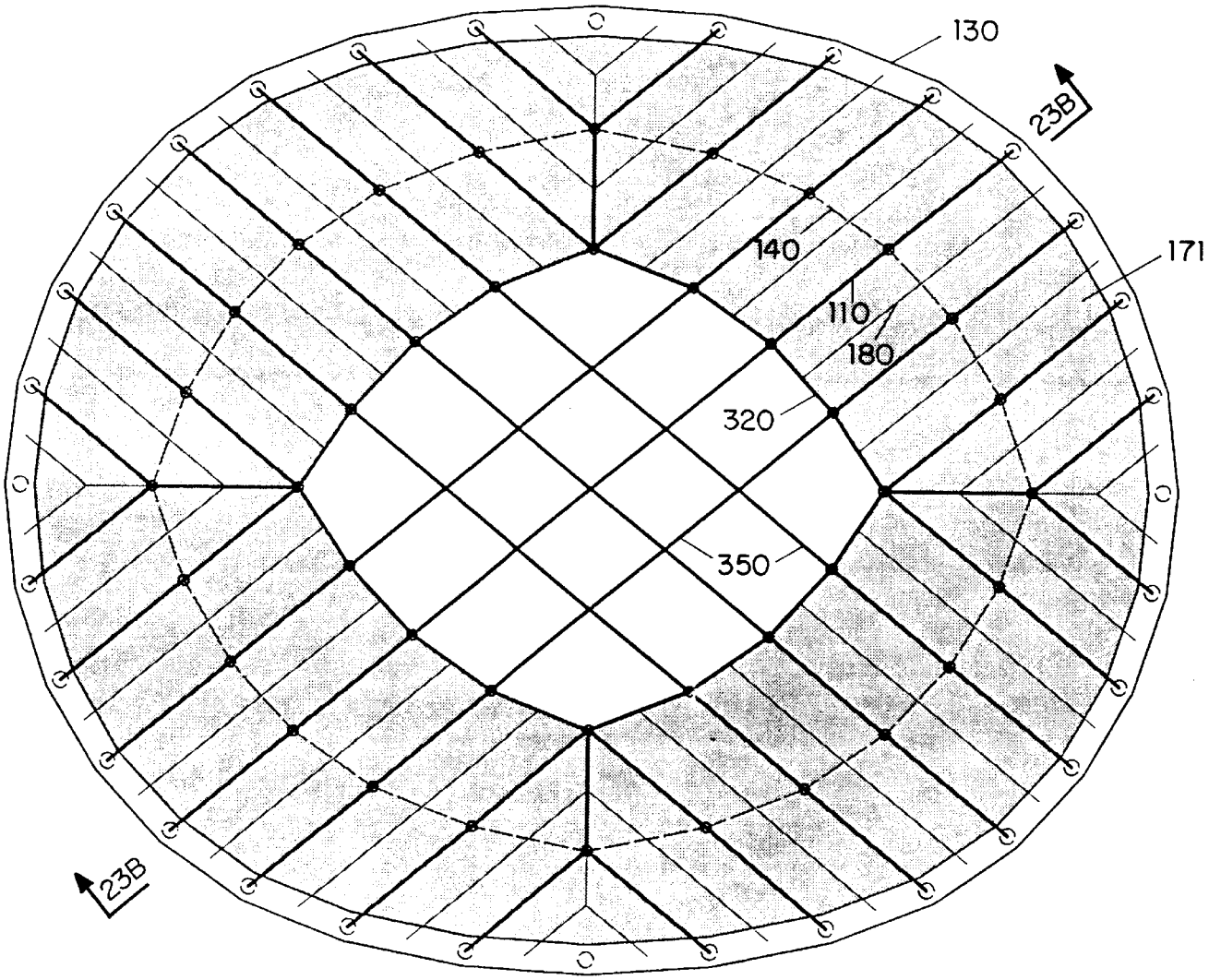
FIG. 22B is a plan view of the retractable roof structure of FIG. 22A, showing its retractable section moved to its open position.
Figure 22C:
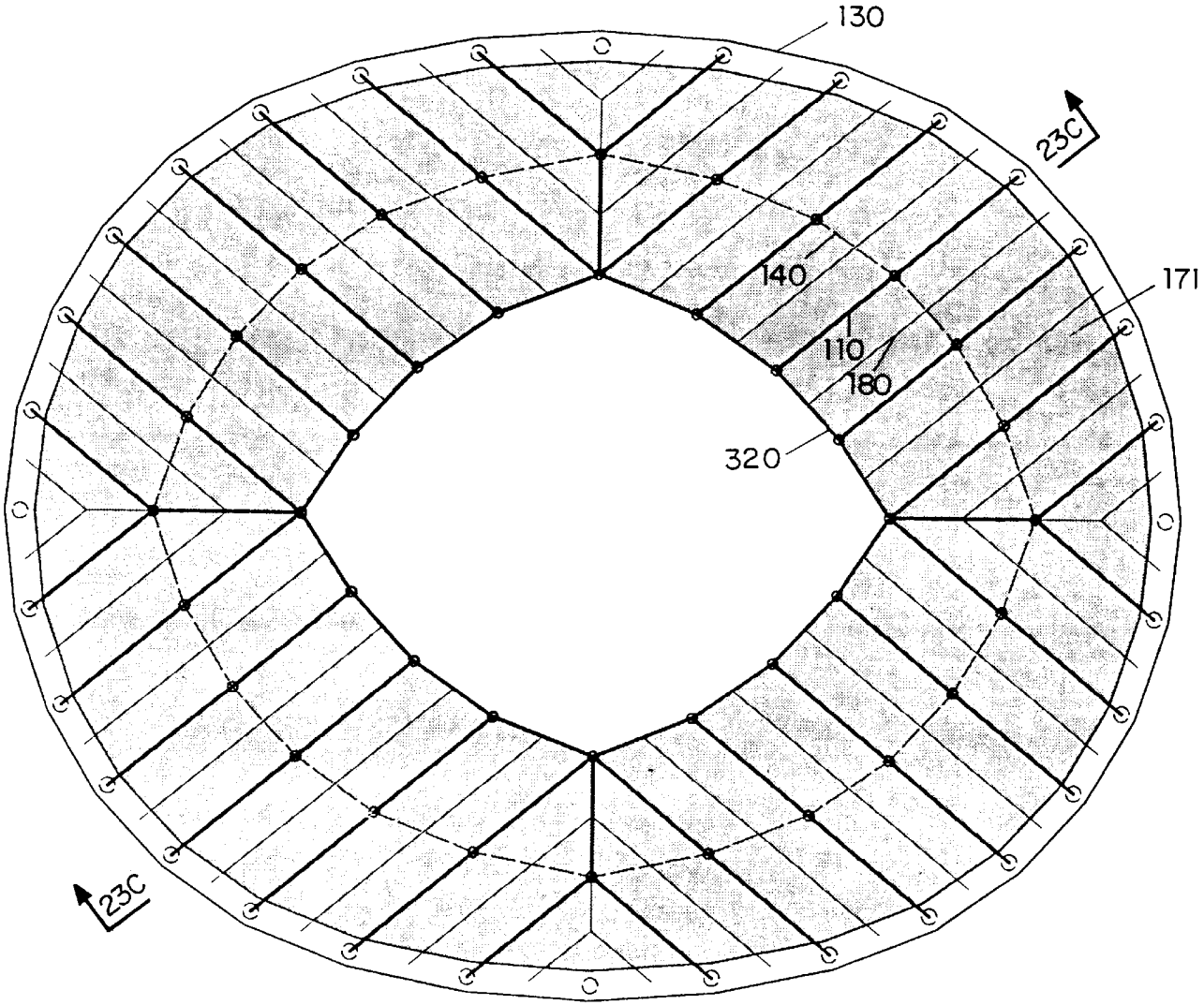
FIG. 22C is a plan view of the retractable roof structure of FIG. 22A, showing its retractable section in an open position.
Figure 23A:
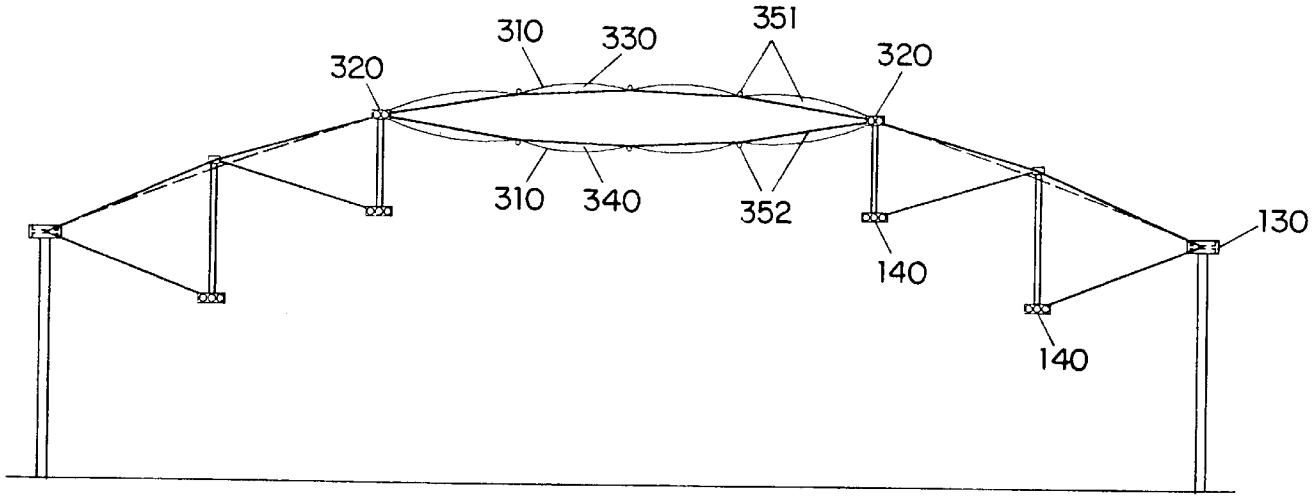
FIG. 23A is a cross-sectional view of the retractable roof structure of FIG. 22A, taken along at line 23A—23A in FIG. 22A, showing the roof in its closed position.
Figure 23B:
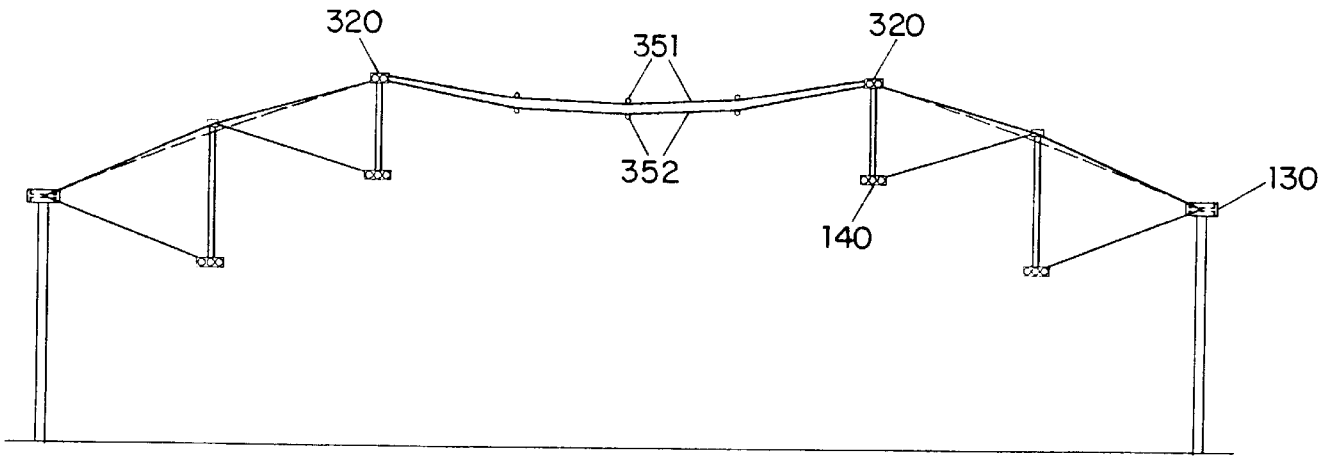
FIG. 23B is a cross-sectional view of the retractable roof structure of FIG. 22A, taken along line 23B—23B in FIG. 22B.
Figure 23C:
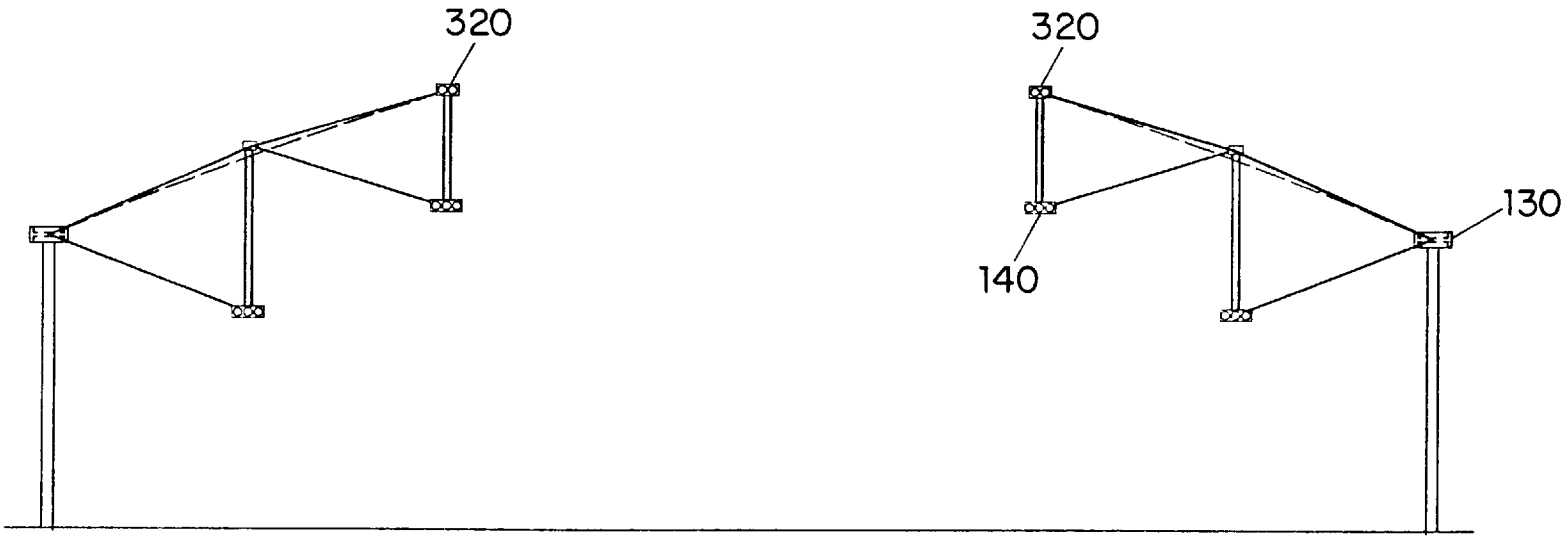
FIG. 23C is a cross-sectional view of the retractable roof structure of FIG. 22A, taken along line 23C—23C in FIG. 22C, showing its roof in an alternate open position.

As shown in these drawings, fixed membrane panels 171 and retractable membrane panels 310 have been shaded in order to differentiate more clearly between closed (shaded) roof areas and open (unshaded) roof areas. Fixed panels 171 are placed between top chord tension members 111 of the parallel trusses 110, beyond retractable section 300, either from an upper hoop-like tension member 320 or from the top chord tension member 121 of the collector trusses 120 to the compression ring 130. A membrane stiffener tension member 180 is placed over each fixed panel 171 either from the upper hoop-like tension member 320 or from the top chord tension member 1212 of the collector trusses 120 to the compression ring 130, between the two top chord tension members 111 of the parallel trusses 110 that bound the panel 171. The upper hoop-like tension member 320 is attached to the top of a set of compression members 150 at the boundary of the retractable section 300. This upper hoop-like tension member 320 is parallel in elevation to the hoop-like tension member 140 that is attached to the lower end of the same set of compression members 150. The retractable membrane section 300 is placed inside the upper hoop-like tension member 320. The retractable section 300 consists of an upper light membrane 330, a lower light membrane 340. Both upper and lower membranes 330 and 3340, respectively, are made of panels 310 and may be reinforced with cable nets 350. Upper membrane 330 and lower membrane 340 are joined together with air-tight zippers to create an air-tight cushion that can be inflated. When inflated, the retractable roof assembly 300 is self equilibrating, introducing tension in the upper and lower membranes 330 and 340, and it only has to be hanged from the top of the compression members 150 connected by the upper hoop-like tension member 320 in order to close the roof structure 100. To open the roof structure, the retractable cushion assembly 300 is deflated and the membrane panels 310 of the upper and lower membranes 330 and 340 are unzipped so that they can be lowered, folded and stored. This roof condition is indicated in FIGS. 22B and 23B, where the cable nets 350, upper cable net 351 and lower cable net 352, are left hanging. If the cable nets 350 are also lowered, then the dome roof structure 100 appears as shown in FIGS. 22C and 23C. Thus, when the retractable section 300 is not in place, temporarily or permanently, the roof structure has the appearance of a long span canopy.

Figure 24:
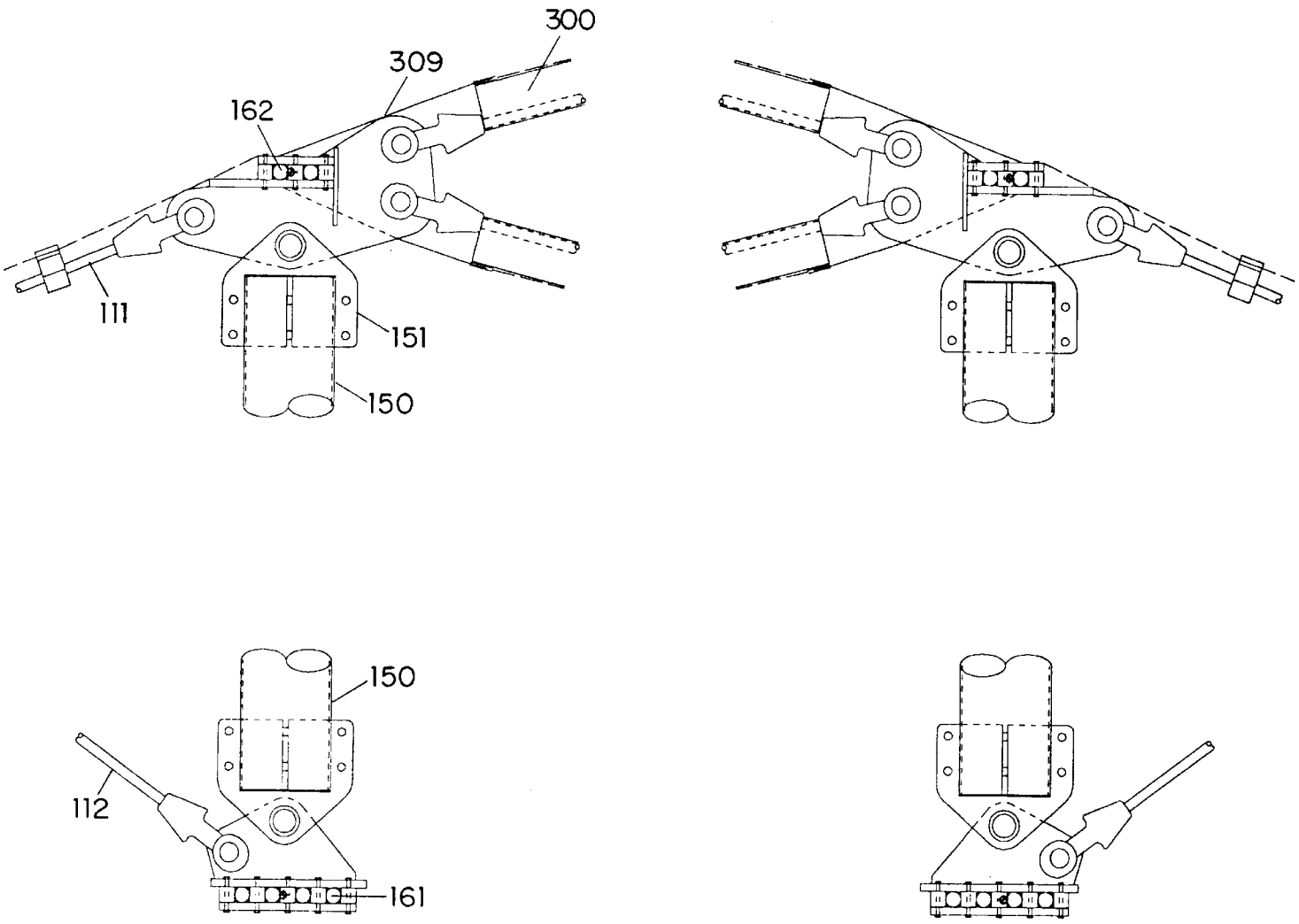
FIG. 24 is a cross-sectional view of the roof structure of FIG. 22A, taken along line 24—24 in FIG. 22A, showing the connection detail at the interface between the retractable section and the fixed roof.
Figure 24A:
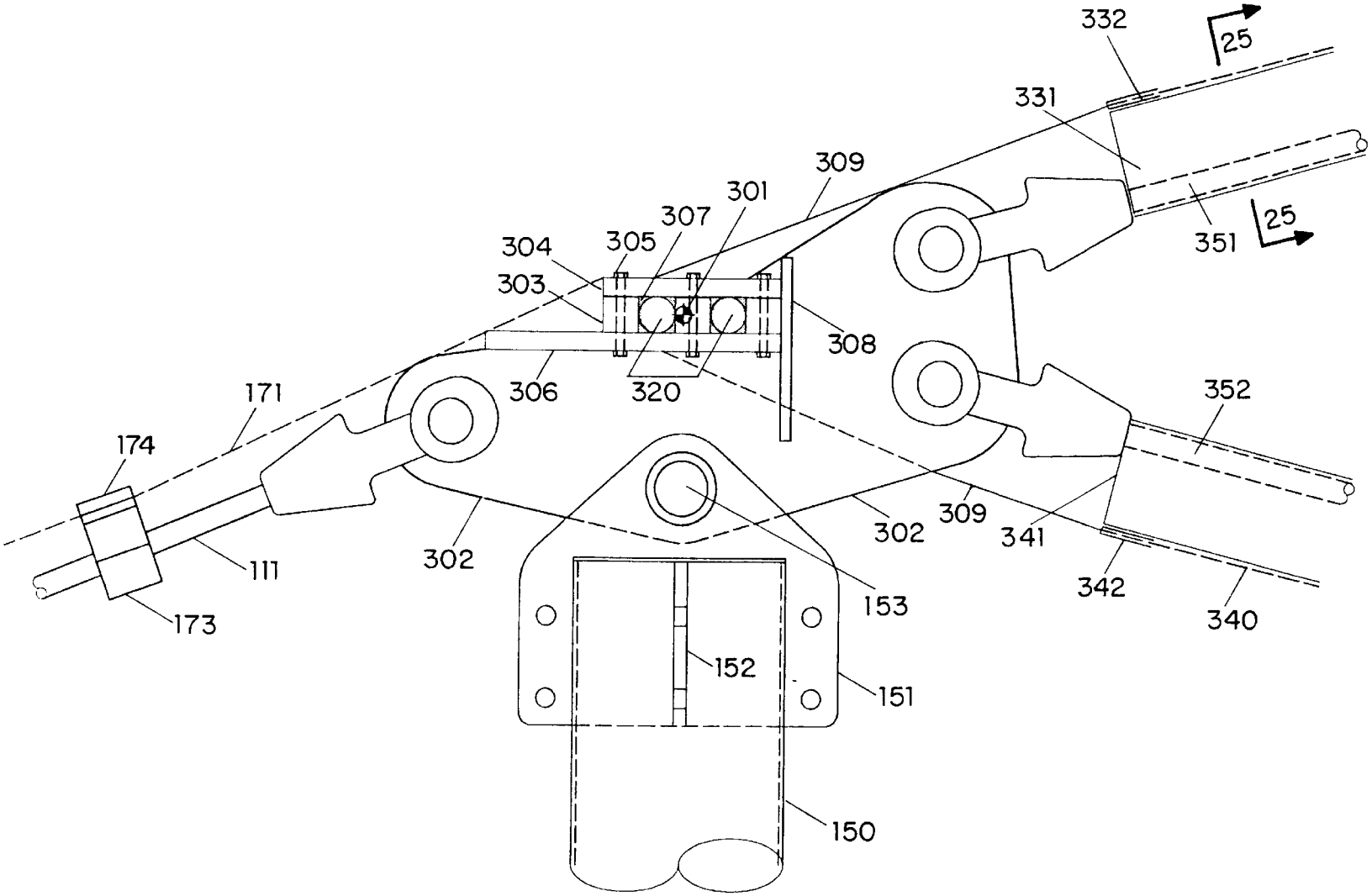
FIG. 24A is an elevated side view of the top of a compression member shown in FIG. 24.

FIGS. 24 and 24A provide a cross-sectional view of the attachment detail between the retractable section 300 and the fixed roof structure. As shown, this connection links the upper end of compression members 150 to the top chord tension members 111 of the parallel trusses 110, to the upper hoop-like tension member 320, and to the retractable cushion section 300. The centerlines of the axial forces to tension members 111, 351 and 352 and of compression member 150 intersect each other at point 301. Plates 151 are provided at the top of compression member 150 to allow attachment to plate 302 by means of pin 153. Plates 152 serve construction and rigging purposes. Plate 306 is secured to plate 302. Upper hoop-like tension member 320 is placed between saddle-like plates 303 and is secured to plate 306 by cover plates 304 and clamping bolts 305. The clamping force imposed by bolts 305 is large enough to develop friction forces to avoid slipping of the upper hoop-like tension member 320 due to differential forces under different loading conditions. The use of a soft packing material 307, such as lead or aluminum, ensures that frictional forces are developed and that they are uniformly distributed. The upper end of the top chord tension member 111 is also attached to plate 302. Finally, the retractable section 300 is connected to plate 302 by means of tension members 351 and 352, that are part of the cable nets 350. A stiffener plate 308 provides a good flow of forces from tension members 351 and 352 to plate 302. Membrane covers 309 close the gaps between the retractable membranes 330 and 340 and the fixed membrane panels 171. Air-tight zippers 332 and 342 are provided to attach covers 309 to upper and lower retractable membranes 330 and 340, respectively.

Figure 25:
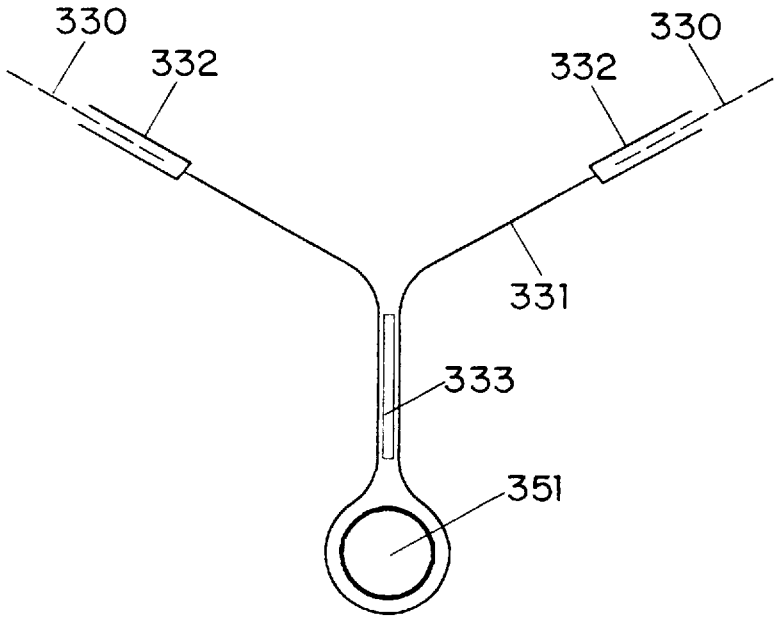
FIG. 25 is a cross-sectional view showing the attachment detail between the membrane and the cable net, taken along line 25—25 in FIG. 24.
Figure 26:
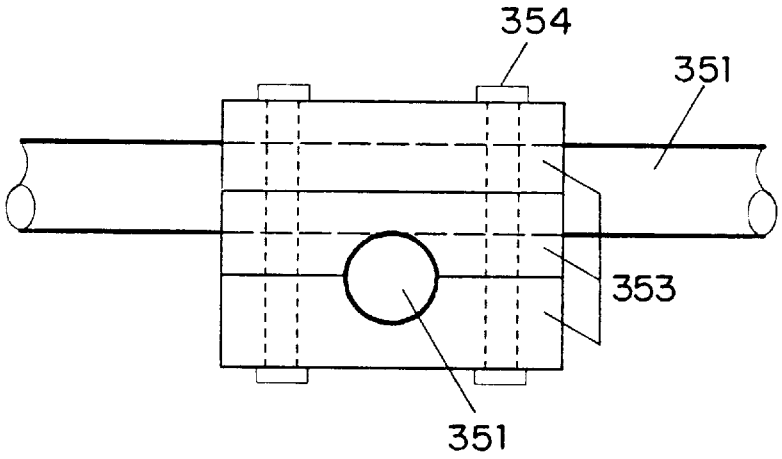
FIG. 26 is a cross-sectional view showing the connection detail between two crossing cables of the cable net in the retractable section.

FIGS. 25 and 26 illustrate typical connection details between an upper cable net member 351 and the upper membrane 330. As shown, a piece of membrane 331 wrapper around upper cable net element 351 has air-tight zippers 332 to which membrane 330 can be secured. Membrane 331 can be mechanically or thermally attached to a backup plate 333. FIG. 26 shows an elevation detail of the crossing of two members 351 of the cable nets 350. A set of grooved plates 353 are bolted together to clamp the crossing members 351. Bolts 354 provide enough clamping force to develop friction forces that will impede slipping of members 351.

Figure 27:
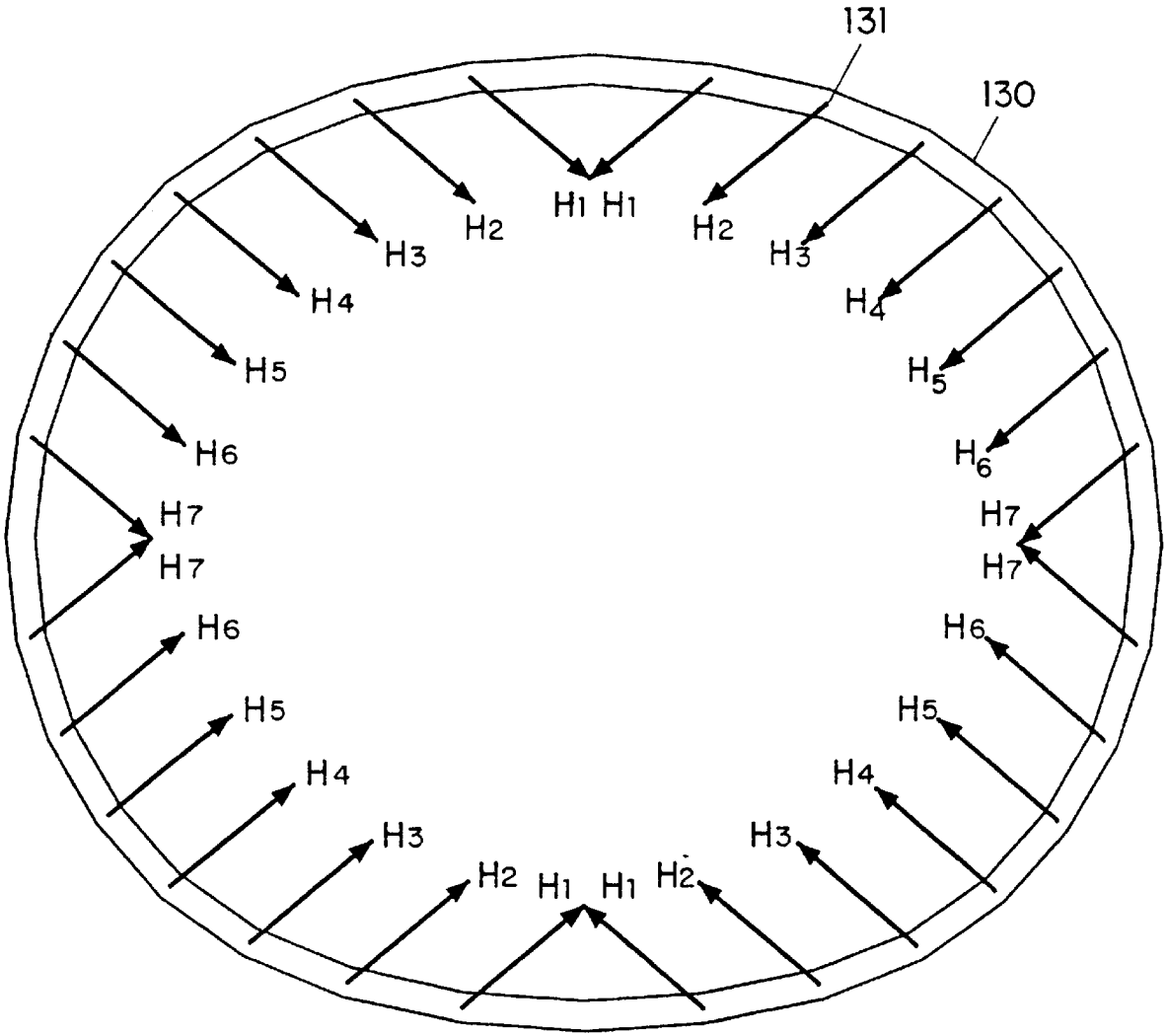
FIGS. 27A through 27E are plan views of other embodiments of the roof structure of the present invention.

FIG. 27 illustrates that the force distribution acting on the compression ring of the retractable roof structure is resolved in a manner similar to that shown in FIG. 15.

Figure 27A:
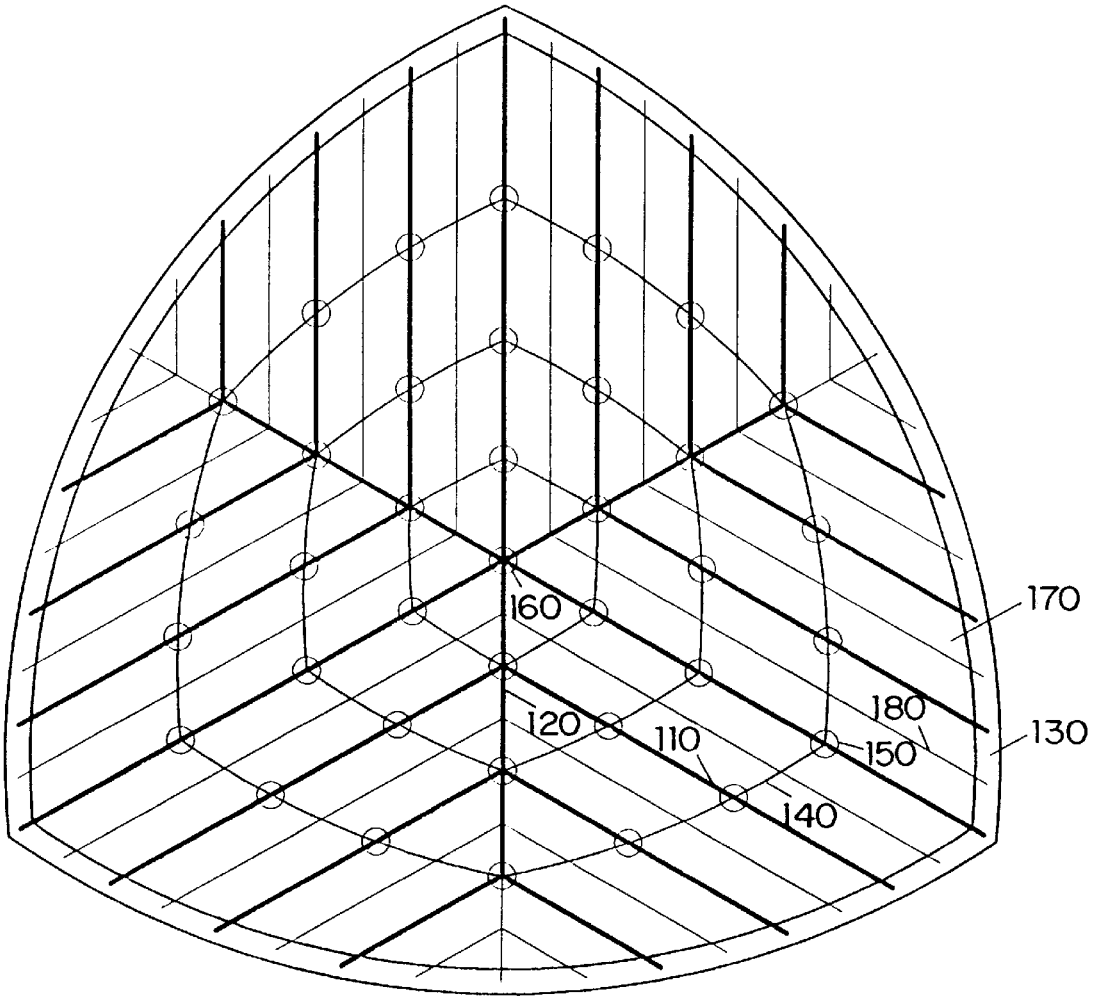
Figure 27B:
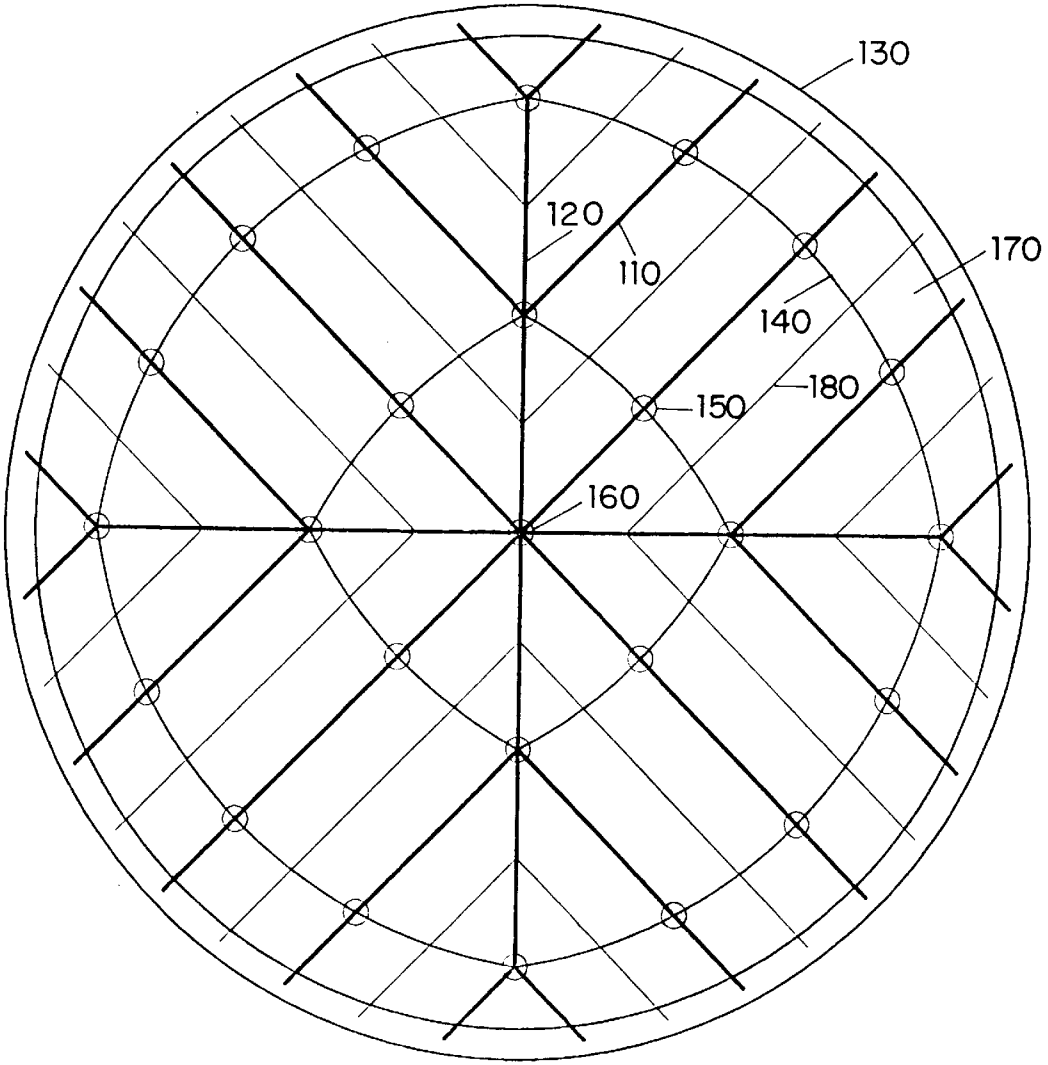
Figure 27C:
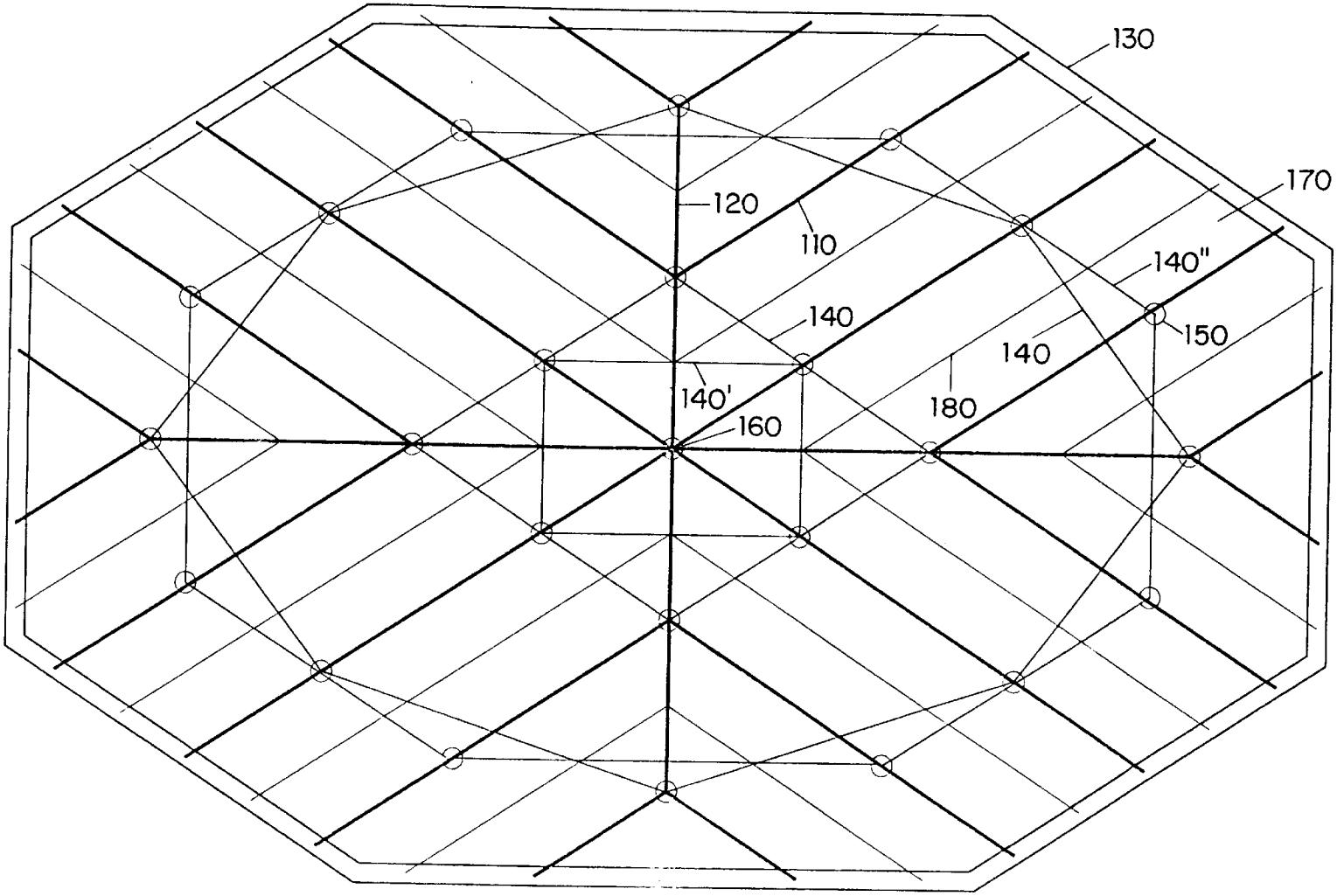
Figure 27D:
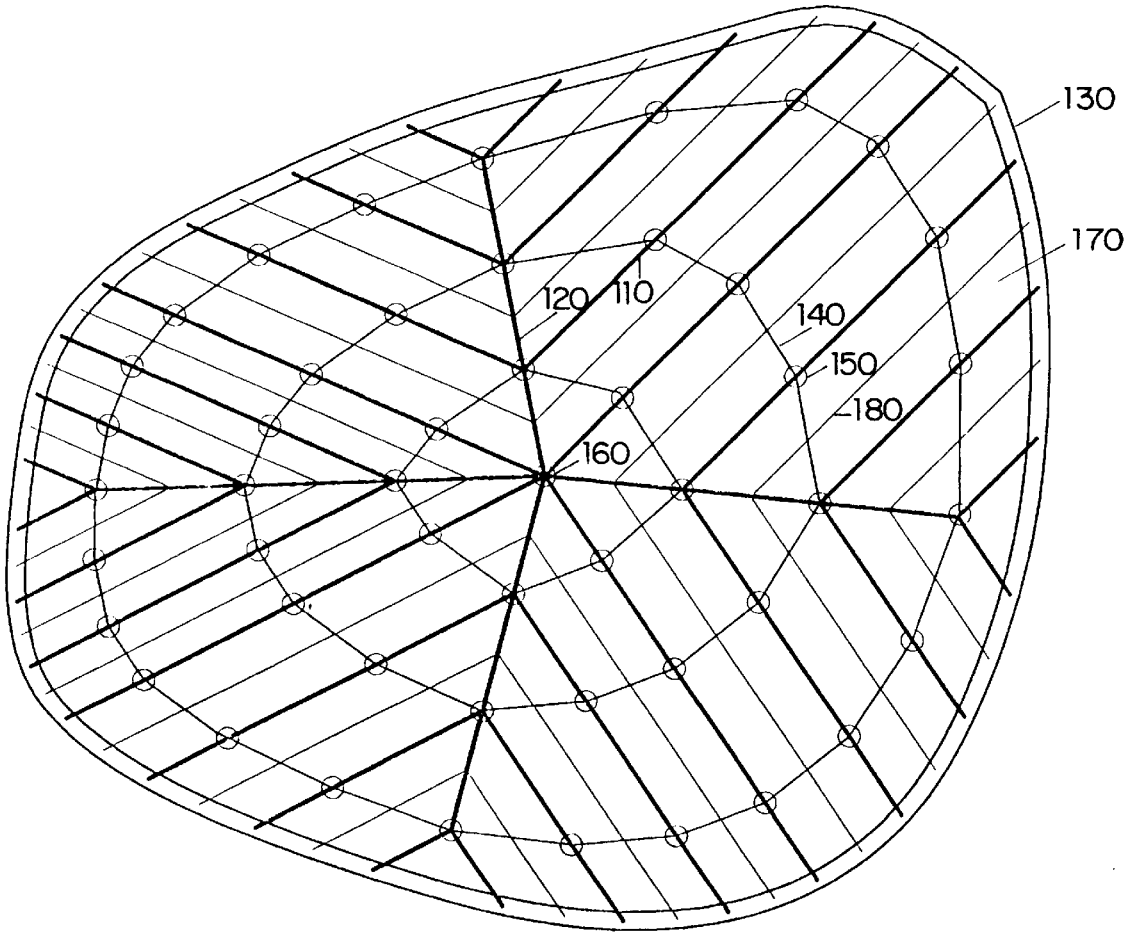
Figure 27E:
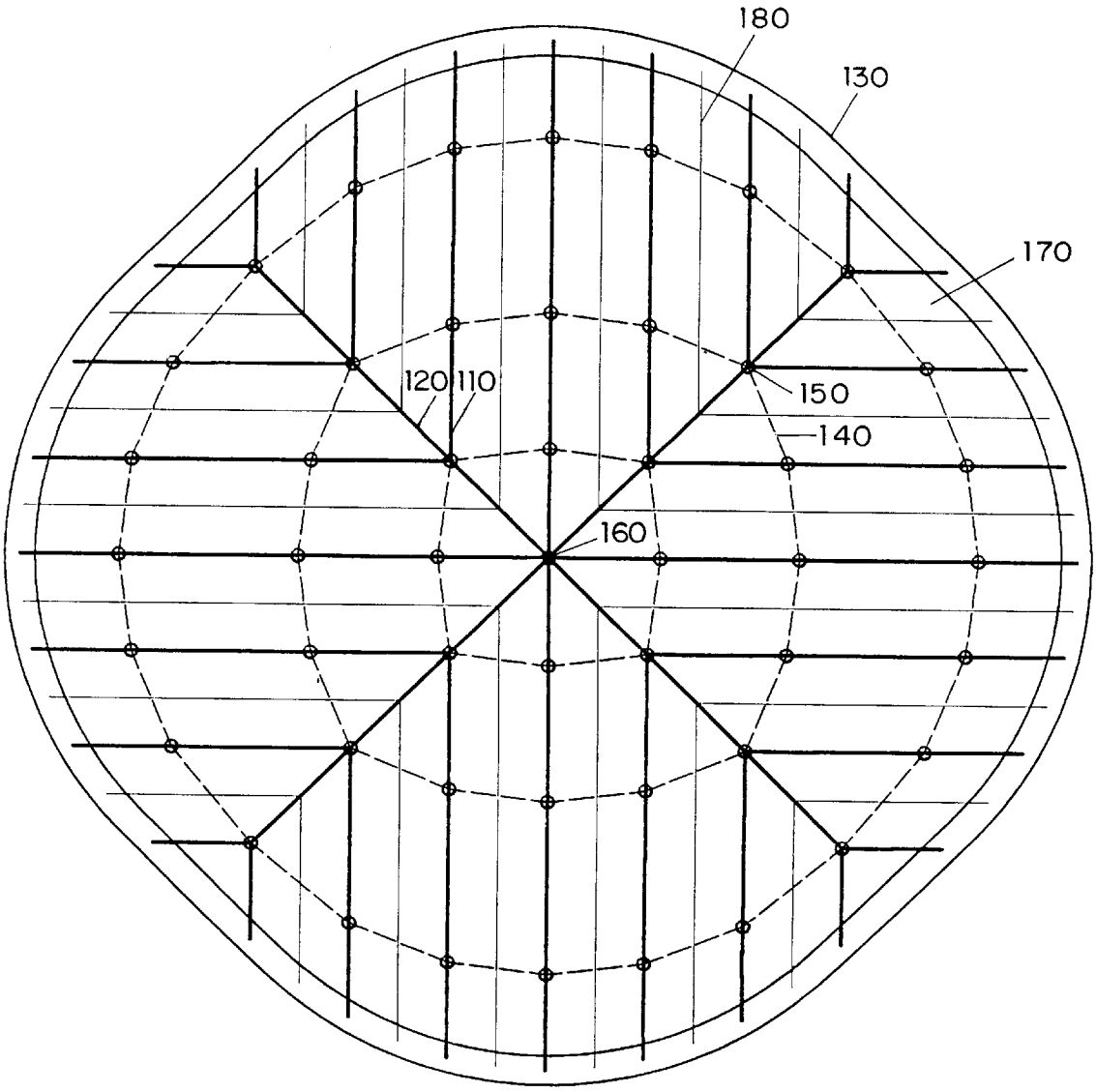

FIGS. 27A through 27D show examples of different plan configurations of dome roof structures that can be realized using the principles of the present invention. In such drawings, like elements are numbered in a like manner. In particular, FIG. 27A shows a dome roof structure design that projects in plan, in substantial accordance with a triangle formed by three circular arcs. FIG. 27B shows a possible roof structure design for a circular roof configuration. FIG. 27C shows a dome roof structure design for a substantially rectangular building with trimmed corners. This straight line segment perimeter illustrates the wide range of application of this invention. At least two hoop-like tension members, 140 and 140', are necessary to link the lower end of a series of compression members 150 located at the same elevation to compensate for the lack of curvature in the straight segments. FIG. 27D shows a roof structure design that projects in plan along a general closed line of arbitrary character. FIG. 27E shows a roof structure design for a substantially square building with trimmed corners.

In the illustrative embodiments, top chord tension members 111 and 121, diagonal tension members 112 and 122, hoop-like tension members 140 and 320, edge tension member 250, and cable nets are preferably made from steel wire rope or steel strand cables. However, in some instances, such elements may be made using steel prestressing strands, high strength steel rods, or other materials that behave well under tension. Each of these tension members can be either one or several elements (cables, strands, or rods). These elements may or may not be continuous. For example, the top chord tension members 111 and the hoop-like tension members 140 have been shown to be continuous as they run through the top and the bottom, respectively, of compression elements 150. However, they could be discontinuous and each segment between adjacent compression members 150 would be individually secured to the connecting plate assembly. The central tension members 161 and 162 can also be made of steel wire rope or steel strand cables. However, bent rolled shapes or built-up steel members may be used as well.

Preferably, compression members 150 are constructed from hollow steel piping. However, the use of wooden posts or steel latticed towers may be used for this purpose. The connections from the tension members 111, 121, 112, 122, 140, 320, 350 to the compression members 150 have been shown to be welded steel plate assemblies, but they could also be high strength steel castings. The compression ring 130 is shown to have an H-shaped cross section, but it could also be a channel section or a hollow box section, all preferably made of reinforced concrete; however, this compression ring could also be a steel space truss.

It is also possible to build the roof structure 100 with a support structure other than compression ring 130. For example, the compression ring support structure may be realized by a set of towers and cable-stays, where the top chord tension members 111 and 121 and the diagonal tension members 112 and 122 of the parallel trusses 110 and the collector trusses 120 are adequately anchored. Alternatively, these tension members can be made run over saddles formed in the towers, extending down to the foundation level where they could be secured into anchor blocks buried deep beneath the ground.

A flexible membrane 170 has been described to cover the space between top chord tension members 111 and 121. This membrane is preferably made of glass fiber coated with fluorocarbon TFE resins (Teflon), but it could also be made of PVC-coated glass fiber, PVC-coated polyester, silicon-coated glass fiber, coated Kevlar™, or other coated carbon and metal fabrics. It is possible to use metal decking or other type of covering as an alternative to a flexible membrane used in the illustrative embodiments.

While illustrative embodiments of the present invention have been described in great detail with reference to the accompanying drawings, it is to be understood that the present invention is not limited to those illustrative embodiments, and that various changes and modifications may be effected therein by those with ordinary skill in the art without departing from the scope or spirit of the invention defined by the appended claims to the invention.

What is claimed is:

1. A vertical compression member for use stressing first and second cable tension members in a roof structure, said vertical compression member comprising:

a variable length compression structure having first and second end portions selectively positionable from each other at any one of a plurality of distances along a longitudinal axis passing through said first and second end portions; and length fixing means, operably associated with said variable length compression structure, for selectively fixing the distance between said first and second sections to one of said plurality of distances so that said vertical compression member stresses two or more cable tension members in said cable dome roof structure.

2. The vertical compression member of claim 1, in combination with a jacking assembly operably connectable to said variable length compression structure, for displacing said first and second end portions along said longitudinal axis at a selected one of said plurality of distances, while said first and second cable tension members engage and apply compressive forces upon said first and second end portions, respectively, thereby permitting said length fixing means to fix the distance between said first and second end portions to said selected distance while under said compressive forces.

3. The vertical compression member of claim 2, which further comprises connection means for connecting said jack assembly to said variable length compression structure when said jack assembly is used to elongate the distance between said first and second end portions, and permitting the disconnection of said jack assembly from said variable compression structure when said jack assembly has been displaced said first and second end portions along said longitudinal axis by said selected distance and said length fixing means has fixed said selected distance between said first and second end portions while said first and second cable tension members engage and apply compressive forces upon said first and second end portions.

4. The vertical compression member of said claim 3, wherein said jacking means comprises a hydraulic jacking mechanism.

5. The vertical compression member of said claim 1, wherein said jacking assembly comprises:

a first pair of rigid jacking members hingedly connected together at a first pivot point and hingedly connectable between said first and second end portions of said variable length compression structure;

a second pair of rigid jacking members hingedly connected together at a second pivot point and hingedly connectable between said first and second end portions of said variable length compression structure; and pulling means for pulling said first and second pivot points towards each other along a transverse axis substantially perpendicular to said longitudinal axis while said first and second cable tension members engage and apply compressive forces upon said first and second end portions, whereby said first and second end portions are displaced away from each other along said longitudinal axis while said first and second cable tension members engage and apply compressive forces upon said first and second end portions.

6. The vertical compression member of claim 5, wherein said pulling means comprises pulling cables extending between said first and second pivot points and means for shortening the length of said pulling cables during a cable stressing operation.

7. The vertical compression member of claim 1, wherein said variable length compression structure comprises:

a first compression section having a hollow interior portion and terminating in said first end portion; and a second compression section being slidably received within the hollow interior portion of said first compression member section, and terminating in said second end portion;

wherein the length of said variable length compression structure is varied by displacing said first and second compression sections along said longitudinal axis.

8. The variable length compression member of claim 7, wherein said length fixing means comprises;

a plurality of spaced apart bores formed entirely through both said first and second compression sections along said hollow interior portion; and a pin insertable through any one of said bores along said hollow interior portion, for fixedly securing the relative position of said first and second compression sections when said variable length compression structure has been sufficiently elongated so that said first and second end portions engage and apply sufficient tensional forces upon said first and second cable tension members.

9. The variable length compression member of claim 8, in combination with a jacking assembly operably connectable to said variable length compression structure, for displacing said first and second end portions along said longitudinal axis by a selected one of said plurality of distances, while said first and second cable tension members engage and apply compressive forces upon said first and second end portions, respectively, and thereby permitting said length fixing means to fix the distance between said first and second end portions to said selected distance while under said compressive forces.

10. The vertical compression member of claim 9, which further comprises connection means for connecting said jack assembly to said variable length compression structure when said jack assembly is used to elongate the distance between said first and second end portions, and for disconnecting said jack assembly from said variable compression structure when said jack assembly has displaced said first and second end portions along said longitudinal axis by said selected distance and said length fixing means has fixed said selected between said first and second end portions while said first and second cable tension members engage and apply compressive forces upon said first and second end portions.

11. The vertical compression member of said claim 8, wherein said jacking means comprises a hydraulic jacking mechanism.

12. The vertical compression member of said claim 9, wherein said jacking assembly comprises:

a first pair of rigid jacking members hingedly connected at a first pivot point and hingedly connectable between said first and second end portions of said variable length compression structure;

a second pair of rigid jacking members hingedly connected at a second pivot point and hingedly connectable between said first and second end portions of said variable length compression structure; and pulling means for pulling said first and second pivot points towards each other along a transverse axis substantially perpendicular to said longitudinal axis while said first and second cable tension members engage and apply compressive forces upon said first and second end portions, whereby said first and second end portions are displaced away from each other along said longitudinal axis while said first and second cable tension members engage and apply compressive forces upon said first and second end portions.

13. The vertical compression member of claim 12, wherein said pulling means comprises pulling cables extending between said first and second pivot points and means for shortening the length of said pulling cables.

14. The vertical compression member of claim 1, wherein said variable length compression structure further comprises:

a first pair of rigid members hingedly connected together at a first pivot point and hingedly connected between said first and second end portions of said variable length compression structure, a second pair of rigid members hingedly connected together at a second pivot point and hingedly connected between said first and second end portions of said variable length compression structure, and pulling means for pulling said first and second pivot points towards each other along a transverse axis substantially perpendicular to said longitudinal axis while said first and second cable tension members engage and apply compressive forces upon said first and second end portions, whereby said first and second end portions are displaced away from each other along said longitudinal axis at a selected one of said plurality of distances while said first and second cable tension members engage and apply compressive forces upon said first and second end portions, permitting said length fixing means to fix the selected distance between said first and second end portions.

15. A method of stressing first and second cable tension members in a roof structure, comprising the steps:

(a) providing a vertical compression member, including (1) a variable length compression structure having first and second end portions selectively positionable from each other at any one of a plurality of distances along a longitudinal axis passing through said first and second end portions, and (2) length fixing means, operably associated with said variable length compression structure for selectively fixing the distance between said first and second sections to one of said plurality of distances so that said vertical compression member stresses two or more cable tension members in said roof structure;

(b) installing said vertical length compression structure between said first and second cable tension members, such that said first end portion operably engages said first cable tension member and said second end portion operably engages said second cable tension member;

(c) operably connecting a jacking assembly to said variable length compression structure;

(d) using said jacking assembly to displace said first and second end portions along said longitudinal axis at a selected one of said plurality of distances, and causing said displaced first and second end portions to stress said first and second cable tension members respectively; and (e) using said length fixing means to fix the distance between said first and second end portions to said selected distance while said first and second cable tension members are stressed by said vertical length compression structure.

16. The method of claim 15, wherein step (a) comprises providing said jacking assembly which comprises a first pair of rigid jacking members hingedly connected at a first pivot point and hingedly connectable between said first and second end portions of said variable length compression structure, a second pair of rigid jacking members hingedly connected together at a second pivot point and hingedly connectable between said first and second end portions of said variable length compression structure, and pulling means for pulling said first and second pivot points towards each other along a transverse axis substantially perpendicular to said longitudinal axis while said first and second cable tension members engage and apply compressive forces upon said first and second end portions; and wherein step (d) comprises using said pulling means to displace said first and second end portions away from each other along said longitudinal axis while said first and second cable tension members engage and apply compressive forces upon said first and second end portions.

* * * * *